US006344313B1

(12) United States Patent
Goto et al.

(10) Patent No.: US 6,344,313 B1
(45) Date of Patent: Feb. 5, 2002

(54) HEAT-DEVELOPABLE PHOTOSENSITIVE MATERIAL

(75) Inventors: Takahiro Goto; Toshihide Ezoe, both of Minami-ashigara; Hiroyuki Suzuki, Minami-ashiagar; Minoru Sakai, Minami-ashigara; Hideki Maeta, Minami-ashigara; Nobuaki Inoue, Minami-ashigara; Masaru Takasaki, Minami-ashigara, all of (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/538,727

(22) Filed: Mar. 30, 2000

(30) Foreign Application Priority Data

| | | |
|---|---|---|
| Mar. 30, 1999 | (JP) | 11-088496 |
| Mar. 30, 1999 | (JP) | 11-089709 |
| Mar. 30, 1999 | (JP) | 11-090126 |
| Mar. 30, 1999 | (JP) | 11-090152 |

(51) Int. Cl.[7] ..... G03C 1/498; G03C 1/34

(52) U.S. Cl. ..... 430/619; 430/531; 430/607; 430/611; 430/613; 430/614

(58) Field of Search ..... 430/619, 531, 430/611, 607, 613, 614

(56) References Cited

U.S. PATENT DOCUMENTS

| | | | | |
|---|---|---|---|---|
| 5,716,775 A | * | 2/1998 | Uehara et al. | 430/611 |
| 5,723,275 A | * | 3/1998 | Wang et al. | 430/528 |
| 5,883,042 A | * | 3/1999 | Defieuw et al. | 503/201 |
| 6,146,822 A | * | 11/2000 | Asanuma et al. | 430/619 |
| 6,165,707 A | * | 12/2000 | Hirano et al. | 430/619 |

FOREIGN PATENT DOCUMENTS

| | | |
|---|---|---|
| JP | 2-251838 | * 10/1990 |
| JP | 9160166 | 6/1997 |
| JP | 9265150 | 10/1997 |

* cited by examiner

*Primary Examiner*—Thorl Chea
(74) *Attorney, Agent, or Firm*—Birch, Stewart, Kolasch & Birch, LLP

(57) ABSTRACT

An object of the present invention is to provide a heat-developable photosensitive material of improved fluctuation of photographic performance (sensitivity, Dmin) arisen from fluctuation of development temperature condition (temperature, time) and storage time after heat development. According to the present invention, there is provided a heat-developable photosensitive material, wherein the photosensitive material comprises, on a support, an image-forming layer containing at least (a) non-photosensitive organic silver salt, (b) photosensitive silver halide, (c) a reducing agent, and (d) a binder, and a protective layer on the image-forming layer, polymer latexes are used as binders of the image-forming layer and the protective layer, and the photosensitive material further comprises, on the image-forming layer side, (e) a nucleating agent and (f) one or more compounds represented by the following formula (1):

(1)

wherein, in the formula (1), $Z^1$ and $Z^2$ each independently represent a halogen atom, $X^1$ represents a hydrogen atom or an electron withdrawing group, $Y^1$ represents —CO— group or —$SO_2$— group, Q represents an arylene group which may have a substituent or a divalent heterocyclic group which may have a substituent, L represents a linking group, W represents carboxyl group or a salt thereof, slufo group or a salt thereof, phosphoric acid group, hydroxyl group, a quaternary ammonium group, or a polyethyleneoxy group, and n represents 0 or 1.

18 Claims, 1 Drawing Sheet

HEAT-DEVELOPABLE PHOTOSENSITIVE MATERIAL

FIELD OF THE INVENTION

The present invention relates to a heat-developable photosensitive material, in particular, a heat-developable photosensitive material for scanners and image setters, which is suitable for photomechanical process. More specifically, the present invention relates to a heat-developable photosensitive material for photomechanical process, which can affords images of low fog, and little increase of fog and little fluctuation of sensitivity during storage before heat development as well as images with high Dmax (maximum density) suitable for use in photomechanical process.

BACKGROUND OF THE INVENTION

A large number of photosensitive materials are known which have a photosensitive layer on a support and form image by imaging exposure. An example of a system that enables environmental conservation or simplification of image formation includes a technique of forming an image by heat development.

In recent years, reduction of amount of waste processing solutions is strongly desired in the field of photomechanical processes from the standpoints of environmental protection and space savings. Techniques relating to heat-developable photosensitive materials for use in photomechanical processes are required which enables efficient exposure by a laser scanner or a laser image setter and formation of a clear black image having high resolution and sharpness. The heat-developable photosensitive materials can provide users with a simple and non-polluting heat development processing system which eliminates the use of solution-type processing chemicals.

Methods for forming an image by heat development are described, for example, in U.S. Pat. Nos. 3,152,904 and 3,457,075 and D. Klosterboer, Imaging Processes and Materials, "Thermally Processed Silver Systems", 8th ed., compiled by J.Sturge, V. Walworth and A. Shepp, Chapyer 9, p.279, Neblette (1969). The photosensitive material contains a reducible light-insensitive silver source (e.g., organic silver salt), a photocatalyst (e.g., silver halide) in a catalytically active amount, and a reducing agent for silver, which are usually dispersed in an organic binder matrix. This photosensitive material is stable at an ambient temperature, but when the material is heated at a high temperature (e.g., 80° C. or higher) after light exposure, silver is produced through an oxidation-reduction reaction between the reducible silver source (which functions as an oxidizing agent) and the reducing agent. Theoxidation-reduction reaction is accelerated by catalytic action of a latent image generated upon exposure. The silver produced by the reaction of the reducible silver salt in the exposure region provides a black image and this presents a contrast to the non-exposure region to form an image.

Such heat-developable photosensitive materials are practically used mainly in the field of microphotography and the medical field. However, they use a high development temperature of 100° C. or higher and hence suffer from problems that slight change of development temperature or development time may cause fluctuation of performance, and they show poor image storability. Therefore, improvement has been desired.

On the other hand, low contrast heat-developable photosensitive materials have not been accepted in the field of graphic arts, since higher contrast is required in that field.

To overcome this problem, heat development techniques for affording ultrahigh contrast characteristics by using a nucleating agent have been disclosed in U.S. Pat. Nos. 5,496,695, 5,536,622, 5,545,515 and 5,635,339. However, in most of these photosensitive materials, a photosensitive layer is formed by applying a coating solution containing an organic solvent such as toluene, methyl ethyl ketone (MEK) or methanol as a solvent. However, use of an organic solvent as a solvent is not preferred because of its adverse effect on a human body during the production process or in view of the cost for recovery of the solvent and other process steps.

In addition, although the heat-developable photosensitive materials disclosed in the aforementioned patent documents, which have ultrahigh contrast characteristic, show good photographic performance under an optimum heat development condition, they suffer problems that slight change of environmental temperature or humidity, or development time or temperature may cause quick changes of maximum density (Dmax) and half tone dot percentage and raise of Dmin.

Accordingly, a method of forming a photosensitive layer by applying a coating solution containing a water solvent free of the aforementioned problems has been proposed (hereinafter referred to as "aqueous photosensitive layer"). For example, JP-A-49-52626 (the term "JP-A" as used herein means an "unexamined published Japanese patent application"), JP-A-53-116144 and so forth describe use of gelatin as a binder, and JP-A-50-151138 describes use of polyvinyl alcohol as a binder.

Furthermore, JP-A-60-61747 describes use of gelatin and polyvinyl alcohol in combination. JP-A-58-28737 describes a photosensitive layer containing a water-soluble polyvinyl acetal as a binder.

In fact, when such a binder is used, a photosensitive layer can be formed using a coating solution comprising a water solvent, and this is advantageous in view of environmental protection and cost.

However, when a polymer selected from gelatin, polyvinyl alcohol, water-soluble polyacetal and so forth is used as a main binder, a coating obtained has a coated surface of which properties are not acceptable for practical use, because of the poor compatibility of the polymer with an organic silver salt. Moreover, blackening density in exposed areas becomes low and density in unexposed areas becomes high, and thus there are provided only images of which commercial value is seriously impaired.

Techniques for aqueous photosensitive material that are excellent in view of environmental protection and cost, and which can provide good coated surface property and ultrahigh contrast characteristics are disclosed in JP-A-10-10669, Japanese Patent Application Nos. 9-171750, JP-A-11-174621, JP-A-11-218877, JP-A-11-223900, JP-A-223902, JP-A-11-282128, and JP-A-11-295845. These techniques markedly improved the coated surface property and photographic performance. However, it is desired to further improve the performance in order to attain stable quality in the commercial market.

Further, a color photomechanical process is carried out by using four films for the four colors, i.e., Y, M, C and K. When these four films are simultaneously subjected to light exposure and heat development, any particular problem is not caused. However, the light exposure and the heat development are often performed on different occasions for these four films. In such a case, because the period after the heat development is different for each film, the sizes of the films may not fit to one another, which often causes color deviation.

In order to solve this problem, techniques utilizing a support having an undercoat layer containing a vinylidene chloride copolymer for heat-developable photosensitive materials are disclosed in JP-A-2000-39684 and Japanese Patent Application Nos. 10-355429. Although these techniques exhibit marked effectiveness on dimensional change, they have newly arisen problems, i.e., increase of fog (Dmin), fluctuation of light exposure time to PS plates and so forth, which are caused by storage or light irradiation of treated films.

SUMMARY OF THE INVENTION

An object of the present invention is to provide a heat-developable photosensitive material of improved fluctuation of photographic performance (sensitivity, Dmin) arisen from fluctuation of development temperature condition (temperature, time) and storage period after heat development, more specifically, to provide a heat-developable photosensitive material more stably affording ultrahigh contrast characteristics for photomechanical process, and to provide a heat-developable photosensitive material of excellent dimensional stability. Another object of the present invention is to provide a heat-developable photosensitive material for photomechanical process, in particular, for scanners and image setters, which affords an image with low fog, little increase of fog and little fluctuation of sensitivity during storage before light exposure and an image of high Dmax (maximum density) suitable for use in photomechanical process, and which can be performed by applying an aqueous coating solution which is advantageous in view of environmental protection and costs According to the present invention, there is provided a heat-developable photosensitive material, wherein the photosensitive material comprises, on a support, an image-forming layer containing at least (a) non-photosensitive organic silver salt, (b) photosensitive silver halide, (c) a reducing agent, and (d) a binder, and a protective layer on the image-forming layer, polymer latexes are used as binders of the image-forming layer and the protective layer, and the photosensitive material further comprises, on the image-forming layer side, (e) a nucleating agent and (f) one or more compounds represented by the following formula (1).

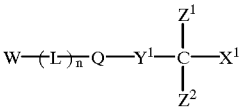

In the formula (1), $Z^1$ and $Z^2$ each independently represent a halogen atom, $X^1$ represents a hydrogen atom or an electron withdrawing group, $Y^1$ represents —CO— group or —$SO_2$— group, Q represents an arylene group which may have a substituent or a divalent heterocyclic group which may have a substituent, L represents a linking group, W represents carboxyl group or a salt thereof, slufo group or a salt thereof, phosphoric acid group, hydroxyl group, a quaternary ammonium group, or a polyethyleneoxy group, and n represents 0 or 1.

The nucleating agent preferably consists of one or more of a substituted alkene derivative represented by the following formula (2), a substituted isoxazole derivative represented by the following formula (3), and an acetal compound represented by the following formula (4).

(2)

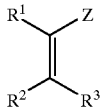

(3)

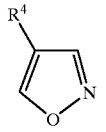

(4)

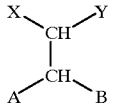

In the formula (2), $R^1$, $R^2$ and $R^3$ each independently represents a hydrogen atom or a substituent, and Z represents an electron withdrawing group or a silyl group. In the formula (2), $R^1$ and Z, $R^2$ and $R^3$, $R^1$ and $R^2$, or $R^3$ and Z may be combined with each other to form a ring structure.

In the formula (3), $R^4$ represents a substituent.

In the formula (4), X and Y independently represent a hydrogen atom or a substituent, A and B independently represent an alkoxy group, an alkylthio group, an alkylamino group, an aryloxy group, an arylthio group, an anilino group, a heterocyclyloxy group, a heterocyclylthio group or a heterocyclylamino group, and X and Y, or A and B may be combined with each other to form a ring structure.

Preferably, the support has, on both surfaces, one or more undercoat layers which have a thickness of 0.3 $\mu$m or more (total thickness for each surface) and contain a vinylidene chloride copolymer containing at least 70% by weight of repeating units of vinylidene chloride monomers.

Preferably, the nucleating agent consists of one or more compounds represented by the formula (A) or (B).

(A)

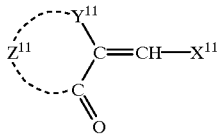

(B)

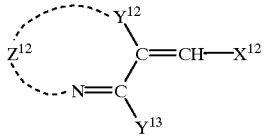

In the formula (A) and (B), $Z^{11}$ and $Z^{12}$ each represent a nonmetallic atomic group which can form a 5- to 7-membered ring structure including $Z^{11}$ and $Z^{12}$, $Y^{11}$ and $Y^{12}$ each represent —C((=O)— group or —$SO_2$— group, and $X^{11}$ and $X^{12}$ each represent hydroxyl group (or a salt thereof), an alkoxy group, an aryloxy group, a heterocyclyloxy group, mercapto group (or a salt thereof), an alkylthio group, an arylthio group, a heterocyclylthio group, amino group, an alkylamino group, an arylamino group, a heterocyclylamino group, anacylamino group, a sulfonamide group, or a heterocyclic group. $Y^{13}$ represents a hydrogen atom or a substituent.

Preferably, the heat-developable photosensitive material of the present invention preferably contains, on the side of the support provided with the photosensitive silver halide, at least one compound represented by the following formula (Z).

(Z)

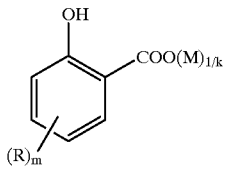

(Z)

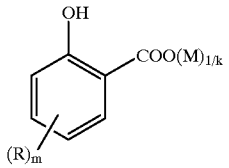

In the formula (Z), M represents a hydrogen atom or a k-valent cation, and R represents a substituent. m represents an integer of 1–4. When n is 2 or higher number, a plurality of R maybe the same or different. k is an integer of 1 or higher, and when M is a hydrogen atom, k is 1.

Preferably, the heat-developable photosensitive material of the present invention has a film pH of 6.0 or less.

Preferably, the heat-developable photosensitive material of the present invention further contains, on the side of the support provided with the photosensitive silver halide, at least one compound represented by the following formula (5).

$$Z^{11}—SO_2SM \quad (5)$$

In the formula (5), $Z^{11}$ represents an aliphatic hydrocarbon group, an aryl group or a heterocyclic group, and M represents a cation.

Preferably, the photosensitive silver halide is subjected to spectral sensitization in the range of 750–1400 nm.

Preferably,the polymer latex of the image-forming layer comprises a polymer latex having a glass transition temperature of −30 to 40° C. in an amount of at least 50% by weight of

PREFERRED EMBODIMENT OF THE INVENTION

Figure 1:
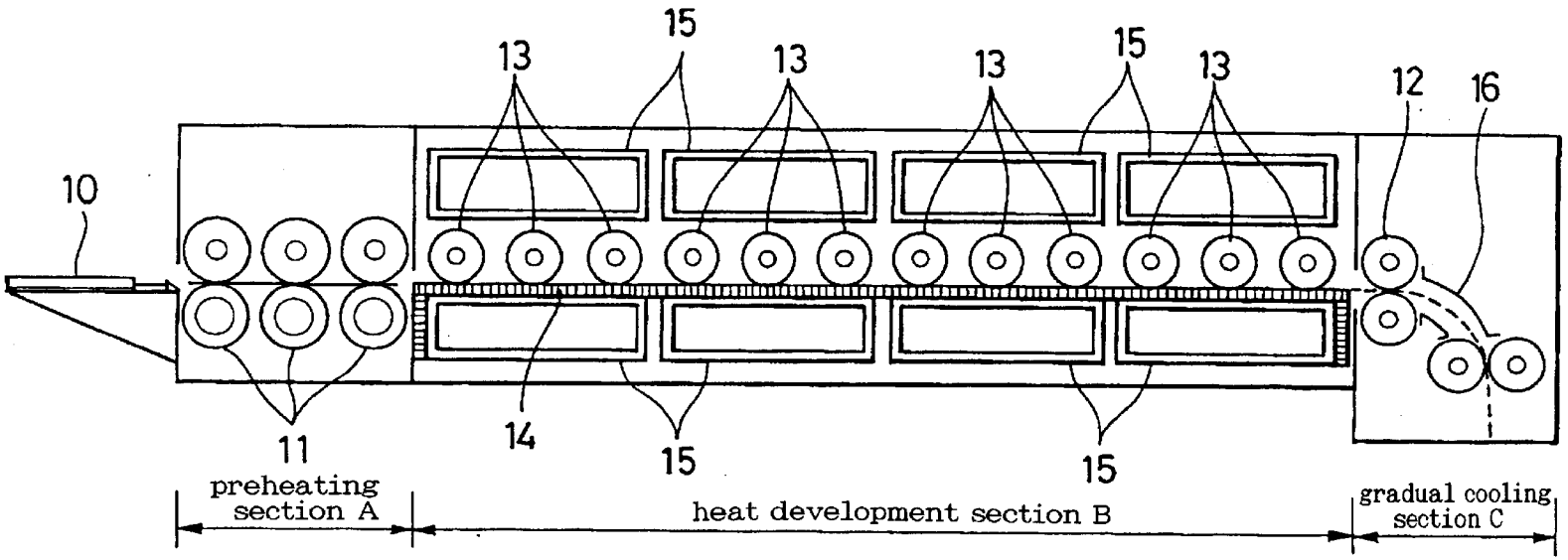
FIG. 1 is a side view of an exemplary heat developing apparatus used for the heat developing process of the photosensitive material of the present invention. In the figure, there are shown a heat-developable photosensitive material 10, carrying-in roller pairs 11, carrying-out roller pairs 12, rollers 13 a flat surface 14, heaters 15, and guide panels 16. The apparatus consists of a preheating section A, a heat development section B, and a gradual cooling section C.

Embodiments of the present invention and methods for practicing the present invention will be explained in detail below.

The heat-developable photosensitive material of the present invention comprises, on a support, an image-forming layer containing at least (a) non-photosensitive organic silver salt, (b) photosensitive silver halide, (c) a reducing agent, and (d) a binder, and a protective layer on the image-forming layer. Polymer latexes are used as binders of the image-forming layer and the protective layer. The photosensitive material further comprises, on the image-forming layer side, (e) a nucleating agent and (f) at least one compound represented by the following formula (1). According to the present invention, by adding a compound represented by the following formula (1) to at least one layer on the side provided with the image-forming layer (i.e., the image-forming layer, a layer adjacent thereto, or a protective layer), fluctuation of photographic performance due to temperature variation during the heat development can be suppressed, and raise of Dmin during storage after heat development can be reduced. This effect becomes marked in a system containing a nucleating agent as a film for mechanical process, or a system which utilizes a support having an undercoat layer containing a vinylidene chloride copolymer.

In a preferred embodiment of the present invention, by adding a thiosulfonic acid derivative represented by the formula (5) to a layer on the image-forming layer side, heat-induced fog in non-image areas can be suppressed, and good storability can be obtained.

Furthermore, another preferred embodiment of the present invention utilizes a photosensitive silver halide subjected to spectral sensitization in the range of 750–1400 nm. When such a photosensitive silver halide is used, the advantages of the present invention become marked.

The heat-developable photosensitive material of the present invention contains non-photosensitive silver salt (organic silver salt). The organic silver salt which can be used in the present invention is relatively stable against light, but forms a silver image when it is heated at 80° C. or higher in the presence of an exposed photocatalyst (e.g., a latent image of photosensitive silver halide) and a reducing agent. The organic silver salt may be any organic substance containing a source capable of reducing the silver ion. A silver salt of an organic acid, particularly a silver salt of a long chained aliphatic carboxylic acid (having from 10 to 30, preferably from 15 to 28 carbon atoms) is preferred. A complex of an organic or inorganic silver salt, whose ligand has a complex stability constant of from 4.0 to 10.0, is also preferred. The silver-supplying substance may constitute preferably from about 5 to 70% by weight of the image-forming layer. Examples of preferred organic silver salt include a silver salt of an organic compound having a carboxyl group. Examples include an aliphatic carboxylic acid silver salt and an aromatic carboxylic acid silver salt, but the present invention is not limited to these examples. Preferred examples of the aliphatic carboxylic acid silver salt include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and a mixture thereof.

Silver salts of compounds having mercapto or thione group and derivatives thereof may also be used as the organic silver salt. Preferred examples of these compounds include a silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido)benzothiazole, silver salts of thioglycolic acids such as silver salts of S-alkylthioglycolic acids wherein the alkyl group has 12 to 22 carbon atoms, silver salts of dithiocarboxylic acids such as silver salt of dithioacetic acid, silver salts of thioamides, silver salt of 5-carboxyl-1-methyl-2-phenyl-4-thiopyridine, silver salts of mercaptotriazines, silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thione compounds such as silver salt of 3-(3-carboxyethyl)-4-methyl-4-thiazoline-2-thione as described in U.S. Pat. No. 3,301,678. Compounds containing an imino group may also be used. Preferred examples of such a compound include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Various silver acetylide compounds as described, for example, in U.S. Pat. Nos. 4,761,361 and 4,775,613 may also be used.

Among organic acid silver salts and combinations of the organic acid silver salts, preferred in the present invention is an organic acid silver salt having a silver behenate content of 75 mol % or more, more preferably 85 mol % of more, particularly preferably 95 mol % or more. The term "silver behenate content" as used herein means a partial ratio in mol of the silver behenate to the organic acid silver salt used. Preferred examples of the organic acid silver salt other than silver behenate, contained in the organic acid silver salt for use in the present invention include the above-described organic acid silver salts.

The organic acid silver salt preferred in the present invention is prepared by reacting an alkali metal salt (e.g., Na salt, K salt, Li salt) solution or suspension of the above-described organic acid with silver nitrate. The organic acid alkali metal salt for use in the present invention can be obtained by treating the organic acid with an alkali. The preparation of the organic acid silver salt for use in the present invention may be performed batchwise or continuously in any appropriate reaction vessel while stirring and the stirring may be effected by any stirring method according to the required properties of the grain. The organic acid silver salt is preferably prepared by means of a method of gradually or rapidly adding an aqueous silver nitrate solution to the reaction vessel containing an organic acid alkali metal solution or suspension, a method of gradually or rapidly adding a previously prepared organic acid alkali metal salt solution or suspension to the reaction vessel containing an aqueous silver nitrate solution, or a method of previously preparing an aqueous silver nitrate solution and an organic acid alkali metal salt solution or suspension and simultaneously adding those solutions to the reaction vessel.

The aqueous silver nitrate solution and the organic acid alkali metal salt solution or suspension may have any concentration and may be added at any addition rate so as to control the grain size of the organic acid silver salt prepared. The aqueous silver nitrate solution and the organic acid alkali metal salt solution or suspension each may be added by a method of adding the solution at a constant rate or a method of adding the solution while increasing or decreasing the addition rate with any time function. The solution may also be added to the liquid surface or in the liquid of the reaction solution. When an aqueous silver nitrate solution and an organic acid alkali metal salt solution or suspension are previously prepared and then simultaneously added to a reaction vessel, either of the aqueous silver nitrate solution and the organic acid alkali metal salt solution or suspension may be added in advance but the aqueous silver nitrate solution is preferably added in advance by a precedence degree of from 0 to 50 vol %, more preferably from 0 to 25 vol %, of the entire addition amount. Furthermore, a method of adding the solution while controlling the pH or silver potential of the reaction solution during the reaction as described in JP-A-9-127643 may be preferably used.

The pH of the aqueous silver nitrate solution and the organic acid alkali metal salt solution or suspension to be added may be adjusted according to the required properties of the grain. For adjusting the pH, any acid or alkali may be added. Furthermore, depending on the required property of the grain, for example, in order to control the grain size of the organic acid silver salt prepared, the temperature in the reaction vessel may be appropriately selected. The temperature of the aqueous silver nitrate solution and the organic acid alkali metal salt solution or suspension to be added may also be appropriately controlled. In order to ensure the liquid flowability of the organic acid alkali metal salt solution or suspension, the solution is preferably heat-insulated by heating at 50° C. or more.

The organic acid silver salt for use in the present invention is preferably prepared in the presence of a tertiary alcohol. The tertiary alcohol preferably has a total carbon number of 15 or less, more preferably 10 or less. Examples of preferred tertiary alcohols include tert-butanol. However, tert-butanol that can be used for the present invention is not limited to it.

The tertiary alcohol for use in the present invention may be added in any timing during the preparation of the organic acid silver salt but the tertiary alcohol is preferably added at the time of preparation of the organic acid alkali metal salt to dissolve the organic alkali metal salt. The tertiary alcohol for use in the present invention may be added in any amount of from 0.01 to 10 in terms of the weight ratio to $H_2O$ used as a solvent at the preparation of the organic acid silver salt but preferably added in an amount of from 0.03 to 1 in terms of the weight ratio to $H_2O$.

Although the shape of the organic silver salt is not particularly limited, an particular crystal form having a short axis and a long axis is preferred. In the present invention, the short axis is preferably from 0.01 to 0.20 $\mu$m, more preferably from 0.01 to 0.15 $\mu$m, and the long axis is preferably from 0.10 to 5.0 $\mu$m, more preferably from 0.10 to 4.0 $\mu$m. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 80% or less, more preferably 50% or less, particularly preferably 30% or less. The shape of the organic silver salt can be determined from a transmission electron microscope image of organic silver salt dispersion. Another method for determining the monodispesibility is a method involving obtaining the standard deviation of a volume weight average diameter of the organic silver salt. The percentage (coefficient of variation) of the value obtained by dividing the standard deviation by the volume weight average diameter is preferably 80% or less, more preferably 50% or less, still more preferably 30% or less. As a measurement method, for example, the grain size can be determined by irradiating organic silver salt dispersed in a solution with a laser ray and determining an auto correlation function of the fluctuation of the scattered light on the basis of the change in time (volume weight average diameter). The average grain size determined by this method is preferably from 0.05 to 10.0 $\mu$m, more preferably from 0.1 to 5.0 $\mu$m, further preferably from 0.1 to 2.0 $\mu$m, as a solid fine grain dispersion.

The organic silver salt that can be used in the present invention is preferably desalted. The desalting method is not particularly limited and any known method may be used. Known filtration methods such as centrifugal filtration, suction filtration, ultrafiltration and flocculation washing by coagulation may be preferably used.

In order to obtain an organic silver salt solid dispersion having a high S/N ratio and a small grain size and being free from coagulation, a preferable example include a dispersion method comprising the steps of converting a water dispersion, that contains an organic silver salt as an image-forming medium and contains substantially no photosensitive silver salt, to a high-speed flow dispersion, and then releasing the pressure.

The dispersion thus obtained is then mixed with an aqueous photosensitive silver salt solution to produce a coating solution containing the photo sensitive image-forming medium. The coating solution enables the manufacture of a heat-developable photosensitive material exhibiting low haze and low fog, and having high sensitivity. When a photosensitive silver salt coexists at the time of dispersing process under a high-pressure and at high-speed flow, fog frequency may increase and sensitivity may often highly decrease. Furthermore, when an organic solvent is used as a dispersion medium instead of water, haze and fog may increase and sensitivity may likely be decreased. When a conversion method where a part of the organic silver salt in the dispersion is converted into a photosensitive silver salt is used instead of the method of mixing an aqueous photosensitive silver salt solution, sensitivity may likely be decreased.

The above-described water dispersion obtained using conversion under a high-pressure and at high-speed flow is substantially free of a photosensitive silver salt. The content thereof is 0.1 mol % or less based on the light-insensitive organic silver salt. A photosensitive silver salt is not added intentionally.

The solid dispersing apparatus and technique used for performing the above-described dispersion method in the present invention are described in detail, for example, in Toshio Kajiuchi and Hiromoto Usui, Bunsan-Kei Rheology to Bunsanka Gijutsu (Rheology of Dispersion System and Dispersion Technology), pp.357–403, Shinzan Sha Shuppan (1991), and Kagaku Kogakuno Shinpo (Progress of Chemical Engineering), pp. 184–185, compiled by Corporation Kagaku Kogakukai Tokai Shibu, Maki Shoten (1990). The dispersion method used in the present invention comprises the steps of supplying a water dispersion containing at least an organic silver salt under a positive pressure by means of a high-pressure pump or the like into a pipeline, passing the dispersion through a narrow slit provided inside the pipeline, and then subjecting the dispersion to rapid pressure reduction to perform fine dispersion.

As for the high-pressure homogenizer which may be used in the present invention, it is considered that the dispersion into fine grains is generally achieved by dispersion forces such as (a) "shear force" generated at the passage of a dispersoid through a narrow slit under a high pressure at a high speed, and (b) "cavitation force" generated at the time of the release of the dispersoid from a high pressure to normal pressure. As the dispersion apparatus of this class, an example include the Golline homogenizer previously used. By using this apparatus, the solution to be dispersed is transported under a high pressure and converted into a high-speed flow through a narrow slit on the cylinder surface, and the energy of the flow allows collision of the flow against the peripheral wall surface to achieve emulsification and dispersion. The pressure applied may generally be from 100 to 600 kg/cm$^2$ and the flow velocity may be from several m/sec to 30 m/sec. In order to increase the dispersion efficiency, some apparatuses are designed wherein a part of a high flow velocity is formed into a serrated shape to increase the frequency of collision. Apparatuses capable of dispersion under a higher pressure and at a higher flow velocity have been developed in recent years, and examples include Microfluidizer (manufactured by Microfluidex International Corporation) and Nanomizer (manufactured by Tokusho Kika Kogyo KK).

Examples of the dispersing apparatus which can be suitably used in the present invention include Microfluidizer M-110S-EH (with G10Z interaction chamber), M-110Y (with H10OZ interaction chamber), M-140K (with G10Z interaction chamber), HC-5000 (with L30Z or H230Z interaction chamber) and HC-8000 (with E230Z or L30Z interaction chamber), all manufactured by Microfluidex International Corporation.

By using these apparatuses, an aqueous dispersion containing at least an organic silver salt is transported under a positive pressure by means of a high-pressure pump or the like into the pipeline, and the solution is passed though a narrow slit provided inside the pipeline so that a desired pressure is applied. Then, the pressure in the pipeline is rapidly released to the atmospheric pressure to apply a rapid pressure decrease to the dispersion to obtain an optimal organic silver salt dispersion for use in the present invention.

In advance of the dispersion operation, the stock solution is preferably subjected to preparatory dispersion. The preparatory dispersion may be performed using a known dispersion means (for example, a high-speedmixer, a homogenizer, a high-speed impact mill, a Banbary mixer, a homomixer, a kneader, a ball mill, a vibrating ball mill, a planetary ball mill, an attriter, a sand mill, a bead mill, a colloid mill, a jet mill, a roller mill, a tronemill or a high-speed stone mill). Other than the mechanical dispersion, the stock solution may be coarsely dispersed in a solvent by controlling pH and thereafter formed into fine grains in the presence of a dispersion aid by changing pH. The solvent used for the coarse dispersion may be an organic solvent. The organic solvent is usually removed after the completion of fine grain formation.

In dispersing process of the organic silver salt for use in the present invention, dispersion having a desired grain size may be obtained by controlling the flow velocity, the difference in the pressure before and after at the pressure dropping and the frequency of the processing. From viewpoints of photographic performance and the grain size, the flow velocity is preferably from 200 to 600 m/sec and the difference in the pressure at the pressure dropping is preferably from 900 to 3,000 kg/cm$^2$, and more preferably, the flow velocity is from 300 to 600 m/sec, and the difference in the pressure at the pressure dropping is from 1,500 to 3,000 kg/cm$^2$. The frequency of the dispersion processing may be appropriately chosen as required, and is usually from 1 to 10 times. From a viewpoint of productivity, the frequency is approximately from 1 to 3 times. The water dispersion under a high pressure is preferably not warmed at a high temperature from viewpoints of dispersibility and photographic performance. At a high temperature above 90° C., a grain size may readily become large and fog may be increased. Accordingly, in the present invention, the water dispersion is preferably kept at a temperature of from 5 to 90° C., more preferably from5to 80° C., and most preferably from 5 to 65° C., by providing a cooling step before the conversion into a high pressure and high flow velocity, after the pressure drop, or both before the conversion and after the pressure drop. It is particularly effective to provide the cooling step at the time of dispersion under a high pressure of from 1,500 to 3,000 kg/cm$^2$. The cooler may be appropriately selected from a double pipe, a double piper using a static mixer, a multi-tubular exchanger and a coiled heat exchanger, depending on an amount of heat exchange to be treated. The size, wall thickness or material of a pipe may be appropriately selected to increase heat exchange efficiency depending on an applied pressure. In addition, depending on an amount of heat exchange, a refrigerant used in the cooler may be a well water at 20° C. or a chilled water at from 5 to 10° C. cooled by a refrigerator, and if desired, a refrigerant such as ethylene glycol/water at −30° C. may also be used.

In the dispersion operation of the present invention, the organic silver salt is preferably dispersed in the presence of a dispersant (dispersion aid) soluble in an aqueous solvent. Examples of the dispersion aid include synthetic anion polymers such as polyacrylic acid, copolymer of acrylic acid, maleic acid copolymer, maleic acid monoester copolymer and acrylomethyl propane sulfonic acid copolymer, semi synthetic anion polymers such as carboxymethyl starch and carboxymethyl cellulose, anionic polymers such as alginic acid and pectic acid, compounds described in JP-A-7-350753, known anionic, nonionic or cationic surface active agents, known polymers such as polyvinyl alcohol, polyvinyl pyrrolidone, carboxymethyl cellulose, hydroxypropyl cellulose and hydroxypropylmethyl cellulose, and naturally-occurring polymer compounds such as gelatin, and these may be appropriately selected and used. Polyvinyl alcohols and water-soluble cellulose derivatives are particularly preferred.

The dispersing aid is generally mixed with the organic silver salt in a form of powder or wet cake before the dispersing process, and fed as slurry into a dispersing apparatus. The dispersing aid may be mixed with the organic silver salt beforehand, and then the mixture may be subjected to a treatment such as by heating or with a solvent to form an organic silver salt powder or wet cake. The pH may be controlled with a suitable pH modifier before, during or after the dispersing operation.

Other than the mechanical dispersion, the organic silver salt can be made into micro particles by roughly dispersing the salt in a solvent through pH control, and then changing the pH in the presence of a dispersant. For the operation, an organic solvent may be used as a solvent for the rough dispersion, and such organic solvent can be removed after the formation of grains.

The dispersion prepared can be stored with stirring to prevent precipitation of the grains during storage, or stored in a highly viscous state by means of a hydrophilic colloids (e.g., a jelly state for med with gelatin). Also, the dispersion may contain a preservative in order to prevent proliferation of microorganisms during storage.

The organic silver salt solid fine grain dispersion for use in the present invention comprises at least an organic silver salt and water. The ratio of the organic silver salt to water is not particularly limited. The organic silver salt preferably accounts for from 5 to 50% by weight, more preferably from 10 to 30% by weight of the entire dispersion. A dispersion aid is preferably used as described above, but it is preferably used in a minimum amount within the range suitable for attaining a minimum grain size, specifically, in an amount of from 0.5 to 30% by weight, more preferably from 1 to 15% by weight, based on the organic silver salt.

In the present invention, a photosensitive material may be produced by mixing an organic silver salt water dispersion and a photosensitive silver salt water dispersion. The mixing ratio of the organic silver salt and the photosensitive silver salt may be selected according to the purpose. The ratio of the photosensitive silver salt to the organic silver salt is preferably from 1 to 30 mol %, more preferably from 3 to 20 mol %, still more preferably from 5 to 15 mol %. In the mixing, it is preferred to mix two or more organic silver salt water dispersions with two or more photosensitive silver salt water dispersions, so that the photographic properties can be controlled.

The organic silver salt for use in the present invention may be used in any desired amount, and it is preferably used in an amount of from 0.1 to 5 g/m$^2$, more preferably from 1 to 3 g/m$^2$, in terms of silver amount per m$^2$ of the photosensitive material.

In the present invention, metal ions selected from Ca, Mg, Zn and Ag are preferably added to the non-photosensitive organic silver salt. The metal ions selected from Ca, Mg, Zn and Ag are preferably added to the non-photosensitive organic silver salt in the form of a water-soluble metal salt, not a halide compound. Specifically, metal ions are preferably added in the form of nitrate or sulfate. Addition of halide is not preferred, since it degrade image storability, i.e., so-called printing-out property, of the photosensitive material against light (indoor light, sun light etc.) after the development. Therefore, in the present invention, it is preferable to add the ions in the form of water-soluble metal salts, which are not the aforementioned halide compound.

The metal ions selected from Ca, Mg, Zn and Ag may be added any time after the grains formation of the non-photosensitive organic silver salt until immediately before the coating operation, for example, immediately after the formation of grains, before dispersion, after dispersion, before and after the preparation of coating solution and so forth. The metal ions are preferably added after dispersion, or before or after the preparation of coating solution.

The metal ions selected from Ca, Mg, Zn and Ag are preferably added in an amount of $10^{-3}$ to $10^{-1}$ mol. particularly $5\times10^{-3}$ to $5\times10^{-2}$ mol. per one mol of non-photosensitive organic acid silver salt.

The photosensitive silver halide for use in the present invention is not particularly limited as for the halogen composition, and silver chloride, silver chlorobromide, silver bromide, silver iodobromide, and silver chloroiodobromide may be used. The halide composition may have a uniform distribution in the grains, or the compositions may change stepwise or continuously in the grains. Silver halide grains having a core/shell structure may be preferably used. Core/shell grains having preferably a double to quintuple structure, more preferably a double to quadruple structure may be used. A technique for localizing silver bromide on the surface of silver chloride or silver chlorobromide grains may also be preferably used.

For the preparation of the photosensitive silver halide used for the present invention, methods well known in the art, e.g., the methods described in Research Disclosure, No. 17029 (June, 1978) and U.S. Pat. No. 3,700,458, can be used. More specifically, applicable methods for the present invention include a method comprising the step of adding a halogen-containing compound to a ready prepared organic silver salt to convert a part of silver of the organic silver salt into a photosensitive silver halide, and a method comprising the step of preparing photosensitive silver halide grains by adding a silver-supplying compound and a halogen-supplying compound to a solution of gelatin or another polymer and then mixing the prepared grains with an organic silver salt. In particular, the latter method is preferred for the present invention. As for a grain size of the photosensitive silver halide, smaller grains are desirable to prevent cloudiness of the photosensitive material after image formation. Specifically, the grain size may preferably be not greater than 0.20 μm, preferably from 0.01 to 0.15 μm, more preferably from 0.02 to 0.12 μm. The term "grain size" used herein means "ridge length" of silver halide grains when the silver halide grains are regular crystals in cubic or octahedral form. Where silver halide grains are tabular grains, the term means the diameter of a circle having the same area as a projected area of the main surface of the tabular grain. Where the silver halide grains are irregular crystals, such as spherical or rod-like grains, the term means the diameter of a sphere having the same volume as the grain.

Examples of the form of silver halide grains include a cubic form, octahedral form, tabular form, spherical form, rod-like form and potato-like form. In particular, cubic grains and tabular grains are preferred for the present invention. When tabular silver halide grains are used, an average aspect ratio may be from 100:1 to 2:1, preferably from 50:1 to 3:1. Silver halide grains having round corners are also preferably used in the present invention. Surface index (Miller index) of outer surfaces of the photosensitive silver halide grains is not particularly limited. However, it is desirable that [100] face be present in a high proportion that can achieve high spectral sensitizing efficiency when a spectral sensitizing dye adsorbed thereto. The proportion of [100] face may be not lower than 50%, preferably at least 65%, and more preferably at least 80%. The proportion of [100] face can be determined using the method described in T. Tani, J. Imaging Sci., 29, 165 (1985), where the difference in adsorption of a sensitizing dye to [111] face and [100] face is utilized.

The photosensitive silver halide grain for use in the present invention preferably contains a metal or metal complex of Group VII or VIII (group 7 to 10) in the periodic table of elements. The metal or center metal of the metal complex of Group VII or VIII of the periodic table is preferably rhodium, rhenium, ruthenium,osmiumoriridium. The metal complex may be used alone, or two or more complexes with the same or different metals may also be used in combination. The metal complex content is preferably from $10^{-9}$ to $10^{-2}$ mol, more preferably from $10^{-8}$ to $10^{-4}$ mol based on one mole of silver. More specifically, the metal complexes having the structures described in JP-A-7-225449 may be used.

As the rhodium compound preferably used in the present invention, a water-soluble rhodium compound may be used. Examples include a rhodium(III) halogenide compounds and rhodium complex salts having a halogen, an amine or an oxalate as a ligand, such as hexachlororhodium(III) complex salt, pentachloroaquorhodium(III) complex salt, tetrachlorodiaquorhodium(III) complex salt, hexabromorhodium(III) complex salt, hexaamminerhodium (III) complex salt and trioxalatorhodium(III) complex salt. The rhodium compound is used after being dissolved in water or an appropriate solvent, and a method commonly used for stabilizing the rhodium compound solution may be applied, for example, a method comprising the step of adding an aqueous solution of hydrogen halide (e.g., hydrochloric acid, hydrobromic acid, hydrofluoric acid) or alkali metal halide (e.g., KCl, NaCl, KBr, NaBr) may be used. Instead of the use of a water-soluble rhodium, different silver halide grains doped beforehand with rhodium may be added and dissolved at the time of preparation of silver halide.

The amount of the rhodium compound is preferably from $1\times10^{-8}$ to $5\times10^{-4}$ mol, more preferably from $5_{-10}$ to $1\times10^{-5}$ mol based on one mole of silver halide.

The rhodium compound may be appropriately added at the time of preparation of the silver halide emulsion grains or at each stages before the coating of the emulsion. The rhodium compound may preferably be added at the time of formation of the emulsion and incorporated in the silver halide grain.

The rhenium, ruthenium or osmium for use in the present invention is added in the form of a water-soluble complex salt described in JP-A-63-2042, JP-A-1-285941, JP-A-2-20852 and JP-A-2-20855. Particularly preferred examples are six-coordinate complex represented by the following formula:

$$[ML_6]^{n-}$$

wherein M represents Ru, Re or Os, L represents a ligand, and n represents 0, 1, 2, 3 or 4.

In this case, the counter ion plays no important role and an ammonium or alkali metal ions may be is used.

Preferred examples of the ligand include a halide ligand, a cyanide ligand, a cyan oxide ligand, a nitrosyl ligand, a thionitrosyl ligand and the like. Specific examples of the complex for use in the present invention are shown below. However, the scope of the present invention is not limited to these examples.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{-}$ | $[RuCl_5(H_2O)]^{2-}$ |
| $[RuCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The amount of these compound is preferably from $1\times10^{-9}$ to $1\times10^{-4}$ mol, most preferably from $1\times10^{-1}$ to $1\times10^{-5}$ mol based on one mole of silver halide.

These compounds may be added appropriately at the time of preparation of silver halide emulsion grains or at each stages before the coating of the emulsion. The compounds are preferably added at the time of formation of the emulsion and incorporated in silver halide grains.

For the addition of the compound during the grain formation of silver halide for incorporation in silver halide grains, examples of applicable methods include, for example, a method where a metal complex powder or an aqueous solution of the complex dissolved with NaCl or KCl is added to a water-soluble salt or water-soluble halide solution during the grain formation, a method where the compound is added as a "third" solution at the time of simultaneous mixing of a silver salt and a halide solution to prepare silver halide grains by the simultaneous mixing of the three solutions, or a method where a necessary amount of an aqueous metal complex solution is poured into a reaction vessel during the grain formation. Among these, the method is preferred which comprises the step of adding a metal complex powder or an aqueous solution of the complex dissolved with NaCl or KCl to a water-soluble halide solution.

In order to add the compound to the surface of the grain, a necessary amount of an aqueous metal complex solution may be charged into a reaction vessel immediately after the grain formation, during or after completion of the physical ripening, or at the time of chemical ripening.

As the iridium compound preferably used in the present invention, various compounds may be used. Examples include hexachloroiridium, hexammineiridium, trioxalatoiridium, hexacyanoiridium, pentachloronitrosyliridium and the like. The iridium compound is used after being dissolved in water or an appropriate solvent, and a method commonly used for stabilizing the iridium compound solution, more specifically, a method comprising the step of adding an aqueous solution of hydrogen halide (e.g., hydrochloric acid, hydrobromic acid, hydrofluoric acid) or alkali metal halide (e.g., KCl, NaCl, KBr, NaBr) may be used. Instead of using a water-soluble iridium, different silver halide grains doped beforehand with iridium may be added and dissolved at the time of preparation of silver halide.

The silver halide grain for use in the present invention may further contain a metal atom such as cobalt, iron, nickel, chromium, palladium, platinum, gold, thallium, copper and lead. In the case of cobalt, iron, chromium or ruthenium compound, a hexacyano metal complex is preferably used. Specific examples include ferricyanate ion, ferrocyanate ion, hexacyanocobaltate ion, hexacyanochromate ion and hexacyanoruthenate ion. However, the present invention is not limited to these examples. The metal complex may be added, for example, uniformly in the silver halide grain, added in a higher concentration in the core part, or added in a higher concentration in the shell part, and a way of the addition of the metal complex is not particularly limited.

The above-described metal is used preferably in an amount of from $1\times10^{-9}$ to $1\times10^{-4}$ mol based on one mole of silver halide. The metal may be converted into a metal salt in the form of a simple salt, a composite salt or a complex salt, and added at the time of preparation of grains.

The photosensitive silver halide grain may be desalted by water washing according to a method known in the art, such as noodle washing and flocculation. The grain may or may not be desalted in the present invention.

A gold sensitizer used for gold sensitization of the silver halide emulsion used in the present invention may have a gold oxidation number of either +1 valence or +3 valence, and gold compounds commonly used as a gold sensitizer can be used. Representative examples thereof include chloroauric acid, potassium chloroaurate, auric trichloride, potassium auric thiocyanate, potassium iodoaurate, tetracyanoauric acid, ammonium aurothiocyanate, pyridyltrichlorogold and so forth.

While the addition amount of the gold sensitizer may vary depending on various conditions, it is added, in general, in an amount of $10^{-7}$ to $10^{-3}$ mol, more preferably $10^{-6}$ to $5\times10^{-4}$ mol, per mole of silver halide.

The silver halide emulsion for use in the present invention is preferably subjected to gold sensitization and other chemical sensitization in combination. The chemical sensitization may be performed using a known method such as sulfur sensitization, selenium sensitization, tellurium sensitization or noble metal sensitization. When these sensitization methods are used in combination with gold sensitization, a combination of sulfur sensitization and gold sensitization, a combination of selenium sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization, for example, are preferred.

The sulfur sensitization used preferably in the present invention is usually performed by adding a sulfur sensitizer and stirring the emulsion at a high temperature of 40° C. or higher for a given time. A known compound may be used as the sulfur sensitizer, and examples include a sulfur compound contained in gelatin, as well as various sulfur compounds such as thiosulfates, thioureas, thiazoles and rhodanines. Preferred sulfur compounds are thiosulfate and thiourea compounds. The amount of the sulfur sensitizer varies depending on various conditions such as pH and a temperature at the chemical ripening and the size of silver halide grain. A preferred amount may be from $10^{-7}$ to $10^{-2}$ mol, more preferably from $10^{-5}$ to $10^{-3}$ mol based on one mole of silver halide.

As the selenium sensitizer for use in the present invention, a known selenium compound may be used. The selenium sensitization is usually performed by adding a labile and/or non-labile selenium compound and stirring the emulsion at a high temperature of 40° C. or higher for a given time. Examples of the labile selenium compound include the compounds described in JP-B-44-15748(the term "JP-B" as used herein means a "published Japanese patent application"), JP-B-43-13489, JP-A-4-25832, JP-A-4-109240 and JP-A-4-324855. Among them, particularly preferred compounds are those represented by formulas (VIII) and (IX) of JP-A-4-324855.

The tellurium sensitizer for use in the present invention is a compound capable of forming silver telluride, presumably working as a sensitization nucleus, on the surface or inside of a silver halide grain. The rate of the formation of silver telluride in a silver halide emulsion can be examined according to a method described in JP-A-5-313284. Examples of the tellurium sensitizer include diacyl tellurides, bis (oxycarbonyl) tellurides, bis(carbamoyl) tellurides, diacyl tellurides, bis (oxycarbonyl) ditellurides, bis (carbamoyl) ditellurides, compounds having a P=Te bond, tellurocarboxylates, Te-organyl tellurocarboxylic acid esters, di(poly)tellurides, tellurides, tellurols, telluroacetals, tellurosulfonates, compounds having a P-Te bond, Te-containing heterocyclic rings, tellurocarbonyl compounds, inorganic tellurium compounds, colloidal tellurium and the like. Specific examples thereof include the compounds described in U.S. Pat. Nos. 1,623,499, 3,320,069 and 3,772,031, British Patent Nos. 235,211, 1,121,496, 1,295,462 and 1,396,696, Canadian Patent No. 800,958, JP-A-4-204640, Japanese Patent Application Nos. 3-53693, 3-131598, 4-129787, J. Chem. Soc. Chem. Commun., 635 (1980), ibid., 1102 (1979), ibid., 645 (1979), J. Chem. Soc. Perkin. Trans., 1, 2191 (1980), S. Patai (compiler), The Chemistry of Organic Selenium and Tellurium Compounds, Vol. 1 (1986), and ibid., Vol. 2 (1987) and the like. The compounds represented by formulas (II), (III) and (IV) of JP-A-5-313284 are particularly preferred.

The amount of the selenium or tellurium sensitizer used in the present invention varies depending on silver halide grains used, chemical ripening conditions or the like. The amount is usually from $10^{-8}$ to $10^{-2}$ mol, preferably from $10^{-7}$ to $10^{-3}$ mol based on one mole of silver halide. The conditions for chemical sensitization in the present invention are not particularly limited. In general, pH of from 5 to 8, pAg of from 6 to 11, preferably from 7 to 10 may be applied, and a temperature may be from 40 to 95° C., preferably from 45 to 85° C.

In the silver halide emulsion for use in the present invention, a cadmium salt, sulfite, lead salt or thallium salt may be allowed to coexist during the formation or physical ripening of the silver halide grains.

In the present invention, reduction sensitization may be used. Specific examples of the compound used in the reduction sensitization include an ascorbic acid, thiourea dioxide, stannous chloride, amino imino methane sulfinic acid, a hydrazine derivative, a borane compound, a silane compound and a polyamine compound. The reduction sensitization may be performed by ripening the grains while keeping the emulsion at a pH of 7 or more or at a pAg of 8.3 or less. The reduction sensitization may also be performed by introducing a single addition part of silver ion during the formation of grains.

To the silver halide emulsion for use in the present invention, a thiosulfonic acid compound may be added by the method described in European Patent 293917A.

The silver halide emulsion may be used alone in the photosensitive material of the present invention, or two or more of them may be used in combination (for example, those having different average grain sizes, different halogen compositions, or different crystallization properties, or those produces under different sensitization conditions).

The amount of the photosensitive silver halide used in the present invention may preferably be from 0.01 to 0.5 mol, more preferably from 0.02 to 0.3 mol, and more preferably from 0.03 to 0.25 mol based on per mole of the organic silver salt. Examples of a method and conditions formixing the photosensitive silver halide with a separately prepared organic silver salt include, for example, a method of mixing the silver halide grains and the organic silver salt by means of a high-speed stirrer, a ball mill, a sand mill, a colloidal mill, a vibration mill, a homogenizer or the like, or a method of adding a ready prepared photosensitive silver halide to an organic silver salt at any stage of its preparation. The mixing method and conditions are not particularly limited so long as the advantages of the invention can be fully achieved.

The heat-developable photosensitive material of the present invention contains a reducing agent for organic silver salt. The reducing agent for organic silver salt may be any substance, preferably an organic substance, which reduces the silver into metal silver. Conventional photographic developers such as phenidone, hydroquinone and catechol are useful. A hindered phenol reducing agent is preferred. The reducing agent is preferably contained in an amount of from 5 to 50 mol %, more preferably from 10 to 40 mol % based on per mole of silver on the surface having an image-forming layer. The layer to which the reducing agent is added may be any layer on the surface having an image-forming layer. Where the reducing agent is added to a layer other than the image-forming layer, the reducing agent is preferably used in a relatively large amount, i.e., from 10 to 50 mol % based on one mole of silver. The reducing agent may also be a so-called precursor that is modified so as to effectively exhibit the function only at the time of development.

For the heat-developable photosensitive material using an organic silver salt, variety of reducing agents are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686 and 5,464,738, German Patent No. 2,321,328, European Patent 692732 and the like. Examples include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with an ascorbic acid such as a combination of 2,2-bis(hydroxymethyl)propionyl-β-phenylhydrazine with an ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl) methane; combinations of a bis-β-naphthol with a 1,3-dihydroxybenzene derivative (e.g., 2,4-dihydroxybenzophenone, 2',4-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethyl-hexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol. Particularly preferred reducing agents are bisphenols and chromanols.

The reducing agent used for the present invention may be added in any form, for example, as a solution, powder, solid microparticle dispersion and the like. The solid microparticle dispersion is performed using a known pulverizing means (e.g., a ball mill, a vibrating ball mill, a sand mill, a colloid mill, a jet mill, a roller mill). At the time of solid microparticle dispersion, a dispersion aid may also be used.

As the binders used for the present invention, those polymer latexes described below are preferably used.

In the present invention, the binder of the image-forming layer (photosensitive layer, emulsion layer) may be selected from well known natural or synthetic resins such as gelatin, poly(vinyl acetal), poly(vinyl chloride), poly(vinyl acetate), cellulose acetate, polyolefins, polyesters, polystyrene, polyacrylonitrile and polycarbonates. Copolymers and terpolymers may also be used. Preferred polymers are polyvinyl butyral, butyl ethyl cellulose, methacrylate copolymer, maleic anhydride ester copolymer, polystyrene and butadiene/styrene copolymer. Two or more of these polymers may be used in combination, if required. The polymers are used in an amount sufficient to hold other components in the polymer. Namely, the polymers are used in an effective amount to function as a binder. Those skilled in the art can appropriately determine the effective range of the amount. In order to hold at least the organic silver salt, the proportion of the binder to the organic silver salt may preferably range from 15:1 to 1:2, more preferably from 8:1 to 1:1.

At least one of layers constituting the image-forming layer of the heat-developable photosensitive material of the present invention is preferably an image-forming layer containing polymer latex described below in an amount of at least 50% by weight based on the total binder thereof (hereinafter, such an image-forming layer is referred to as the "image-forming layer in the present invention", and the polymer latex used for the binder is referred to as the "polymer latex used for the present invention"). The polymer latex may be used not only in the image-forming layer, but inaprotective layer and a backing layer. When the heat-developable photosensitive material of the present invention is used for printing inwhich a dimensional change causes a problem, the polymer latex is preferably used also in the protective layer and the backing layer. The term "polymer latex" used herein means a material where water-insoluble hydrophobic polymer is dispersed as fine particles in a water-soluble dispersion medium. As for a dispersion state, the polymers may be those emulsified in a dispersion medium, those obtained by an emulsion-polymerization, or those obtained by a micell dispersion, or those having a partially hydrophilic structure in their molecule so as to allow molecular dispersion of the molecular chain. The polymer latex for use in the present invention is described in Gosei Jushi Emulsion (Synthetic Resin Emulsion), compiled by Taira Okuda and Hiroshi Inagaki, issued by Kobunshi Kanko Kai (1978), Gosei Latex no Oyo (Application of Synthetic Latex), compiled by Takaaki Sugimura, Yasuo Kataoka, Souichi Suzuki and Keiji Kasahara, issued by Kobunshi Kanko Kai (1993), and Soichi Muroi, Gosei Latex no Kagaku (Chemistry of Synthetic Latex), Kobunshi Kanko Kai (1970) and the like. The dispersion particles preferably have an average particle size of about 1 to 50,000 nm, more preferably about 5 to 1,000 nm. The particle size distribution of the dispersed particles is not particularly limited, and the dispersed particles may have a broad particle size distribution or a monodisperse particle size distribution.

As the polymer latex used for the present invention, a so-called core/shell type latex may be used, as well as the normal polymer latex having a uniform structure. Where the core/shell latex is used, preferable properties may sometimes be obtained when a core and a shell have different glass transition temperatures.

The polymer latex used as the binder in the heat-developable photosensitive material of the present invention has a glass transition temperature (Tg) of which preferred range may be different among those for the protective layer, the backing layer and the image-forming layer. In the protective layer and the backing layer, the glass transition temperature is preferably 25° C. to 100° C., more preferably 25° C. to 70° C., in view of film strength and prevention of adhesion failure, because the protective layer and the backing layer are brought into contact with various instruments. In the image-forming layer, the glass transition temperature is preferably 40° C. or lower, preferably from −30° C. to 4° C., particularly preferably from 0° C. to 40° C. so as to accelerate the diffusion of the photographically useful components during the heat development, and to obtain good photographic properties such as high Dmax and low fogging. The gel fraction of the polymer latex used for the image-forming layer is desirably 30 to 90% by weight for similar reasons. The gel fraction in this case is one obtained according to the following equation by forming a film sample from a polymer latex at a drying temperature of 70° C., immersing the film sample in tetrahydrofuran (THF) at 25° C. for 24 hours, and measuring the amount of insoluble matter.

$$\text{Gel fraction (\% by weight)} = [\text{Weight of insoluble matter (g)} / \text{Weight of film using polymer latex (g)}] \times 100$$

The types of the polymer in the polymer latex for use in the present invention may be of acrylic resin, vinyl acetate resin, polyester resin, polyurethane resin, rubber-based resin, vinyl chloride resin, vinylidene chloride resin, polyolefin resin or a copolymer thereof. The polymer may be a straight-chained polymer, a branched polymer or a cross-linked polymer. The polymer may be a so-called homopolymer obtained by polymerizing a single kind of monomers or may be a copolymer obtained by polymerizing two or more kinds of monomers. The copolymer may be either a random copolymer or a block copolymer. The polymer preferably has a number average molecular weight of about 5,000 to 1,000,000, more preferably on the order of about 10,000 to 100,000. If the molecular weight is too small, the image-forming layer is deficient in the mechanical strength, whereas if it is excessively large, the film-forming property is disadvantageously poor.

Specific examples of the polymer latex used as a binder in the the heat-developable photosensitive material of the present invention include a methyl methacrylate/ethyl methacrylate/methacrylic acid copolymer latex, methyl methacrylate/2-ethylhexyl acrylate/hydroxyethyl methacrylate/styrene/acrylic acid copolymer latex, styrene/butadiene/ acrylic acid copolymer latex, styrene/butadiene/divinylbenzene/methacrylic acid copolymer latex, methyl methacrylate/vinyl chloride/acrylic acid copolymer latex and vinylidene chloride/ethyl acrylate/acrylonitrile/methacrylic acid copolymer latex. Such polymers are also commercially available and examples of the polymer which can be used include acrylic resins such as CEBIAN A-4635, 46583, 4601 (all produced by Dicel Kagaku Kogyo Co., Ltd), Nipol Lx811, 814, 821, 820, 857, 857×2 (all produced by Nippon Zeon Co., Ltd.), VONCORT R3340, R3360, R3370, 4280, 2830, 2210 (all produced by Dai-Nippon Ink & Chemicals, Inc.), Julimer ET-410, 530, SEK101-SEK301, FC30, FC35 (all produced by Nihon Junyaku Co., Ltd.), Polysol F410, AM200, AP50 (all produced by Showa Kobunshi Co., Ltd.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40, VONDIC 1320NS (all produced by Dai-Nippon Ink & Chemicals, Inc.); rubber-based resins such as LACSTAR 7310K, 3307B, 4700H, 7132C, LQ-618-1 (all produced by Dai-Nippon Ink & Chemicals, Inc.), Nipol Lx416, 410, 430, 435, 2507 (all produced by Nippon Zeon Co., Ltd.); vinyl chloride resins such as Nipol G351, G576 (both produced by Nippon Zeon Co., Ltd.); vinylidene chloride resins such as L502, L513 (both produced by Asahi Chemical Industry Co., Ltd.), ARON D7020, D5040, D5071 (all produced by Toagosei Co., Ltd.); and olefin resins such as CHEMIPEARL S120 and SA100 (both produced by Mitsui Petrochemical Industries, Ltd.) and the like. These polymers may be used alone or if desired, as a blend of two or more thereof.

Among these polymer latexes, preferably used as the binder for the protective layer are those based on acrylic compound, styrene, acrylic compound/styrene, vinyl chloride, and vinylidene chloride. specifically, those of acrylic resin type such as VONCORT R3370, 4280, Nipol Lx857, and methyl methacrylate/2-ethylhexyl acrylate/hydroxyethyl methacrylate/styrene/acrylic acid copolymers; those of vinyl chloride resin type such as Nipol G576; and those of vinylidene chloride resin type such as Aron D5071 are preferably used.

As the binder for the backing layer, polymer latexes based on acrylic compound, olefin, and vinylidene chloride are preferably used. Specifically, those of acrylic resin type such as Julimer ET-410, CEBIAN A-4635 and Polysol F410, olefin resin type such as CHEMIPEARL S120, vinylidene chloride type such as L502 and ARON D7020 and the like are preferred.

Specific examples of the polymer latex used as a binder in the image-forming layer of the heat-developable photosensitive material of the present invention include a methyl methacrylate/ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex and vinylidene chloride/ethyl acrylate/acrylonitrile/methacrylic acid copolymer latex. Such polymers are also commercially available and examples of the polymer which can be used include acrylic resins such as CEBIAN A-4635, 46583, 4601 (all produced Dicel KagakuKogyo Co., Ltd), Nipol Lx811, 814, 821, 820, 857 (all produced by Nippon zeon Co., Ltd.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber-based resins such as LACSTAR7310K, 3307B, 4700H, 7132C (all produced by Dai-Nippon Ink & Chemicals, Inc.), Nipol Lx416, 410, 438C, 2507 (all produced by Nippon Zeon Co., Ltd.); vinyl chloride resins such as G351, G576 (both produced by Nippon Zeon Co., Ltd.); vinylidene chloride resins such as L502, L513 (both produced by Asahi Chemical Industry Co., Ltd.), ARON D7020, D5040, D5071 (all produced by Toagosei Co., Ltd.); and olefin resins such as CHEMIPEARL S120 and SA100 (both produced by Mitsui Petrochemical Industries, Ltd.) and the like. These polymers may be used alone or if desired, as a blend of two or more thereof.

The image-forming layer in the present invention preferably contains the aforementioned polymer latex in an amount of 50% by weight or more, more preferably 70% by weight or more based on the total binder.

As the binder for the image-forming layer, polymer latexes based on styrene/butadiene are preferably used. Specifically, those of rubber resin type such as LACSTAR 3307B, Nipol Lx430 and 435 are preferably used.

If desired, the image-forming layer in the present invention may contain a hydrophilic polymer in an amount of 50% by weight or less of the total binder, such as gelatin, polyvinyl alcohol, methyl cellulose, hydroxypropyl cellulose, carboxymethyl cellulose and hydroxypropylmethyl cellulose. The amount of the hydrophilic polymer added is preferably 30% by weight or less, more preferably 15% by weight or less of the total binder in the image-forming layer.

The image-forming layer (photographic layer) in the present invention is preferably formed by coating an aqueous coating solution and then drying the coating solution. The term "aqueous" as used herein means that water content of the solvent (dispersion medium) in the coating solution is 60% by weight or more. In the coating solution, the component other than water may be a water-miscible organic solvent such as methyl alcohol, ethyl alcohol, isopropyl alcohol, methyl cellosolve, ethyl cellosolve, dimethylformamide, ethyl acetate, diacetone alcohol, fur furyl alcohol, benzyl alcohol, diethylene glycol monoethyl ether, and oxyethyl phenyl ether. Examples of the solvent composition include water/methanol=90/10, water/methanol=70/30, water/ethanol=90/10, water/isopropanol=90/10, water/dimethylformamide=95/5, water/methanol/dimethylformamide=80/15/5 and water/methanol/dimethylformamide=90/5/5 (the numerals are in % by weight) as well as water alone.

The total amount of the binder in the image-forming layer in the present invention is preferably from 0.2 to 30 g/m$^2$, more preferably from 1 to 15 g/m$^2$.

The total amount of the binder in the protective layer in the present invention is preferably from 0.2 to 6.0 g/m$^2$, more preferably from 0.5 to 4.0 g/m$^2$.

The total amount of the binder in the backing layer in the present invention is preferably from 0.01 to 3 g/m$^2$, more preferably from 0.05 to 1.5 g/m$^2$.

Each layer may contain a crosslinking agent for crosslinking, surfactant for improving coat ability and the like.

Two or more layers may be provided for each of these layers. When the image-forming layer is composed of two or more layers, it is preferred that all of the layers contain a polymer latex as a binder. The protective layer is provided on the image-forming layer, and may also be composed of two or more layers. In such a case, it is preferred that at least one layer thereof, in particular, the outermost layer of the protective layer contains a polymer latex as a binder. The backing layer is provided on an undercoat layer provided on the back face of the support, and may also be composed of two or more layers. In such a case, it is preferred that at least one layer thereof, in particular, the outermost layer of the backing layer contains a polymer latex as a binder.

The polymer latex for use in the present invention preferably has a minimum film-forming temperature (MFT) of from −30 to 90° C., more preferably from 0 to 70° C. In order to control the minimum film-forming temperature, a film-forming aid may be added. The film-forming aid is also called a plasticizer or a transient plasticizer and it is an organic compound (usually an organic solvent) capable of reducing the minimum film-forming temperature of the polymer latex. This organic compound is described in Souichi Muroi, Gosei Latexno Kagaku (Chemistry of Synthetic Latex), Kobunshi Kanko Kai (1970). Preferred film-forming aids are mentioned below. However, film-forming aids that can be used for the present invention are not limited to the following compounds.

Z-1: Benzyl alcohol

Z-2: 2,2,4-Trimethylpentanediol-1,3-mono-iso-butyrate

Z-3: 2-Dimethylaminoethanol

Z-4: Diethylene glycol

The film-forming aid is preferably added, in particular, when a protective layer is formed. In such a case, the film-forming aid is preferably added in an amount of 1 to 30% by weight, more preferably 5 to 20% by weight, relative to the solid content of polymer latex in a coating solution for protective layer.

If desired, the image-forming layer and the protective layer in the present invention may contain a hydrophilic polymer as a dispersion stabilizer, such as gelatin, polyvinyl alcohol, methyl cellulose, hydroxypropyl cellulose, carboxymethyl cellulose and hydroxypropylmethyl cellulose. Among these, polyvinyl alcohol is preferred.

Specific examples of hydrophilic polymers used for the image-forming layer and the protective layer in the present invention are listed below. However, hydrophilic polymers that can be used for the present invention are not limited to the following compounds.

HP-1

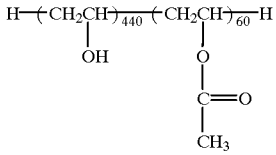

HP-2

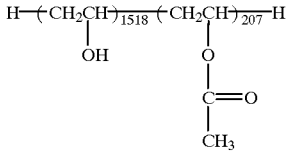

HP-3

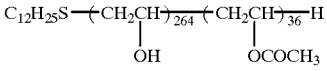

HP-4

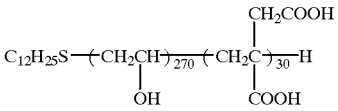

HP-5

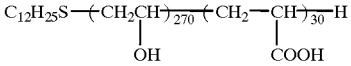

HP-6

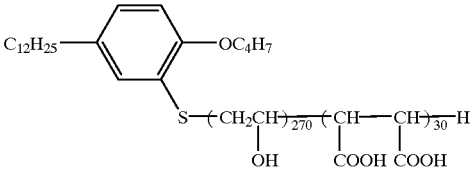

HP-7

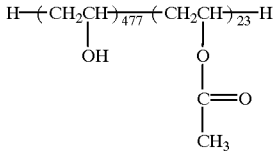

These hydrophilic polymers are preferably added to the image-forming layer in an amount of 50% by weight or less of the total binder, and in an amount of 1 to 30% by weight, more preferably 5 to 20% by weight, of the polymer latex binder derived from the polymer latex in the image-forming layer. These hydrophilic polymers are preferably added to the protective layer in an amount of 0.2 to 20% by weight, more preferably 0.5 to 10% by weight, of the polymer latex binder derived from the polymer latex in the protective layer.

The compound represented by the formula (1) used for the present invention will be explained in detail.

In the formula (1), $Z^1$ and $Z^2$ independently represent a halogen atom such as fluorine, chlorine, bromine and iodine. It is most preferred that both of $Z^1$ and $Z^2$ represent bromine atom.

In the formula (1), $X^1$ is a hydrogen atom or an electron with drawing group. The electron with drawing group used herein is a substituent having a Hammett's substituent constant σp of a positive value, and specific examples thereof include cyano group, an alkoxycarbonyl group, an aryloxycarbonyl group, a carbamoyl group, a sulfamoyl group, an alkylsulfonyl group, an arylsulfonyl group, a halogen atom, anacyl group, a heterocyclic group and so forth. In the formula (1), $X^1$ is preferably a hydrogen atom or a halogen atom, and the most preferred is bromine atom.

In the formula (1), $Y^1$ is —CO— or —$SO_2$—, and it preferably —$SO_2$—.

In the formula (1), Q represents an arylene group or a divalent heterocyclic group.

The arylene group represented by Q in the formula (1) is preferably a monocyclic or condensed ring arylene group having 6–30 carbon atoms, preferably a monocyclic or condensed ring arylene group having 6–20 carbon atoms. Examples thereof include, for example, phenylene, naphthylene and so forth, and it is particularly preferably a phenylene group. The arylene group represented by Q may have a substituent. The substituent may be any group so long as it does not adversely affect photographic performance. Examples thereof include, for example, a halogen atom (fluorine atom, chlorine atom, bromine atom or iodine atom), an alkyl group (including an aralkyl group, a cycloalkyl group, an active methine group and so forth), an alkenyl group, an alkynyl group, an aryl group, a heterocyclic group (including N-substituted nitrogen-containing heterocyclic group), a heterocyclic group containing a quaternized nitrogen atom (e.g., pyridinio group), an acyl group, an alkoxycarbonyl group, an aryloxycarbonyl group, a carbamoyl group, carboxy group or a salt thereof, an imino group, an imino group substituted at the Natom, a thiocarbonyl group, acarbazoyl group, cyano group, a thiocarbamoyl group, an alkoxy group (including a group containing repeats of ethyleneoxy group or propyleneoxy group units), an aryloxy group, a heterocyclyloxy group, an acyloxy group, an (alkoxyor aryloxy)carbonyloxy group, a carbamoyloxy group, a sulfonyloxy group, an acylamino group, a sulfonamido group, a ureido group, a thioureido group, an imido group, an (alkoxy or aryloxy)carbonylamino group, a sulfamoylamino group, a semicarbazide group, a thiosemicarbazide group, a hydrazino group, a quatenary ammonio group, an (alkyl or aryl)sulfonylureido group, a nitro group, an (alkyl, aryl or heterocyclyl)thio group, an acylthio group, an (alkyl or aryl)sulfonyl group, an (alkyl or aryl)sulfinyl group, slufo group or a salt thereof, a sulfamoyl group, a phosphoryl group, a group containing phosphoric acid amide or phosphoric acid ester structure, a silyl group and so forth. These substituents may further be substituted with these substituents. Particularly preferred substituents on the arylene group represented by Q in the formula (1) are an alkyl group, an alkoxy group, an aryloxy group, a halogen atom, cyano group, carboxyl group or a salt thereof, a salt of sulfo group and phosphoric acid group.

In the formula (1), the heterocycle of the divalent heterocyclic group represented by Q may be a saturated or unsaturated 5- to 7-membered heterocycle containing at least one of N, O and S atoms. The heterocycle may be a single ring, or it may form a condensed ring with another ring or other rings. Examples of the heterocycle in the heterocyclic group represented by Q include, for example, rings of pyridine, pyrazine, pyrimidine, benzothiazole, benzimidazole, thiadiazole, quinoline, isoquinoline, triazole, triazine and so forth. These may have a substituent, and examples of the substituent include, for example, those mentioned for the arylene group represented by Q.

In the formula (1), Q is preferably an arylene group, and is particularly preferably a phenylene group.

In the formula (1), L represents a linking group such as an alkylene group (including an alkylidene group and a cyclic group, and preferably having 1–30 carbon atoms, more preferably 1–20 carbon atoms, particularly preferably 1–10 carbon atoms), an arylene group (preferably having 6–30 carbon atoms, more preferably 6–20 carbon atoms, particularly preferably 6–10 carbon atoms), an alkenylene group (preferably having 2–30 carbon atoms, more preferably 2–20 carbon atoms, particularly preferably 2–10 carbon atoms), an alkynylene group (preferably having 2-30 carbon atoms, more preferably 2–20 carbon atoms, particularly preferably 2–10 carbon atoms), a heterocyclic group (preferably having 1–30 carbon atoms, more preferably 1–20 carbon atoms, particularly preferably 1–10 carbon atoms), —O—, —NR—, —CO—, —COO—, —OCOO—, —NRCO—, —NRCONR—, —OCONR—, —S—, —SO—, —$SO_2$—, —$SO_2$NR—, a group containing a phosphorus atom, a group consisting of a combination of these groups (the group represented by R is a hydrogen atom, an alkyl group which may have a substituent, or an aryl group which may have a substituent).

The linking group represented by L in the formula (1) may have a substituent, and examples of the substituent include, for example, those mentioned for the arylene group represented by Q.

The linking group represented by L in the formula (1) is preferably an alkylene group, arylene group, —O—, —NRCO—, —$SO_2$NR—, or a group consisting of a combination of these groups. The linking group may be partly cyclized if possible. n is 0 or 1.

W in the formula (1) represents carboxyl group or a salt thereof (Na, K, ammonium salt etc.), slufo group or a salt thereof (Na, K, ammonium salt etc.), phosphoric acid group or a salt thereof (Na, K, ammonium salt etc.), hydroxyl group, a quaternary ammonium group (for example, tetrabutylammonium, trimethylbenzyl ammonium etc.) or a polyethyleneoxy group. W is preferably carboxyl group or a salt thereof, a salt of sulfo group, or hydroxyl group.

Specific examples of the compound represented by the formula (1) will be shown below. However, the scope of the present invention is not limited to these examples.

(P-1)

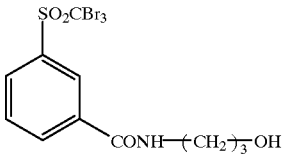

(P-2)

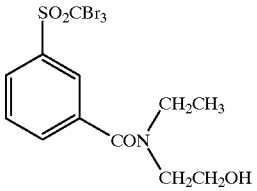

(P-3)

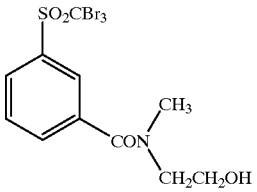

-continued (P-4)

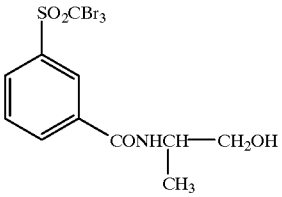

(P-5)

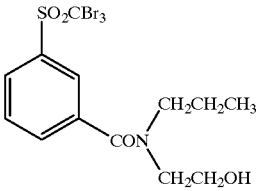

(P-6)

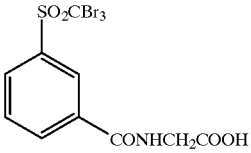

(P-7)

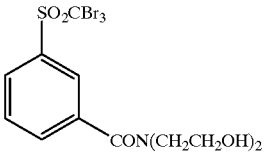

(P-8)

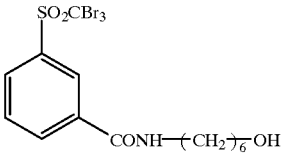

(P-9)

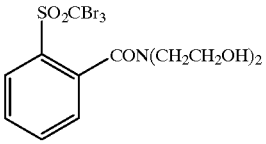

(P-10)

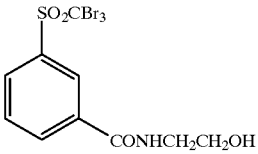

(P-11)

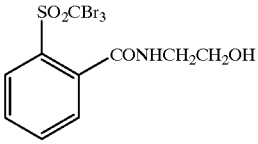

(P-12)

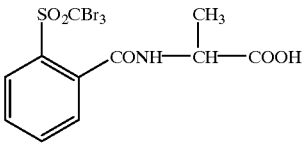

-continued
(P-13)
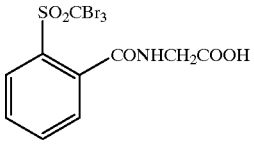
(P-14)
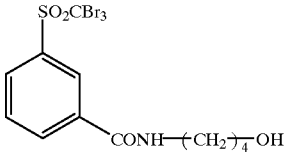
(P-15)
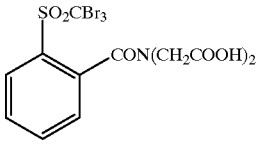
(P-16)
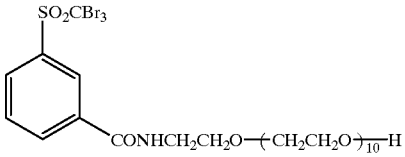
(P-17)
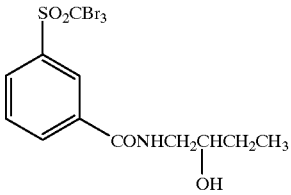
(P-18)
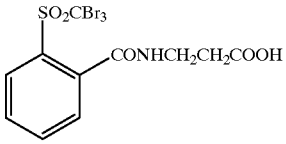
(P-19)
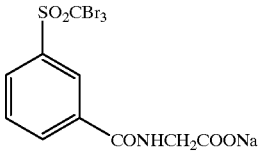
(P-20)
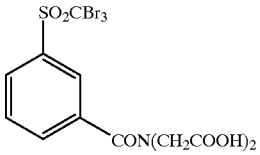
(P-21)
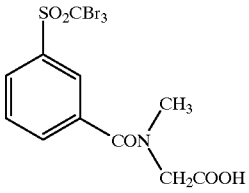
-continued
(P-22)
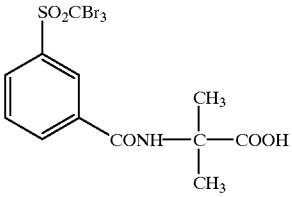
(P-23)
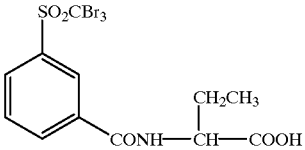
(P-24)
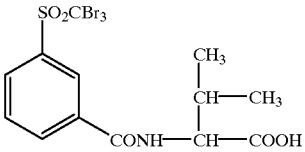
(P-25)
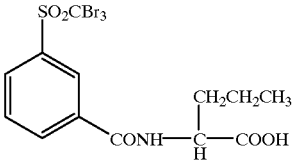
(P-26)
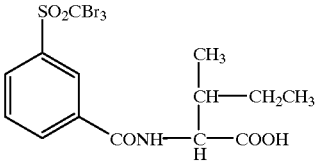
(P-27)
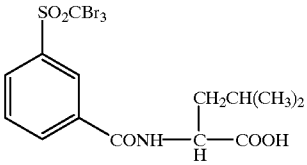
(P-28)
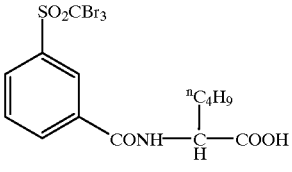
(P-29)
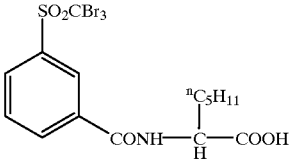

-continued
(P-30)
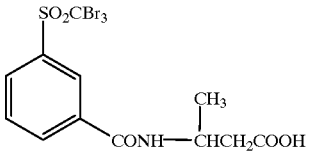
(P-31)
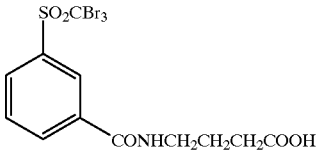
(P-32)
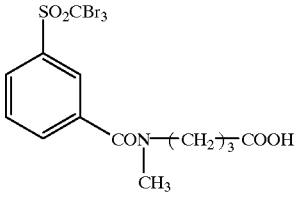
(P-33)
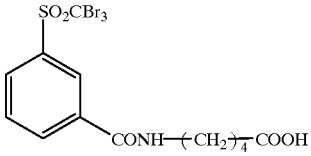
(P-34)
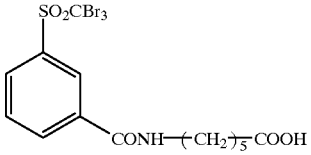
(P-35)
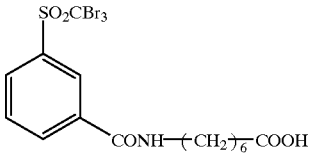
(P-36)
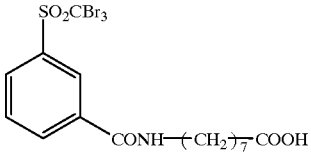
(P-37)
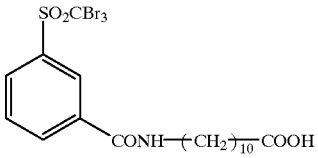
(P-38)
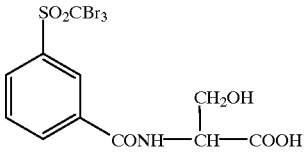
-continued
(P-39)
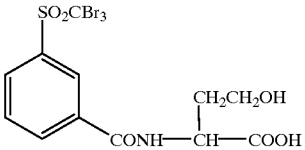
(P-40)
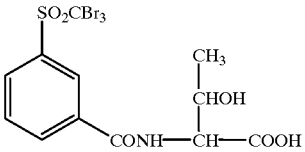
(P-41)
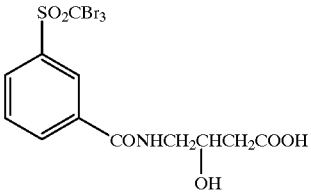
(P-42)
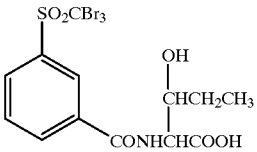
(P-43)
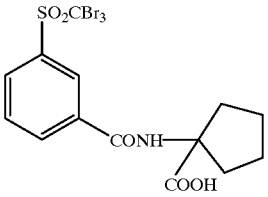
(P-44)
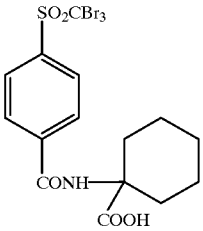
(P-45)
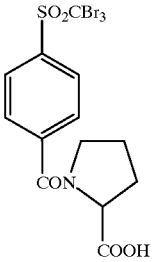

-continued
(P-46)
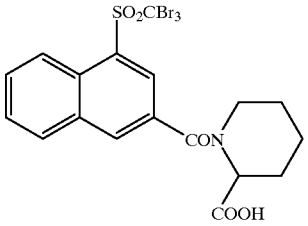
(P-47)
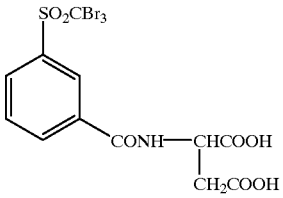
(P-48)
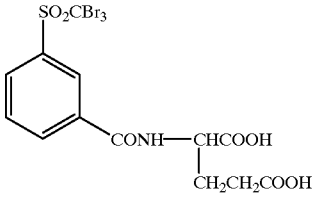
(P-49)
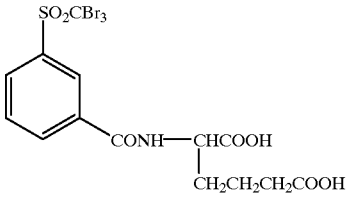
(P-50)
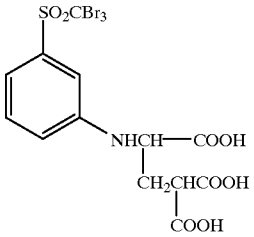
(P-51)
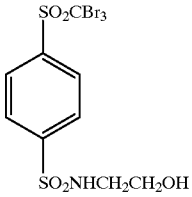
(P-52)
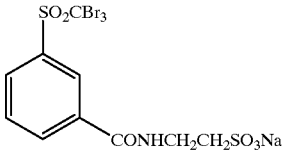
-continued
(P-53)
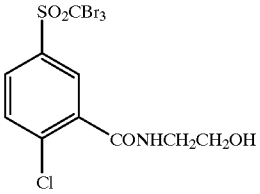
(P-54)
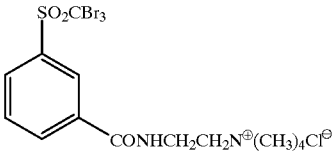
(P-55)
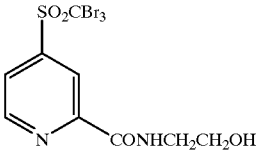
(P-56)
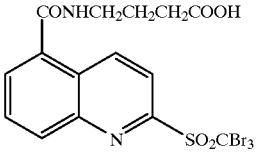
(P-57)
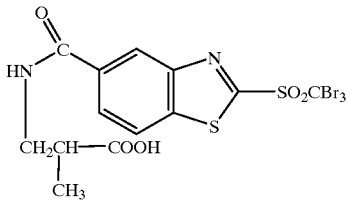
(P-58)
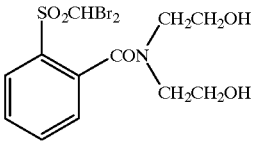
(P-59)
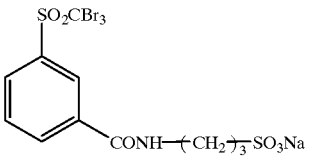
(P-60)
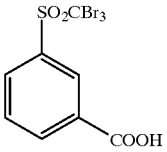

-continued
(P-61)
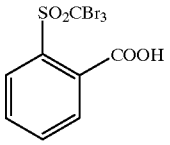
(P-62)
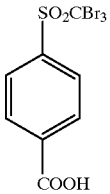
(P-63)
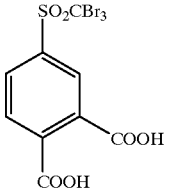
(P-64)
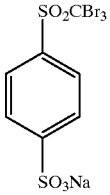
(P-65)
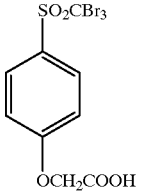
(P-66)
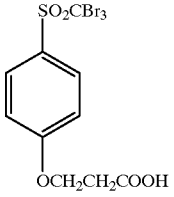
(P-67)
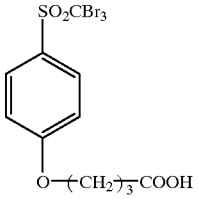
-continued
(P-68)
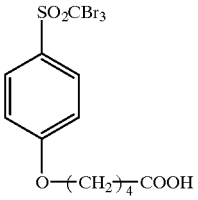
(P-69)
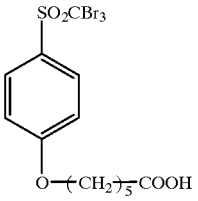
(P-70)
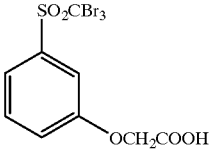
(P-71)
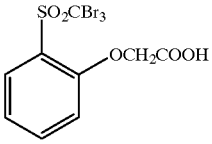
(P-72)
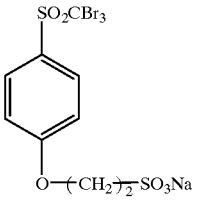
(P-73)
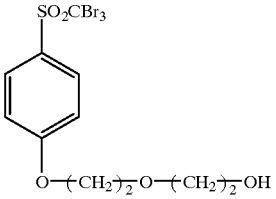
(P-74)
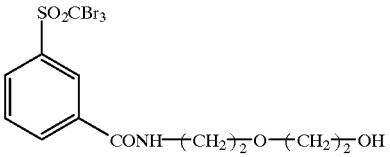
(P-75)
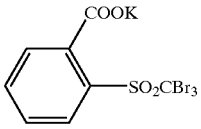

-continued
(P-76)
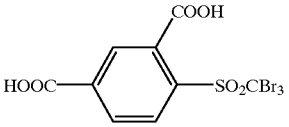
(P-77)
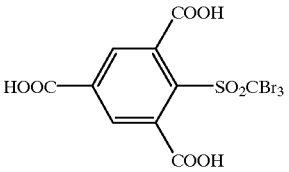
(P-78)
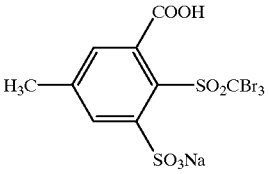
(P-79)
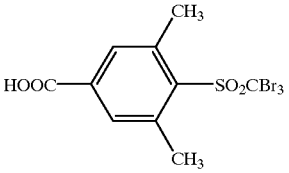
(P-80)
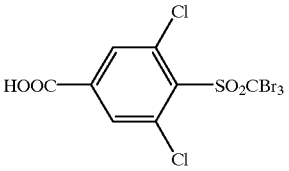
(P-81)
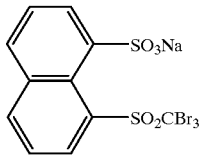
(P-82)
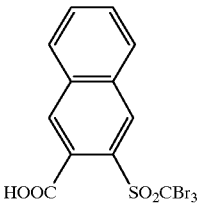
(P-83)
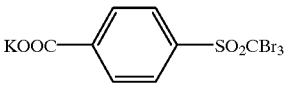
(P-84)
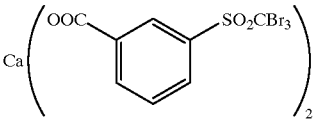
-continued
(P-85)
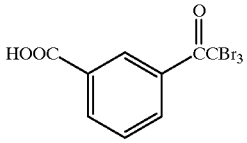
(P-86)
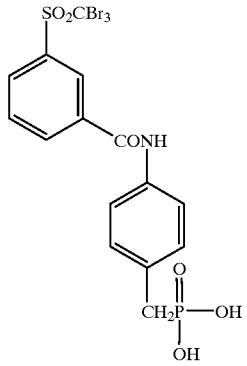
(P-87)
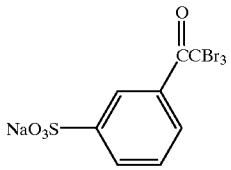
(P-88)
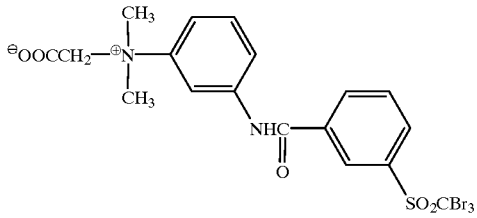
(P-89)
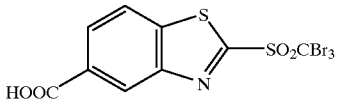
(P-90)
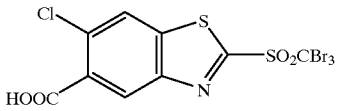
(P-91)
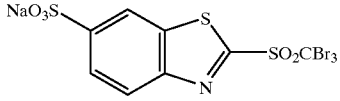
(P-92)
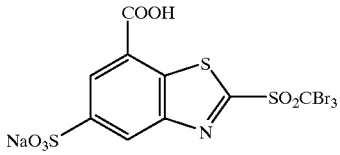

-continued
(P-93)
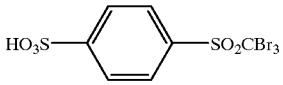
(P-94)
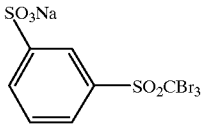
(P-95)
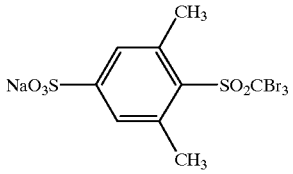
(P-96)
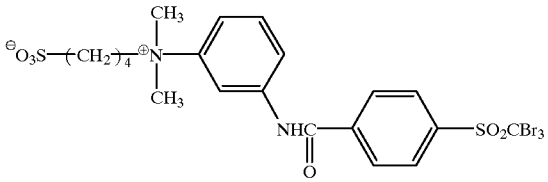
(P-97)
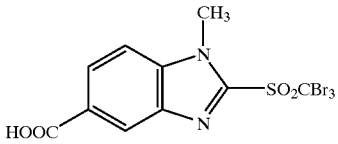
(P-98)
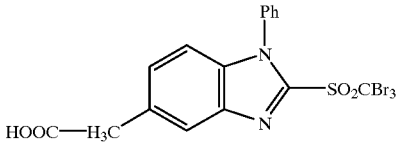
(P-99)
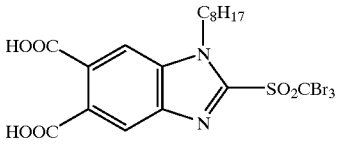
(P-100)
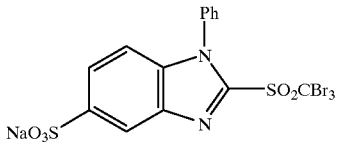
(P-101)
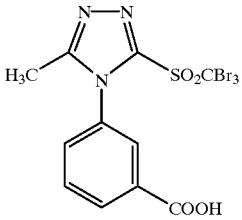
-continued
(P-102)
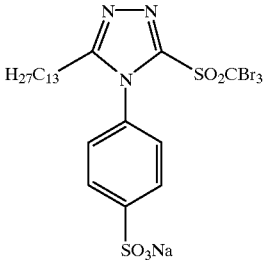
(P-103)
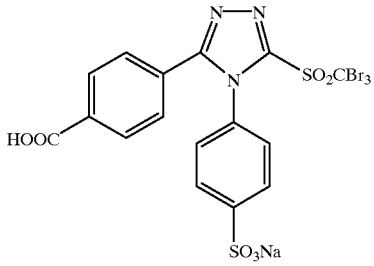
(P-104)
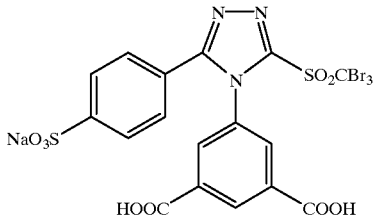
(P-105)
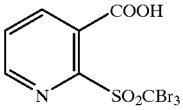
(P-106)
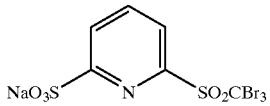
(P-107)
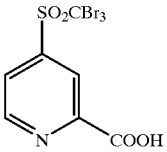
(P-108)
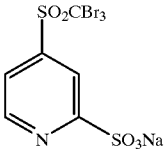
(P-109)
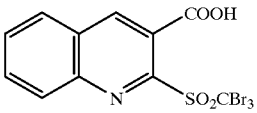

-continued (P-110)

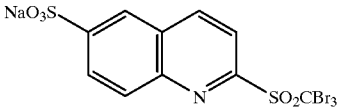

(P-111)

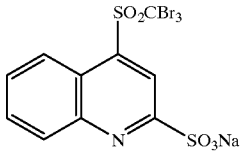

(P-112)

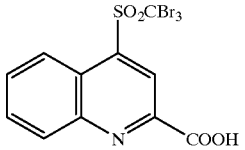

(P-113)

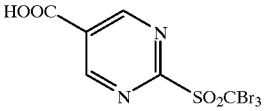

(P-114)

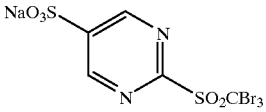

(P-115)

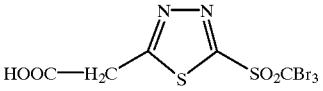

(P-116)

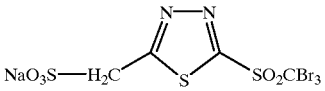

The compounds represented by the formula (1) can readily be synthe sized through ordinary synthesis reactions in the organic chemistry. Typical synthetic methods will be explained below.

SYNTHESIS EXAMPLE 1

Synthesis of Exemplary Compound (P-60)

(P-60)

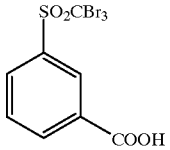

(A)

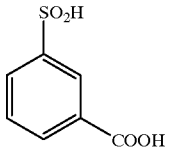

-continued (B)

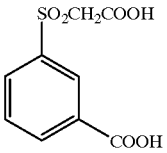

(P-7)

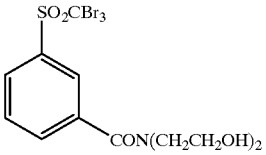

(C)

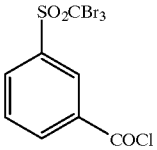

(P-6)

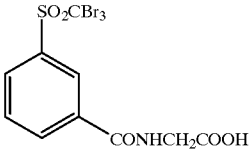

(1) Synthesis of Intermediate Compound (B)

Compound (A) (93 g), which is a commercially available compound, sodium hydroxide (43 g), sodium chloroacetate (123 g) and potassium iodide (10 g) were dissolved in water (300 ml), and stirred at 80° C. for 2 hours. After the internal temperature was lowered to 30° C., the solution was added with concentrated hydrochloric acid (50 ml). After the reaction mixture was stirred for a while, crystals were deposited. The crystals were taken by suction filtration and dried to obtain 80 g of Intermediate compound (B) as white crystals.

(2) Synthesis of Exemplary Compound (P-60)

To a solution of NaOH (57 g) in water (500 ml), bromine (33 ml)was added drop wise at room temperature, and then an aqueous solution of Intermediate compound (B) (24 g) and NaOH (8 g) in water (100 ml) was added dropwise at room temperature. The deposited crystals were taken by filtration, and the obtained crystals were added to diluted hydrochloric acid and filtered. The crystals were fully washed with water and dried to obtain 30 g of Exemplary compound (P-60) as white crystals.

(1) Synthesis of Intermediate Compound (C)

Exemplary compound (P-60) (30 g) and DMF (dimethylformamide, 1 ml) were dissolved in thionyl chloride (100 ml) and stirred at 70° C. for 30 minutes. Then, excessive thionyl chloride was evaporated under reduced pressure to obtain 31 g of Intermediate compound (C) as white crystals.

(2) Synthesis of Exemplary Compound (P-7)

A solution of diethanolamine (4.7 g) in methanol (50 ml) was cooled on ice, and added with Intermediate compound (C) (4.1 g). After the mixture was stirred for 5 minutes, 50 ml of water was added to the mixture. As a result, white crystals were deposited. The crystals were taken by filtration and dissolved in a small amount of DMAc (dimethylacetamide), and added with methanol slowly. As a result, crystals were deposited. These crystals were taken by filtration and dried to obtain 4.0 g of Exemplary compound (P-7) as white crystals.

SYNTHESIS EXAMPLE 3

Synthesis of Exemplary Compound (P-6)

Intermediate compound (C) (20 g) was added to a solution of glycine (15 g), $NaHCO_3$ (17 g), water (100 ml) and THF (tetrahydrofuran, 100 ml), and stirred for 5 minutes at room temperature. The reaction mixture was neutralized by adding diluted hydrochloric acid, and added with water (200 ml). The deposited crystals were taken by filtration. The obtained crude crystals were dissolved in a small amount of DMAc, and added with methanol until crystals were deposited. The crystals were taken by filtration and dried to obtain 22 g of Exemplary compound (P-6) as white crystals.

The compounds represented by the formula (1) used for the present invention may be used by dissolving said compound in water or a suitable organic solvent, for example, alcohols such as methanol, ethanol, propanol, and fluorinated alcohol, ketones such as acetone, methyl ethyl ketone, and methyl isobutyl ketone, dimethylformamide, dimethyl sulfoxide, methyl cellosolve and the like. A compound having an acidic group nay be neutralized with equivalent alkali and added as a salt.

The compounds may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compounds may be used after dispersion of a powder in water by using a ball mill, a colloid mill, a sand grinder mil, MANTON GAULIN, a microfluidizer, or by means of ultrasonic wave according to a known method for solid dispersion.

The compounds represented by the formula (1) used for the present invention may be added to any layers on a support provided at the side of the image-forming layer, i.e., the image-forming layer and/or the other layers provided on the same side. The compounds may preferably be added to the image-forming layer and a layer adjacent thereto. Those compounds may be used a lone, or in any combination of two or more of them. The compounds represented by the formula (1) can be used in a desired amount for obtaining desired performance such as sensitivity and fog. The compound is preferably added in an amount of $10^{-4}$ to 1 mol, more preferably $10^{-3}$ to $5\times10^{1}$ mol per mole of non-photosensitive silver salt in the image-forming layer.

When the heat-developable photosensitive material of the present invention is used for graphic art applications, it preferably shows γ (gradient of a straight line connecting the points at densities of 0.2 and 2.5 with the abscissa being a logarithm of exposure amount) after heat development of 5 to 20, particularly preferably 10 to 18. One of the means for obtaining such contrast is addition of a nucleating agent to the photosensitive layer or a layer adjacent thereto.

The heat-developable photosensitive material of the present invention preferably contains a nucleating agent (ultrahigh contrast agent). As the nucleating agent used for the present invention, substituted alkene derivatives, substituted isooxazole derivatives, and specific acetal compounds are preferably used.

The substituted alkene derivatives represented by the formula (2), substituted isooxazole derivatives represented by the formula (3), specific acetal compounds represented by the formula (4) for use in the present invention will be explained below.

In the formula (2), $R^1$, $R^2$ and $R^3$ each independently represents a hydrogen atom or a substituent, and Z represents an electron withdrawing group or a silyl group. $R^1$ and Z, $R^2$ and $R^3$, $R^1$ and $R^2$, or $R^3$ and Z may be combined with each other to form a ring structure. In the formula (3), $R^4$ represents a substituent; and in the formula (4), X and Y independently represent a hydrogen atom or a substituent, A and B independently represent an alkoxy group, an alkylthio group, an alkylamino group, an aryloxy group, an arylthio group, an anilino group, a heterocyclyloxy group, a heterocyclylthio group or a heterocyclylamino group, and X and Y, or A and B may be combined with each other to form a ring structure.

The compound represented by the formula (2) will be explained in detail below.

In the formula (2), $R^1$, $R^2$ and $R^3$ independently represent a hydrogen atom or a substituent, and Z represents an electron withdrawing group or a silyl group. In the formula (2), $R^1$ and Z, $R^2$ and $R^3$, $R^1$ and $R^2$, or $R^3$ and Z may be combined with each other to form a ring structure.

When $R^1$, $R^2$ or $R^3$ represents a substituent, examples of the substituent include a halogen atom (e.g., fluorine, chlorine, bromide, iodine), an alkyl group (including an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group (e.g., pyridinio group), an acyl group, an alkoxycarbonyl group, an aryloxycarbonyl group, a carbamoyl group, carboxyl group or a salt thereof, an imino group, an imino group substituted at N atom, a thiocarbonyl group, a sulfonylcarbamoyl group, an acylcarbamoyl group, a sulfamoylcarbamoyl group, a carbazoyl group, an oxalyl group, an oxamoyl group, cyano group, a thiocarbamoyl group, hydroxyl group (or a salt thereof), an alkoxy group (including a group containing ethyleneoxy group or propyleneoxy group repeating unit), an aryloxy group, a heterocyclyloxy group, an acyloxy group, an (alkoxy or aryloxy)carbonyloxy group, a carbamoyloxy group, a sulfonyloxy group, an amino group, an (alkyl, aryl or heterocyclic)amino group, an acylamino group, a sulfonamido group, a ureido group, a thioureido group, an imido group, an (alkoxy or aryloxy)carbonylamino group, a sulfamoylamino group, a semicarbazide group, a thiosemicarbazide group, a hydrazino group, a quaternary ammonio group, an oxamoylamino group, an (alkyl or aryl) sulfonylureido group, an acylureido group, an acylsulfamoyl amino group, nitro group, mercapto group, an (alkyl, aryl or heterocyclic)thio group, an acylthio group, an (alkyl or aryl)sulfonyl group, an (alkyl or aryl)sulfinyl group, sulfo group or a salt thereof, a sulfamoyl group, an acylsulfamoyl group, a sulfonylsulfamoyl group or a salt thereof, a phosphoryl group, a group containing phosphor amide or phosphoric acid ester structure, a silyl group and a stannyl group.

These substituents may further be substituted with any one or more of the above-described substituents.

The electron withdrawing group represented by Z in the formula (2) is a substituent that gives a positive value of the Hammett's substituent constant σp, and specific examples include cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, nitro group, a halogen atom, a perfluoroalkyl group, a perfluoro alkylamido group, a sulfonamido group, an acyl group, a formyl group, a phosphoryl group, carboxyl group (or a salt thereof), sulfo group (or a salt thereof), a heterocyclic group, an alkenyl group, an alkynyl group, an acyloxy group, an acylthio group, a sulfonyloxy group, and an aryl group substituted with the above-described electron withdrawing group. The heterocyclic group mentioned above is a saturated or unsaturated heterocyclic group, and examples include a pyridyl group, a quinolyl group, a quinoxalinyl group, a pyrazinyl group, a benzotriazolyl group, an imidazolyl group, a benzimidazolyl group, a hydantoin-1-yl group, a succinimido group and a phthalimido group.

The electron withdrawing group represented by Z in the formula (2) may further have one or more substituents, and examples of the substituents include those described as the substituent represented by $R^1$, $R^2$ or $R^3$ in the formula (2).

In the formula (2), $R^1$ and Z, $R^2$ and $R^3$, $R^1$ and $R^2$, or $R^3$ and Z may be combined with each other to form a ring structure. The ring structure formed is a non-aromatic carbocyclic ring or a non-aromatic heterocyclic ring.

The preferred scope of the compound represented by the formula (2) will be described below.

The silyl group represented by Z in the formula (2) may preferably be trimethylsilyl group, t-butyldimethylsilyl group, phenyldimethylsilyl group, triethylsilyl group, triisopropylsilyl group or trimethylsilyl dimethylsilyl group.

The electron withdrawing group represented by Z in the formula (2) may preferably be a group having a total carbon atom number of from 0 to 30 such as cyano group, an alkoxycarbonyl group, an aryloxycarbonyl group, a carbamoyl group, a thiocarbonyl group, an imino group, an imino group substituted at N atom, a sulfamoyl group, an alkylsulfonyl group, an arylsulfonyl group, nitro group, a perfluoroalkyl group, an acyl group, a formyl group, a phosphoryl group, an acyloxy group, an acylthio group or a phenyl group substituted with one or more electron withdrawing groups, more preferably cyano group, an alkoxycarbonyl group, a carbamoyl group, an imino group, a sulfamoyl group, an alkylsulfonyl group, an arylsulfonyl group, an acyl group, a formyl group, a phosphoryl group, a trifluoromethyl group, or a phenyl group substituted with one or more electron withdrawing group, and most preferably cyano group, a formyl group, an acyl group, an alkoxycarbonyl group, an imino group or a carbamoyl group.

The group represented by Z in the formula (2) is preferably an electron withdrawing group.

The substituent represented by $R^1$, $R^2$ or $R^3$ in the formula (2) may preferably be a group having a total carbon atom number of from 0 to 30, and specific examples of the group include a the same groups as those explained as the electron withdrawing group represented by Z in the formula (2), as well as an alkyl group, hydroxyl group (or a salt thereof), mercapto group (or a salt thereof), an alkoxy group, an aryloxy group, a heterocyclyloxy group, an alkylthio group, an arylthio group, a heterocyclylthio group, an amino group, an alkylamino group, an arylamino group, a heterocyclylamino group, a ureido group, an acylamino group, a sulfonamido group and a substituted or unsubstituted aryl group and the like.

In the formula (2), $R^1$ is preferably an electron withdrawing group, an aryl group, an alkylthio group, an alkoxy group, an acylamino group, hydrogen atom, or a silyl group.

When $R^1$ represents an electron withdrawing group, the electron withdrawing group may preferably be a group having a total carbon atom number of from 0 to 30 such as cyano group, nitro group, an acyl group, a formyl group, an alkoxycarbonyl group, an aryloxycarbonyl group, a thiocarbonyl group, an imino group, an imino group substituted at N atom, an alkylsulfonyl group, an arylsulfonyl group, a carbamoyl group, a sulfamoyl group, a trifluoromethyl group, a phosphoryl group, carboxyl group (or a salt thereof), a saturated or unsaturated heterocyclic group, more preferably cyano group, an acyl group, a formyl group, an alkoxycarbonyl group, a carbamoyl group, an imino group, an imino group substituted at N atom, a sulfamoyl group, carboxyl group (or a salt thereof) or a saturated or unsaturated heterocyclic group, and most preferably cyano group, a formyl group, an acyl group, an alkoxycarbonyl group, a carbamoyl group or a saturated or unsaturated heterocyclic group.

When $R^1$ represents an aryl group, the aryl group is preferably a substituted or unsubstituted phenyl group having a total carbon atom number of from 6 to 30. The substituent may be any substituent, and an electron withdrawing substituent is preferred.

In the formula (2), $R^1$ is more preferably an electron withdrawing group or an aryl group.

The substituent represented by $R^2$ or $R^3$ in the formula (2) may preferably be the same group as those explained as the electron withdrawing group represented by Z in the formula (2), as well as an alkyl group, hydroxyl group (or a salt thereof), mercapto group (or a salt thereof), an alkoxy group, an aryloxy group, a heterocyclyloxy group, an alkylthio group, an arylthio group, a heterocyclylthio group, an amino group, an alkylamino group, an anilino group, a heterocyclylamino group, an acylamino group or a substituted or unsubstituted phenyl group.

In the formula (2), it is more preferred that one of $R^2$ and $R^3$ is hydrogen atom and the other is a substituent. The substituent may preferably be an alkyl group, hydroxyl group (or a salt thereof), mercapto group (or a salt thereof), an alkoxy group, an aryloxy group, a heterocyclyloxy group, an alkylthio group, an arylthio group, a heterocyclylthio group, an amino group, an alkylamino group, an anilino group, a heterocyclylamino group, an acylamino group (particularly, a perfluoroalkanamido group), a sulfonamido group, a substituted or unsubstituted phenyl group or a heterocyclic group, more preferably hydroxyl group (or a salt thereof), mercapto group (or a salt thereof), analkoxy group, an aryloxy group, a heterocyclyloxy group, an alkylthio group, an arylthio group, a heterocyclylthio group or a heterocyclic group, and most preferably hydroxyl group (or a salt thereof), an alkoxy group or a heterocyclic group.

In the formula (2), it is also preferred that Z and $R^1$ or $R^2$ and $R^3$ form a ring structure. The ring structure formed is a non-aromatic carbocyclic ring or a non-aromatic heterocyclic ring, preferably a 5-, 6- or 7-membered ring structure having a total carbon atom number, including those of substituents thereon, of from 1 to 40, more preferably from 3 to 30.

The compound represented by the formula (2) is more preferably a compound wherein Z represents cyano group, a formyl group, an acyl group, an alkoxycarbonyl group, an imino group or a carbamoyl group; $R^1$ represents an electron withdrawing group or an aryl group, and one of $R^2$ and $R^3$ represents hydrogen atom and the other represents hydroxyl group (or a salt thereof), mercapto group (or a salt thereof), an alkoxy group, an aryloxy group, a heterocyclyloxy group, an alkylthio group, an arylthio group, a heterocyclylthio group or a heterocyclic group. A class of most preferable compounds represented by the formula (2) are constituted by those wherein Z and $R^1$ form a non-aromatic 5—, 6- or 7-membered ring structure, and one of $R^2$ and $R^3$ represents hydrogen atom and the other represents hydroxyl group (or a salt thereof), mercapto group (or a salt thereof), an alkoxy group, an aryloxy group, a heterocyclyloxy group, an alkylthio group, an arylthio group, a heterocyclylthio group or a heterocyclic group. In such a compound, Z which forms a non-aromatic ring structure together with $R^1$ is preferably an acyl group, a carbamoyl group, an oxycarbonyl group, a thiocarbonyl group or a sulfonyl group, and $R^1$ is preferably an acyl group, a carbamoyl group, an oxycarbonyl group, a thiocarbonyl group, a sulfonyl group, an imino group, an imino group substituted at N atom, an acylamino group or a carbonyl thio group.

Them compound represented by the formula (3) will be described below.

In the formula (3), R4 represents a substituent. Examples of the substituent represented by $R^4$ include those explained as the substituent represented by $R^1$, $R^2$ or $R^3$ in the formula (2).

The substituent represented by $R^4$ in the formula (3) may preferably be an electron withdrawing group or an aryl group. Where $R^4$ represents an electron withdrawing group, the electron withdrawing group may preferably be a group having a total carbon atom number of from 0 to 30, such as cyano group, nitro group, an acyl group, a formyl group, an alkoxycarbonyl group, an aryloxycarbonyl group, an alkylsulfonyl group, an arylsulfonyl group, a carbamoyl group, a sulfamoyl group, a trifluoromethyl group, a phosphoryl group, an imino group or a saturated or unsaturated heterocyclic group, more preferably cyano group, an acyl group, a formyl group, an alkoxycarbonyl group, a carbamoyl group, a sulfamoyl group, an alkylsulfonyl group, an arylsulfonyl group or a heterocyclic group, and most preferably cyano group, a formyl group, an acyl group, an alkoxycarbonyl group, a carbamoyl group or a heterocyclic group.

Where $R^4$ represents an aryl group, the aryl group may preferably be a substituted or unsubstituted phenyl group having a total carbon atom number of from 6 to 30. Examples of the substituent include those described as the substituent represented by $R^1$, $R^2$ or $R^3$ in the formula (1).

$R^4$ is most preferably cyano group, an alkoxycarbonyl group, a carbamoyl group, a heterocyclic group or a substituted or unsubstituted phenyl group, and most preferably cyano group, a heterocyclic group or an alkoxycarbonyl group.

The compound represented by the formula (4) will be described in detail below.

In the formula (4), X and Y each independently represent hydrogen atom or a substituent, and A and B each independently represent an alkoxy group, an alkylthio group, an alkylamino group, an aryloxy group, an arylthio group, an anilino group, a heterocyclylthio group, a heterocyclyloxy group or a heterocyclylamino group, and X and Y or A and B may be combined with each other to form a ring structure.

Examples of the substituent represented by X or Y in the formula (4) include those described as the substituent represented by $R^1$, $R^2$ or $R^3$ in the formula (2). Specific examples include an alkyl group (including a perfluoroalkyl group and a trichloromethyl group), an aryl group, a heterocyclic group, a halogen atom, cyano group, nitro group, an alkenyl group, an alkynyl group, an acyl group, a formyl group, an alkoxycarbonyl group, an aryloxycarbonyl group, an imino group, an imino group substituted at the nitrogen atom, a carbamoyl group, a thiocarbonyl group, an acyloxy group, an acylthio group, an acylamino group, an alkylsulfonyl group, an arylsulfonyl group, a sulfamoyl group, a phosphoryl group, carboxyl group (or a salt thereof), sulfo group (or a salt thereof), hydroxyl group (or a salt thereof), mercapto group (or a salt thereof), an alkoxy group, an aryloxy group, a heterocyclyloxy group, an alkylthio group, an arylthio group, a heterocyclylthio group, an amino group, an alkylamino group, an anilino group, a heterocyclylamino group, a silyl group and the like.

These groups may further have one or more substituents. X and Y may be combined with each other to form a ring structure, and the ring structure formed may be either a non-aromatic carbocyclic ring or a non-aromatic heterocyclic ring.

In the formula (4), the substituent represented by X or Y may preferably be a substituent having a total carbon number of from 1 to 40, more preferably from 1 to 30, such as cyano group, an alkoxycarbonyl group, an aryloxycarbonyl group, a carbamoyl group, an imino group, an imino group substituted at the nitrogen atom, a thiocarbonyl group, a sulfamoyl group, an alkylsulfonyl group, an arylsulfonyl group, nitro group, a perfluoroalkyl group, an acyl group, a formyl group, a phosphoryl group, an acylamino group, an acyloxy group, an acylthio group, a heterocyclic group, an alkylthio group, an alkoxy group or an aryl group.

In the formula (4), X and Y are more preferably cyano group, nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted at the nitrogen atom, a phosphoryl group, a trifluoromethyl group, a heterocyclic group, a substituted phenyl group or the like, most preferably cyano group, an alkoxycarbonyl group, a carbamoyl group, an alkylsulfonyl group, an arylsulfonyl group, an acyl group, an acylthio group, anacylamino group, a thiocarbonyl group, a formyl group, an imino group, an imino group substituted at the nitrogen atom, a heterocyclic group a phenyl group substituted by any electron withdrawing group or the like.

X and Y may also be preferably combined with each other to form a non-aromatic carbocyclic ring or a non-aromatic heterocyclic ring. The ring structure formed is preferably a 5-, 6- or 7-membered ring having a total carbon atom number of from 1 to 40, more preferably from 3 to 30. X and Y which form a ring structure are preferably an acyl group, a carbamoyl group, an oxycarbonyl group, a thiocarbonyl group, a sulfonyl group, an imino group, an imino group substituted at the nitrogen atom, an acylamino group, a carbonyl thio group or the like.

In the formula (4), A and B each independently represent an alkoxy group, an alkylthio group, an alkylamino group, an aryloxy group, an arylthio group, an anilino group, a heterocyclylthio group, a heterocyclyloxy group or a heterocyclylamino group, which may be combined with each other to form a ring structure. The substituents represented by A and B in the formula (4) are preferably a group having a total carbon atom number of from 1 to 40, more preferably from 1 to 30, and the group may further have one or more substituents.

In the formula (4), it is more preferred that A and B are combined with each other to form a ring structure. The ring structure formed is preferably a 5-, 6- or 7-membered non-aromatic heterocyclic ring having a total carbon atom number of from 1 to 40, more preferably from 3 to 30. Examples of a structure (—A—B—) formed by the linking of A and B include —O—$(CH_2)_2$—O—, —O—$(CH_2)_3$—O—, —S—$(CH_2)_2$—S—, —S—$(CH_2)_3$—S—, —S—ph—

S—, —N($CH_3$)-($CH_2$)$_2$—O—, —N($CH_3$)-($CH_2$)$_2$—S—, —O—($CH_2$)$_2$—S—, —O—($CH_2$)$_3$—S—, —N($CH_3$)—ph—O—, —N($CH_3$)—ph—S—, —N(ph)-($CH_2$)$_2$—S— and the like.

In the present invention, cyclic compounds represented by the formula (A) and the formula (B) are most preferably used as the nucleating agent.

In the formula (A), $Z^{11}$ represents a nonmetallic atomic group which can form a 5- to 7-membered ring structure with —$Y^{11}$—C(=CH—$X^{11}$)—C(=O)—. Preferably, $Z^{11}$ is an atomic group constituted by atoms selected from carbon atom, oxygen atom, sulfur atom, nitrogen atom and hydrogen atom, and several atoms selected from these atoms are bonded to one another through a single bond or a double bond to form a 5- to 7-membered ring structure with —$Y^{11}$—C(=CH—$X^{11}$)—C(=O)—. $Z^{11}$ may have a substituent, or $Z^{11}$ itself may be a part of an aromatic or non-aromatic carbon ring, or an aromatic or non-aromatic heterocycle. In the latter case, the 5- to 7-membered ring structure formed by $Z^{11}$ and —$Y^{11}$—C(=CH—$X^{11}$)—C(=O)— will be a condensed ring structure.

In the formula (B), $Z^{12}$ represents a nonmetallic atomic group which can form a 5- to 7-membered ring structure with —$Y^{12}$—C(=CH—$X^{12}$)—C($Y^{13}$)=N—. Preferably, $Z^{12}$ is an atomic group constituted by atoms selected from carbon atom, oxygen atom, sulfur atom, nitrogen atom and hydrogen atom, and several atoms selected from these atoms are bonded to one another through a single bond or a double bond to form a 5- to 7-membered ring structure with —$Y^{12}$—C (=CH—$X^{12}$)—C($Y^{13}$)=N—. $Z^{12}$ may have a substituent, or $Z^{12}$ itself may be a part of an aromatic or non-aromatic carbon ring, or an aromatic or non-aromatic heterocycle. In the latter case, the 5- to 7-membered ring structure formed by $Z^{12}$ and —$Y^{12}$—C(=CH—$X^{12}$)—C($Y^{13}$)=N— will be a condensed ring structure.

When $Z^{11}$ and $Z^{12}$ have a substituent, examples of the substituent include those listed below.

That is, typical examples of the substituent include, for example, a halogen atom (fluorine atom, chlorine atom, bromine atom or iodine atom), an alkyl group (including an aralkyl group, a cycloalkyl group, active methine group etc.), an alkenyl group, an alkynyl group, an aryl group, a heterocyclic group, a heterocyclic group containing a quaternized nitrogen atom (for example, pyridinio group), an acyl group, an alkoxycarbonyl group, an aryloxycarbonyl group, a carbamoyl group, carboxy group or a salt thereof, a sulfonylcarbamoyl group, an acylcarbamoyl group, a sulfamoylcarbamoyl group, a carbazoyl group, an oxalyl group, an oxamoyl group, cyano group, a thiocarbamoyl group, hydroxyl group, an alkoxy group (including groups containing repeating units of ethyleneoxy group or propyleneoxy group), an aryloxy group, a heterocyclyloxy group, an acyloxy group, an (alkoxy or aryloxy)carbonyloxy group, a carbamoyloxy group, a sulfonyloxy group, amino group, an (alkyl, aryl or heterocyclyl)amino group, an N-substituted nitrogen-containing heterocyclic group, an acylamino group, a sulfonamide group, a ureido group, a thioureido group, an imido group, an (alkoxy or aryloxy) carbonylamino group, a sulfamoylamino group, a semicarbazide group, a thiosemicarbazide group, a hydrazino group, a quaternary ammonio group, an oxamoylamino group, an (alkyl or aryl)sulfonylureido group, an acylureido group, an acylsulfamoyl amino group, nitro group, mercapto group, an (alkyl, arylorheterocyclyl)thio group, an (alkyloraryl) sulfonyl group, an (alkyloraryl)sulfinyl group, sulfo group or a salt thereof, a sulfamoyl group, an acylsulfamoyl group, sulfonylsulfamoyl group or a salt thereof, a group containing phosphor amide or phosphoric acid ester structure, a silyl group, a stannyl group and so forth.

These substituents may further be substituted with any one or more of the above-described substituents.

$Y^{13}$ in the formula (B) will be explained hereafter.

In the formula (B), $Y^{13}$ represents a hydrogen atom or a substituent. When $Y^{13}$ represents a substituent, specific examples of the substituent include the following groups: an alkyl group, an aryl group, a heterocyclic group, cyano group, an acyl group, an alkoxycarbonyl group, an aryloxycarbonyl group, a carbamoyl group, amino group, an (alkyl, aryl or heterocyclyl)amino group, an acylamino group, a sulfonamide group, a ureido group, a thioureido group, an imido group, an alkoxy group, an aryloxy group, an (alkyl, aryl or heterocyclyl)thio group and so forth. These substituents may be substituted by arbitrary substituents, and the examples of the substituents include those exemplified for the substituents of $Z^{11}$ or $Z^{12}$.

In the formula (A) or (B), $X^{11}$ and $X^{12}$ represent hydroxyl group (or a salt thereof), an alkoxy group (for example, methoxy group, ethoxy group, propoxy group, isopropoxy group, octyloxy group, dodecyloxy group, cetyloxy group, t-butoxy group etc.), an aryloxy groups (for example, phenoxy group, p-t-octylphenoxy group etc.), a heterocyclyloxy group (for example, benzotriazolyl-5-oxy group, pyridinyl-3-oxy group etc.), mercapto group (or a salt thereof), an alkylthio group (for example, methylthio group, ethylthio group, butylthio group, dodecylthio group etc.), an arylthio group (for example, phenylthio group, p-dodecylphenylthio group etc.), a heterocyclylthio group (for example, 1-phenyltetrazolyl-5-thio group, mercaptothiadiazolylthio group etc.), amino group, an alkylamino group (for example, methylamino group, propylamino group, octylamino group, dimethylamino group etc.), an arylamino group (for example, anilino group, naphthylamino group etc.), a heterocyclylamino group (for example, pyridylamino group, benzotriazol-5-ylamino group), an acylamino group (for example, acetamide group, octanoylamino group, benzoylamino group, trifluoroacetylamino group etc.), a sulfonamide group (for example, methanesulfonamide group, benzenesulfonamide group, dodecylsulfonamide group etc.), or a heterocyclic group.

The heterocyclic group used herein is an aromatic or non-aromatic, saturated or unsaturated, substituted or unsubstituted nitrogen-containing heterocyclic group having a single ring or condensed ring, which is bonded at the nitrogen atom. Examples thereof include, for example, N-methylhydantoyl group, succinimide group, phthalimide group, N,N'-dimethylurazolyl group, imidazolyl group, benzotriazolyl group, indazolyl group, morpholino group, 4,4-dimethyl-2,5-dioxo-oxazolyl group and so forth.

The salt herein used means a salt with an alkali metal (sodium, potassium, lithium) or an alkaline earth metal (magnesium, calcium), silver salt, zinc salt, quaternary ammonium salt (tetraethylammonium salt, dimethylcetylbenzyl ammonium salt etc.), or quaternary phosphonium salt or the like.

In the formulas (A) and (B), $Y^{11}$ and $Y^{12}$ represent —C(=O)— or —$SO^2$—.

The preferred scope of the compounds represented by the formulas (A) and (B) will be described below.

In the formulas (A) and (B), $Y^{11}$ and $Y^{12}$ preferably represent —C(=O)—.

In the formula (A) or (B), $X^{11}$ and $X^{12}$ preferably represent hydroxyl group (or a salt thereof), an alkoxy group, a heterocyclyloxy group, an acylamino group, mercapto group (or a salt thereof), an alkylthio group, an arylthio group, a heterocyclylthio group, amino group, an alkylamino group, a sulfonamide group, or a heterocyclic group. Further preferably they represent hydroxyl group (or a salt thereof), an alkoxy group, mercapto group (or a salt thereof), an alkylthio group, or a heterocyclic group, and particularly preferably they represent a hydroxyl group (or a salt thereof) or mercapto group (or a salt thereof), an alkoxy group, or a heterocyclic group. Most preferably, they represent hydroxyl group (or a salt thereof) or an alkoxy group.

In the formula (A) or (B), when $X^{11}$ and $X^{12}$ represent alkoxy groups, the total carbon atom number thereof is preferably 1–18, further preferably 1–12, particularly preferably 1–5. In the formula (A) or (B), when $X^{11}$ and $X^{12}$ represent heterocyclic groups, the total carbon atom number thereof is preferably 2–20, further preferably 2–16.

In the formula (A), $Z^{11}$ is preferably an atomic group that can form a 5- or 6-membered cyclic structure. Specific examples thereof include atomic groups constituted by atoms selected from nitrogen atom, carbon atom, sulfur atom and oxygen atom, for example, —N—N—, —N—C—, —O—C—, —C—C—, —C═C—, —S—C—, —C═C—N—, —C═C—O—, —N—C—N—, —N═C—N—, —C—C—C—, —C═C—C—, —O—C—O— and so forth, which further have a hydrogen atom or substituent.

$Z^{11}$ is more preferably an atomic group selected from —N—N—, —N—C—, —O—C—, —C—C—, —C═C—, —S—C—, —N—C—N—, —C═C—N— and so forth, which further have a hydrogen atom or substituent, particularly preferably an atomic group selected form —N—N—, —N—C—, —C═C— and so forth, which further have a hydrogen atom or substituent.

Those compounds where $Z^{11}$ itself is a part of an aromatic or non-aromatic carbon ring or an aromatic or non-aromatic heterocycle and forms a condensed ring structure together with a 5- to 7-membered ring structure formed by $Z^{11}$ and —$Y^{11}$—C(═CH—$X^{11}$)—C(═O)— are also preferred. In this case, examples of the aromatic or non-aromatic carbon ring and the aromatic or non-aromatic heterocycle include, for example, benzene ring, naphthalene ring, pyridine ring, cyclohexane ring, piperidine ring, pyrazolidine ring, pyrrolidine ring, 1,2-piperazine ring, 1,4-piperazine ring, oxane ring, oxolane ring, thiane ring, thiolane ring and so forth. Among these, benzenering, piperidine ring and 1,2-piperazine ring are preferred, and benzene ring is the most preferred.

In the formula (B), $Z^{12}$ is preferably an atomic group that can form a 5- or 6-membered cyclic structure. Specific examples thereof include atomic groups constituted by atoms selected from nitrogen atom, carbon atom, sulfur atom and oxygen atom, for example, —N—, —O—, —S—, —C—, —C═C—, —C—C—, —N—C—, —N═C—, —O—C—, —S—C— and so forth, which further have, if possible, a hydrogen atom or a substituent.

Those compounds where $Z^{12}$ itself is a part of an aromatic or non-aromatic carbon ring or an aromatic or non-aromatic heterocycle and forms a condensed ring structure together with a 5- to 7-membered ring structure formed by $Z^{12}$ and —$Y^{12}$—C(═CH—$X^{12}$)—C($Y^{13}$)═N— are also preferred. In this case, examples of the aromatic or non-aromatic carbon ring and the aromatic or non-aromatic heterocycle include, for example, benzene ring, naphthalene ring, pyridine ring, cyclohexane ring, piperidine ring, pyrazolidine ring, pyrrolidine ring, 1,2-piperazine ring, 1,4-piperazine ring, oxane ring, oxolane ring, thiane ring, thiolane ring and so forth.

In the formula (B), $Z^{12}$ is more preferably an atomic group selected form —N—, —O—, —S—, —C—, —C═C— and so forth, which further have a hydrogen atom or substituent, particularly preferably an atomic group selected from —N—, —O— and so forth, which further have a hydrogen atom or substituent.

In the formulas (A) and (B), the substituent possessed by $Z^{11}$ or $Z^{12}$ is preferably an alkyl group, an aryl group, a halogen atom, a heterocyclic group, anacyl group, analkoxycarbonyl group, an aryloxycarbonyl group, a carbamoyl group, carboxy group or a salt thereof, a sulfonylcarbamoyl group, cyano group, hydroxyl group, an acyloxy group, an alkoxy group, an amino group, an (alkyl, aryl or heterocyclyl)amino group, an acylamino group, a sulfonamide group, a ureido group, a thioureido group, an imido group, an (alkoxy or aryloxy)carbonylamino group, a sulfamoylamino group, nitro group, mercapto group, an (alkyl, arylorheterocyclyl)thio group, an (alkyloraryl)sulfonyl group, sulfo group or a salt thereof, a sulfamoyl group or the like.

When $Z^{11}$ and $Z^{12}$ the mselves constitute a part of aromatic or non-aromatic carbon ring or aromatic or non-aromatic heterocycle to form a condensed ring structure, the aromatic or non-aromatic carbon ring or the aromatic or non-aromatic heterocycle may have a substituent. As such a substituent, those selected from the aforementioned substituents are preferred.

In the formula (B), $Y^{13}$ is preferably a hydrogen atom or a substituents selected from an alkyl group, an aryl group (in particular, phenyl group, naphthyl group), a heterocyclic group, cyano group, an acyl group, an alkoxycarbonyl group, a carbamoyl group, an (alkyl, aryl or heterocyclyl) amino group, an acylamino group, a sulfonamide group, a ureido group, an imido group, an alkoxy group, an aryloxy group, an (alkyl, aryl or heterocyclyl)thio group and so forth.

In the formula (B), $Y^{13}$ further preferably represents a substituent. Specifically, an alkyl group, phenyl group, amino group, an anilino group, an acylamino group, an alkoxy group, an aryloxy group and a carbamoyl group are preferred. These substituents may further have a substituent. However, the total carbon atom number thereof is preferably 1–30, more preferably 1–21.

The compound represented by the formula (A) preferably has atotal carbon atom number of 6 or more, and the compound represented by the formula (B) preferably has a total carbon atom number of 12 or more. While there is no particular restriction on the upper limit of the carbon atom numbers, the compound represented by the formula (A) preferably has a total carbon atom number of 40 or less, more preferably 32 or less, and the compound represented by the formula (B) preferably has a total carbon atom number of 40 or less, more preferably 32 or less.

In the formula (A), $Z^{11}$ preferably has a total carbon atom number of 2 or more, more preferably 3 or more, including its substituent(s). In the formula (B), the sum of total carbon atom numbers of $Z^{12}$ and $Y^{13}$ is preferably 8 or more. In the formula (A), $Z^{11}$ preferably has a total carbon atom number of 3 to 40, particularly preferably 6 or 30, including its substituent(s). In the formula (B), the sum of total carbon atom numbers of $Z^{12}$ and $Y^{13}$ is preferably 8 to 40, particularly preferably 8 or 30 including its substituent(s).

Among the compounds represented by the formula (A) of the present invention, particularly preferred compounds are those compounds of the formula (A) where $Y^{11}$ represents a carbonyl group and $Z^{11}$ forms an indanedione ring, pyrrolidinedione ring or pyrazolidinedione ring together with —$Y^{11}$—C(═CH—$X^{11}$)—C (═O)—. Inter alia, those compounds which form a pyrazolidinedione ring are particularly preferred. Among the compounds represented by the formula (B) used for the present invention, particularly preferred compounds are those compounds of the formula (B) where $Y^{12}$ represents a carbonyl group and $Z^{12}$ forms 5-pyrazolone ring together with —$Y^{12}$—C(═CH—$X^{12}$)—C($Y^{13}$)═N—.

In the compounds represented by the formulas (2), (3), (4), (A) and (B) for use in the present invention, an group capable of adsorbing to silver halide may be introduced. Examples of such adsorbing group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamide group, a mercaptoheterocyclic group and a triazole group. The adsorbing group to silver halide may be formed as a precursor. Examples of the precursor include the groups described in JP-A-2-285344.

In the compounds represented by the formulas (2), (3), (4), (A) and (B) for use in the present invention, a ballast group or a polymer commonly used in the field of immobile photographic additives such as a coupler, may be introduced. The compounds which incorporates the ballast group may be preferred for the present invention. The ballast group is a group having 8 or more carbon atoms and being relatively inactive in the photographic performance. Examples of the ballast group include an alkyl group, an aralkyl group, an alkoxy group, a phenyl group, an alkylphenyl group, a phenoxy group, an alkylphenoxy group and the like. Examples of the polymer include those described in JP-A-1-100530 and the like.

The compounds represented by the formulas (2), (3), (4), (A) and (B) for use in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclyl)thio group, or a dissociative group capable of dissociation by a base (e.g., carboxy group, sulfo group, an acylsulfamoyl group, a carbamoylsulfamoyl group), preferably a group containing an ethyleneoxy group or a propyleneoxy group as a repeating unit, oran (alkyl, aryl or heterocyclic)thio group. Specific examples of these groups include the compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Specific examples of the compounds represented by the formulas (2), (3), (4), (A) and (B) for use in the present invention are shown below. However, the scope of the present invention is not limited to the following compounds.

C-1

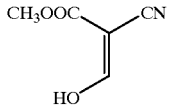

-continued

C-2

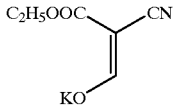

C-3

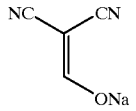

C-4

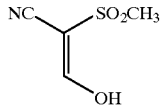

C-5

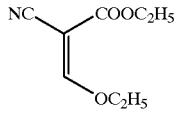

C-6

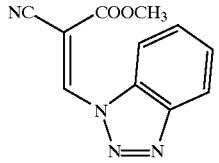

C-7

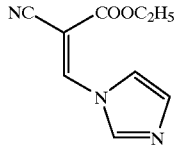

C-8

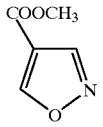

C-9

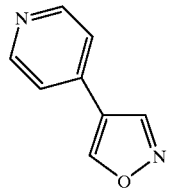

C-10

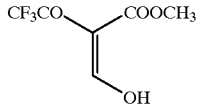

C-11

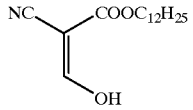

-continued
C-12
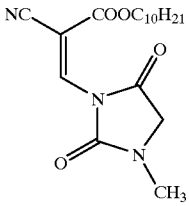
C-13
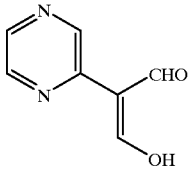
C-14
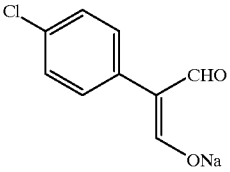
C-15
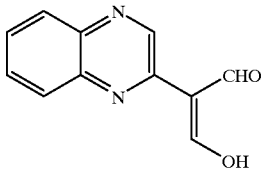
C-16
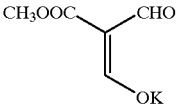
C-17
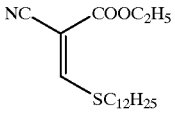
C-18
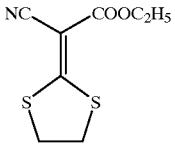
C-19
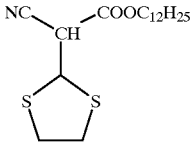
C-20
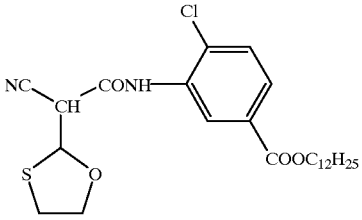
-continued
C-21
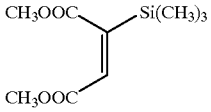
C-22
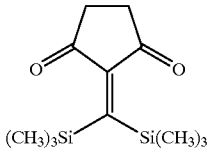
C-23
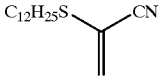
C-24
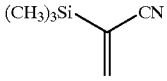
C-25
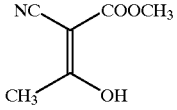
C-26
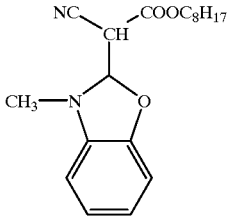
C-27
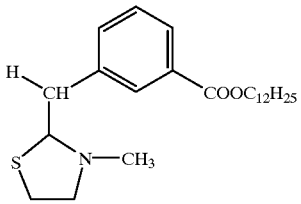
C-28
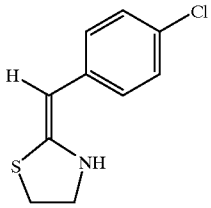
C-29
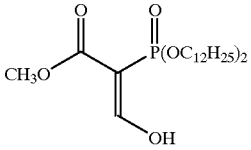
C-30
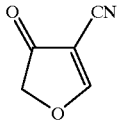

-continued
C-31
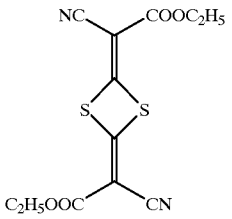
C-32
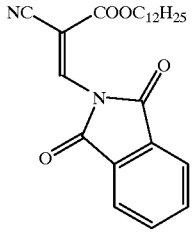
C-33
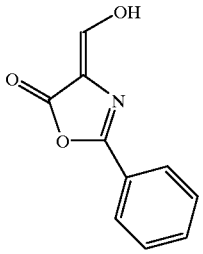
C-34
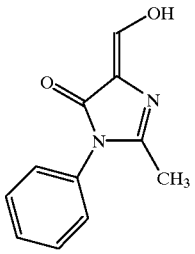
C-35
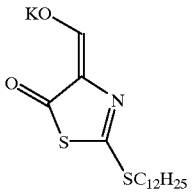
C-36
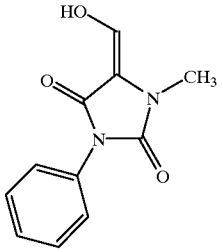
-continued
C-37
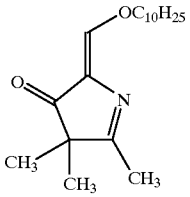
C-38
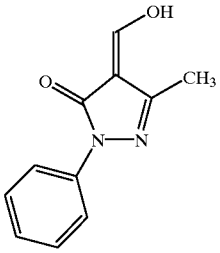
C-39
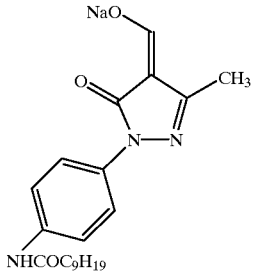
C-40
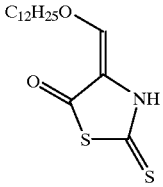
C-41
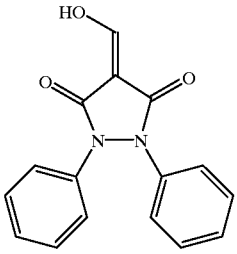
C-42
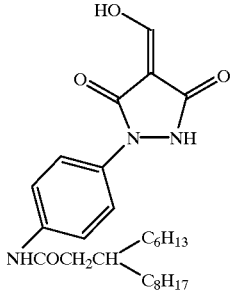

-continued
C-43
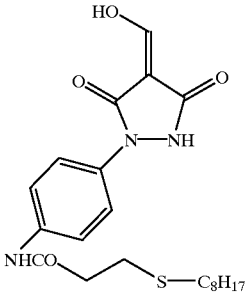
C-44
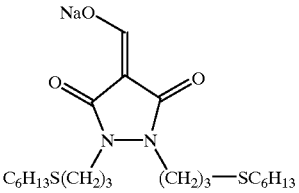
C-45
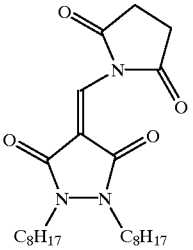
C-46
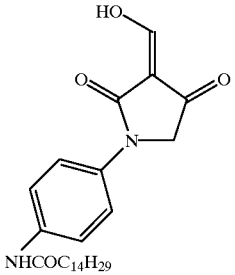
C-47
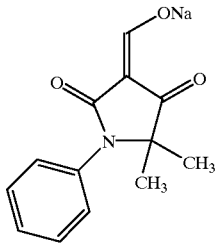
C-48
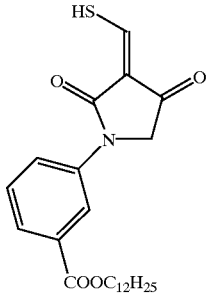
-continued
C-49
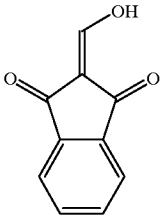
C-50
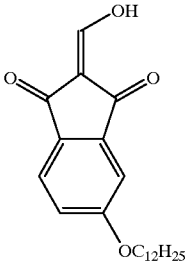
C-51
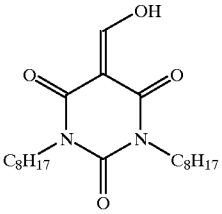
C-52
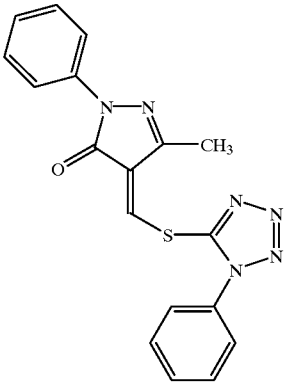
C-53
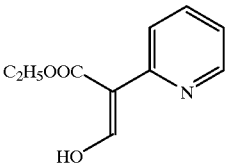
C-54
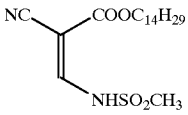

-continued
C-55
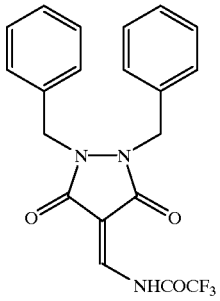
C-56
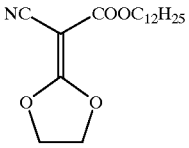
C-57
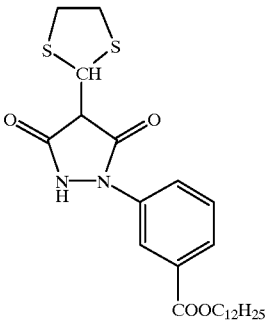
C-58
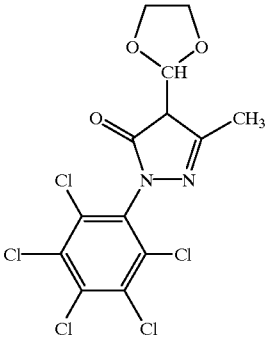
C-59
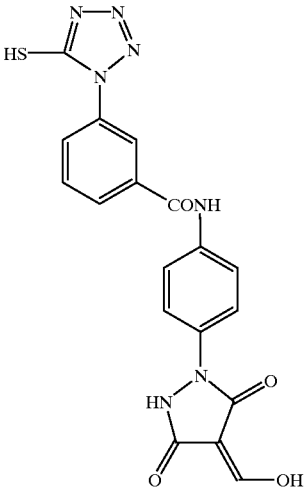
-continued
C-60
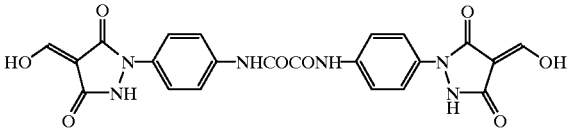
C-61
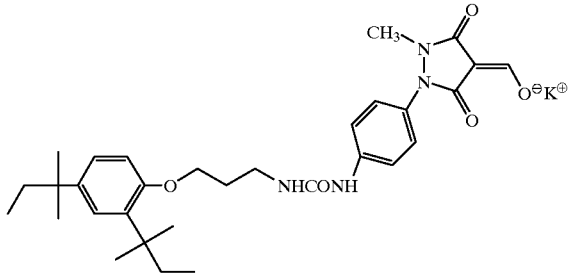
C-62
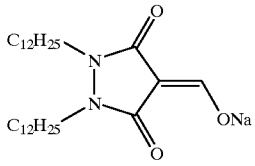
C-63
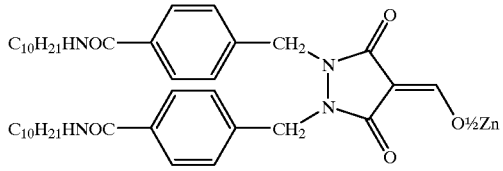
C-64
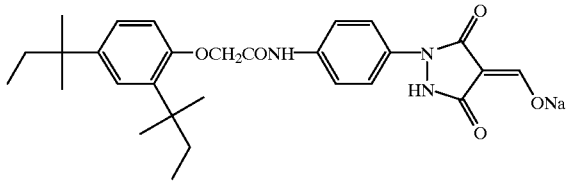
C-65
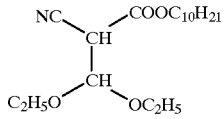
C-66
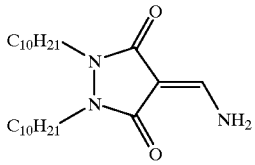

-continued

C-67

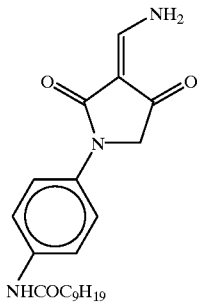

C-68

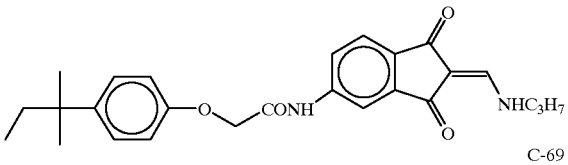

C-69

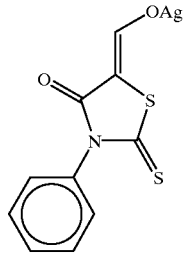

C-70

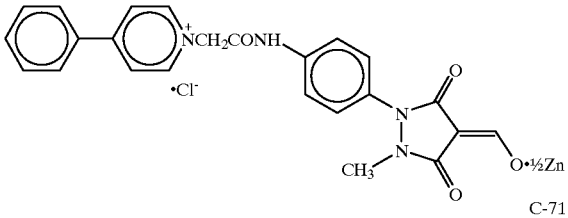

C-71

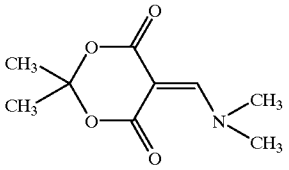

C-72

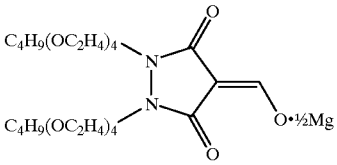

C-73

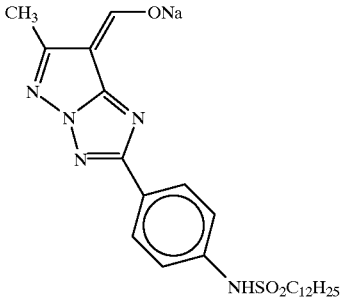

-continued

C-74

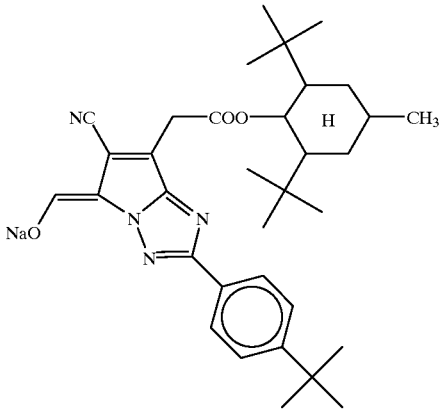

C-75

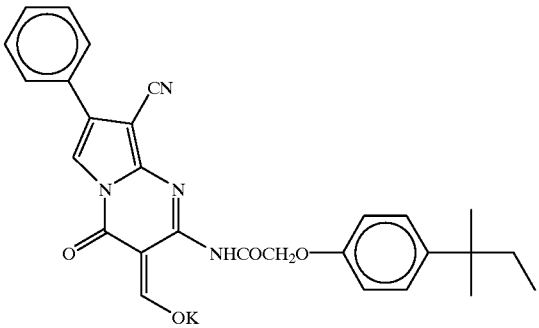

The compounds represented by the formulas (2), (3), (4), (A) and (B) for use in the present invention may be used after being dissolved in water or an appropriate organic solvent such as alcohol (e.g., methanol, ethanol, propanol, fluorinated alcohol), ketone (e.g., acetone, methyl ethyl ketone), dimethylformamide, dimethyl sulfoxide or methyl cellosolve.

The compounds may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compounds may be used after dispersion of a powder in an appropriate solvent such as water by using a ball mill, a colloid mill, or by means of ultrasonic wave according to a known method for solid dispersion.

The compounds represented by the formulas (2), (3), (4), (A) and (B) for use in the present invention may be added to any layers on a support provided at the side of the image-forming layer, i.e., the image-forming layer and/or the other layers providedonthe sameside. The compounds-maypreferably beadded to the image-forming layer and a layer adjacent thereto.

The amount of the compounds represented by the formulas (2), (3), (4), (A) and (B) for use in the present invention is preferably from $1\times10^{-6}$ to 1 mol, more preferably from $1\times10^{-5}$ to $5\times10^{-1}$ mol, most preferably from $2\times10^{-5}$ to $2\times10^{-1}$ mol per mole of silver.

The compounds represented by formulas (2), (3), (4), (A) and (B) can be easily synthe sized according to known methods. For example, the compounds may be synthe sized by referring to the methods described in U.S. Pat. Nos. 5,545,515, 5,635,339 and 5,654,130, International Patent Publication WO97/34196 or JP Application Nos. 9-354107, JP-A-11-133546 and JP-A-11-95365.

The compounds represented by the formulas (2), (3), (4), (A) and (B) may be used alone or in combination of two or more compounds. In addition to these compounds, any of the compounds described in U.S. Pat. Nos. 5,545,515, 5,635,339 and 5,654,130, International Patent Publication WO97/34196, U.S. Pat. No. 5,686,228 or Japanese Patent Application Nos. 8-279962, 9-228881, 9-354107, JP-A-11-119372, JP-A-11-133546, JP-A-11-119372, JP-A-11-109546, JP-A-11-95365, JP-A-11-95366 and JP-A-11-149136 may also be used in combination.

In the present invention, a hydrazine derivative may be used in combination as the nucleating agent.

Hydrazine derivatives represented by the following general formula (H) are preferably used.

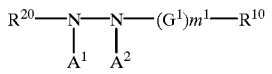

(H)

In the formula (H), $R^{20}$ represents an aliphatic group, an aromatic group or a heterocyclic group, $R^{10}$ represents a hydrogen atom or a block group, $G^1$ represents —CO—, —COCO—, —C(=S)—, —$SO_2$—, —SO—, —PO($R^{30}$)— (wherein $R^{30}$ is a group selected from the groups within the range defined for $R^{10}$, and $R^{30}$ may be different from $R^{10}$), or an iminomethylene group, $A^1$ and $A^2$ both represents a hydrogen atom or one represents a hydrogen atom and the other represents a substituted or unsubstituted alkylsulfonyl group, a substituted or unsubstituted arylsulfonyl group, or a substituted or unsubstituted acyl group, and ml represents 0 or 1 and when $m^1$ is 0, $R^{10}$ represents an aliphatic group, an aromatic group or a heterocyclic group.

The hydrazine derivatives represented by the formula (H) will be explained in detail hereafter.

In the formula (H), the aliphatic group represented by $R^{20}$ is preferably a substituted or unsubstituted, linear, branched or cyclic alkyl, alkenyl or alkynyl group having 1 to 30 carbon atoms.

In the formula (H), the aromatic group represented by $R^{20}$ is a monocyclic or condensed cyclic aryl group, and examples thereof include benzene ring, a phenyl group derived from naphthalene ring and a naphthyl group. The heterocyclic group represented by $R^{20}$ is a monocyclic or condensed cyclic, saturated or unsaturated, aromatic or non-aromatic heterocyclic group, and examples of heterocycle in this group include pyridine ring, pyrimidine ring, imidazole ring, pyrazole ring, quinoline ring, isoquinoline ring, benzimidazole ring, thiazole ring, benzothiazole ring, thiophene ring, triazine ring, morpholine ring, piperidine ring, piperazine ring, benzo[1,3]dioxol ring and so forth. $R^{20}$ may be substituted with any substituent.

$R^{20}$ is preferably an aryl group, an alkyl group or aromatic heterocyclic group, more preferably a substituted or unsubstituted phenyl group, a substituted alkyl group having 1 to 3 carbon atoms or an aromatic heterocyclic group.

When $R^{20}$ represents a substituted alkyl group having 1 to 3 carbon atoms, $R^{20}$ is more preferably a substituted methyl group, furtherpreferably a disubstitutedortrisubstitutedmethyl group. When $R^{20}$ represents a substituted methyl group, $R^{20}$ is preferably t-butyl group, dicyanomethyl group, dicyanophenylmethyl group, triphenylmethyl group (trityl group), diphenylmethyl group, methoxycarbonyldiphenylmethyl group, cyano diphenylmethyl group, methylthio diphenylmethyl group or cyclopropyl diphenylmethyl group, most preferably trityl group.

When $R^{20}$ represents a heterocyclic group, preferred heterocycles are pyridine ring, quinoline ring, pyrimidine ring, triazine ring, benzothiazole group, benzimidazole ring, thiophene ring and so forth.

In the formula (H), $R^{20}$ is most preferably substituted or unsubstituted phenyl group.

In the formula (H), $R^{10}$ represents a hydrogen atom or a block group. The block group is specifically an aliphatic group (specifically, an alkyl group, an alkenyl group or an alkynyl group), an aromatic group (e.g., a monocyclic or condensed cyclic aryl group), a heterocyclic group, an alkoxy group, an aryloxy group, a substituted or unsubstituted amino group or a hydrazino group.

$R^{10}$ is preferably an alkyl group (substituted or unsubstituted alkyl group having 1 to 10 carbon atoms, for example, methyl group, ethyl group, trifluoromethyl group, difluoromethyl group, 2-carboxy tetrafluoroethyl group, pyridinio methyl group, difluoromethoxy methyl group, difluoro (methylthio)methyl group, difluoro carboxymethyl group, hydroxymethyl group, methanesulfonamido methyl group, benzenesulfonamidophenol group, trifluoroacetylmethyl group, dimethylaminomethyl group, phenylsulfonylmethyl group, o-hydroxybenzyl group, a methoxymethyl group, phenoxymethyl group, 4-ethylphenoxymethyl group, phenylthiomethyl group, t-butyl group, dicyanomethyl group, diphenylmethyl group, triphenylmethyl group, methoxycarbonyldiphenylmethyl group, cyano diphenylmethyl group, methylthio diphenylmethyl group etc.), an alkenyl group (alkenyl group having 1 to 10 carbon atoms, for example, vinyl group, 2-ethoxycarbonylvinyl group, 2-trifluoro-2-methoxycarbonylvinyl group, 2,2-di cyanovinyl group, 2-cyano-2-methoxycarbonylvinyl group, 2-cyano-2-ethoxycarbonylvinyl group, 2-acetyl-2-ethoxycarbonylvinyl group etc.), an aryl group (monocyclic or condensed cyclic aryl group, more preferably an aryl group containing a benzene ring, for example, a phenyl group, a perfluorophenyl group, 3,5-dichlorophenyl group, 2-methanesulfonamidophenyl group, 2-carbamoylphenyl group, 4,5-dicyanophenyl group, 2-hydroxymethylphenyl group, 2,6-dichloro-4-cyanophenyl group, 2-chloro-5-octylsulfamoylphenyl group etc.), a heterocyclic group (5- or 6-membered, saturated or unsaturated, monocyclic or condensed heterocyclic group containing at least one nitrogen, oxygen or sulfur atom, for example, morpholino group, piperidino group (N-substituted), imidazolyl group, indazolyl group, pyrazolyl group, triazolyl group, benzimidazolyl group, tetrazolyl group, pyridyl group, pyridinio group, quinolinio group, quinolyl group, hydantoyl group, imidazolidinyl etc.), an alkoxy group (preferably alkoxy group having 1 to 8 carbon atoms, for example, methoxy group, ethoxy group, 2-hydroxyethoxy group, benzyloxy group, t-butoxy group etc.), an amino group (unsubstituted amino group, an alkylamino group having 1 to 10 carbon atoms, an arylamino group or a saturated or unsaturated heterocyclylamino group (including a nitrogen-containing heterocyclylamino group containing a quaternized nitrogen atom), for example, 2,2,6,6-tetramethylpiperidin-4-ylamino group, propylamino group, 2-hydroxyethylamino group, 3-hydroxypropylamino group, anilino group, o-hydroxyanilino group, 5-benzotriazolylamino group, N-benzyl-3-pyridinioamino group etc.) or the like. The group represented by $R^{10}$ may be substituted with any substituent.

Preferred examples of the group represented by $R^{10}$ is described below. When $R^{20}$ is a phenyl group or an aromatic heterocyclic group and $G^1$ is —CO—, $R^{10}$ is preferably a hydrogen atom, an alkyl group, an alkenyl group, an alkynyl group, an aryl group or a heterocyclic group, more preferably a hydrogen atom, an alkyl group or an aryl group, and most preferably a hydrogen atom or an alkyl group. In the case where $R^{10}$ represents an alkyl group, the substituent the refor is particularly preferably a halogen atom, an alkoxy group, an aryloxy group, an alkylthio group, an arylthio group, hydroxyl group, sulfonamide group, amino group, an acylamino group or carboxy group.

When $R^{20}$ is a substituted methyl group and $G^1$ is —CO—, $R^{10}$ is preferably a hydrogen atom, an alkyl group, an aryl group, a heterocyclic group, an alkoxy group or an amino group (e.g., unsubstituted amino group, alkylamino group, arylamino group, heterocyclylamino group), more preferably a hydrogen atom, an alkyl group, an aryl group, a heterocyclic group, an alkoxy group, an alkylamino group, an arylamino group or a heterocyclylamino group. When $G^1$ is —COCO—, $R^{10}$ is preferably, irrespective of $R^{20}$, an alkoxy group, an aryloxy group or an amino group, more preferably a substituted amino group, specifically, an alkylamino group, an arylamino group or a saturated or unsaturated heterocyclylamino group.

When $G^1$ is —$SO_2$—, $R^{10}$ is preferably, irrespective of $R^{20}$, an alkyl group, an aryl group or a substituted amino group.

In the formula (H), $G^1$ is preferably —CO— or —COCO—, more preferably —CO—.

In the formula (H), $A^1$ and $A^2$ each represents a hydrogen atom, an alkyl- or arylsulfonyl group having 20 or less carbon atoms (preferably aphenylsulfonyl group or a phenylsulfonyl group substituted in such a way that the sum of Hammett's substituent constants is −0.5 or more), an acyl group having 20 or less carbon atoms (preferably benzoyl group, a benzoyl group substituted in such a way that the sum of Hammett's substituent constants is −0.5 or more), or a linear, branched or cyclic, substituted or unsubstituted aliphatic acyl group.

$A^1$ and $A^2$ each is most preferably a hydrogen atom.

In the formula (H), $m^1$ represents 1 or 0. When $m^1$ is 0, $R^{10}$ is an aliphatic group, an aromatic group or a heterocyclic group, preferably a phenyl group, a substituted alkyl group having 1 to 3 carbon atoms or an alkenyl group, and these phenyl group and substituted alkyl group having 1 to 3 carbon atoms have the same preferred ranges as described above for $R^{20}$. When $R^{10}$ is an alkenyl group, $R^{10}$ is preferably vinyl group, and particularly preferred is a vinyl group having one or two substituents selected from cyano group, an acyl group, an alkoxycarbonyl group, nitro group, trifluoromethyl group carbamoyl group and the like. Specific examples thereof are 2,2-di cyanovinyl group, 2-cyano-2-methoxycarbonylvinyl group, 2-cyano-2-ethoxycarbonylvinyl group, 2-acetyl-2-ethoxycarbonylvinyl group and so forth.

$m^1$ is preferably 1.

In the formula (H), $R^{10}$ may be one which cleaves the $G^1$–$R^{10}$ moiety from the residual molecule and causes a cyclization reaction to form a cyclic structure containing the atoms in the $G^1$–$R^{10}$ moiety. Into the hydrazine derivatives represented by the formula (H), an adsorptive group capable of adsorbing to silver halide may be integrated. In the formula (H), $R^{10}$ or $R^{20}$ may be one into which a ballast group or polymer commonly used in immobile photographic additives such as a coupler may be integrated. In the formula (H), $R^{10}$ or $R^{20}$ may contain a plurality of hydrazino groups as substituents. In this case, the compound represented by the formula (H) is a multi-mer with respect to the hydrazino group. In the formula (H), $R^{10}$ or $R^{20}$ may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclyl)thio group, or a dissociative group capable of dissociation by a base (e.g., carboxy group, sulfo group, acylsulfamoyl group, carbamoylsulfamoyl group etc.). Examples of the compounds containing such a group include the compounds described in JP-A-63-29751, U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, JP-A-63-234246, JP-A-2-285344, JP-A-1-100530, JP-A-64-86134, JP-A-4-16938, JP-A-5-197091, WO95/32452, WO95/32453, JP-A-9-235264, JP-A-9-235265, JP-A-9-235266, JP-A-9-235267, JP-A-9-179229, JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Specific examples of the compound represented by the formula (H) are shown below. However, the present invention is by not limited to those compounds.

| Y—NHNH—X | | | |
|---|---|---|---|
| | X = | | |
| Y = | —CHO | —$COCH_2OH$ | —$COCH_2NHSO_2CH_3$ |
| 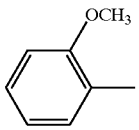 | 1a | 1b | 1c |

-continued
| Y—NHNH—X | | | |
|---|---|---|---|
| 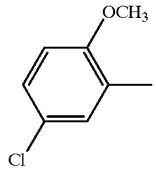 | 2a | 2b | 2c |
| 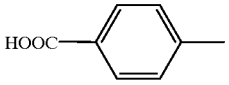 | 3a | 3b | 3c |
| 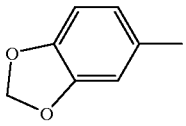 | 4a | 4b | 4c |
| 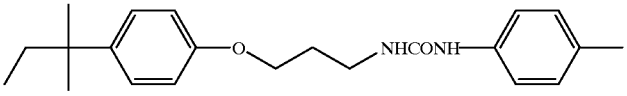 | 5a | 5b | 5c |
| | X = | |
|---|---|---|
| Y = | 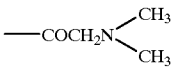 | 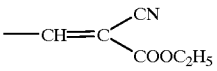 |
| 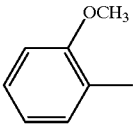 | 1d | 1e |
| 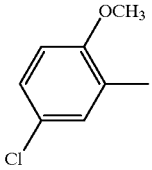 | 2d | 2e |
| 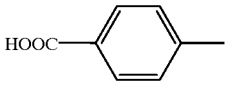 | 3d | 3e |
| 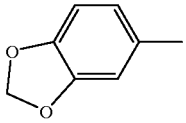 | 4d | 4e |
| 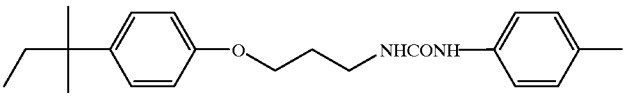 | 5d | 5e |

-continued

| Y—NHNH—X | | |
|---|---|---|
| | X = | |
| Y = | —COCH$_2$N$^{\oplus}$ (Cl$^{\ominus}$) | —COCOO—C(CH$_3$)$_3$ |
| | 6a | 6b |
| | 7a | 7b |
| | 8a | 8b |
| | 9a | 9b |
| | 10a | 10b |

| | | | |
|---|---|---|---|
| | X = | | |
| Y = | —COCONH— | —COCHF$_2$ | —COC$_2$F$_4$COOK |
| | 6c | 6d | 6e |
| | 7c | 7d | 7e |

-continued
| Y—NHNH—X | | | |
|---|---|---|---|
| 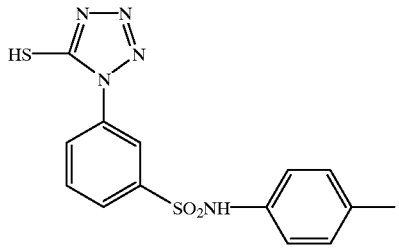 | 8c | 8d | 8e |
| 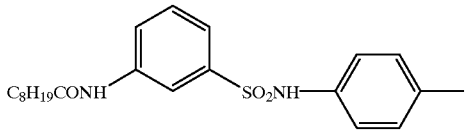 | 9c | 9d | 9e |
| 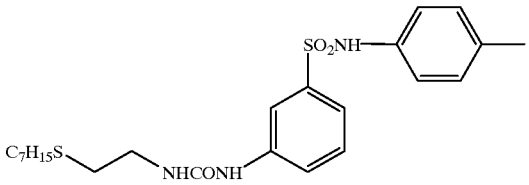 | 10c | 10d | 10e |
11
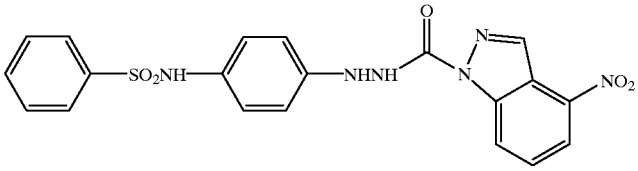
12
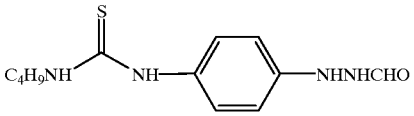
13
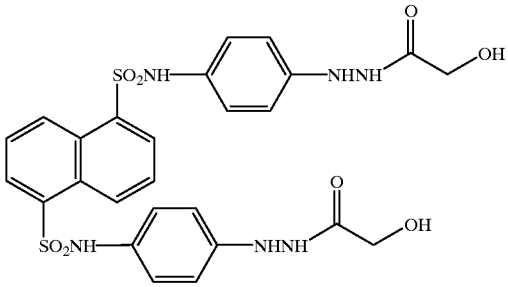
14
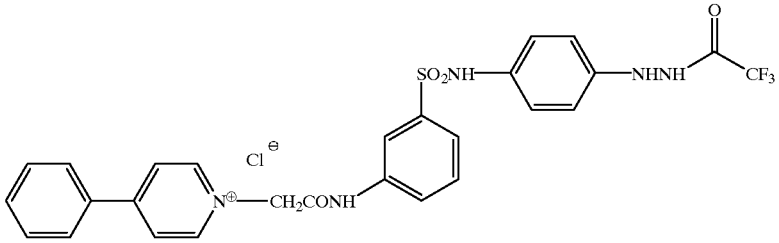

-continued
| Y—NHNH—X |
|---|
| 15 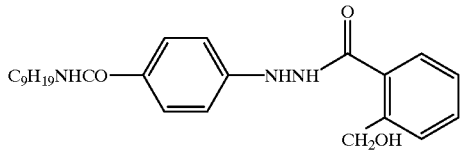 |
| 16 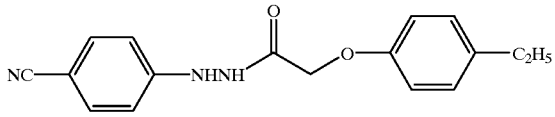 |
| 17 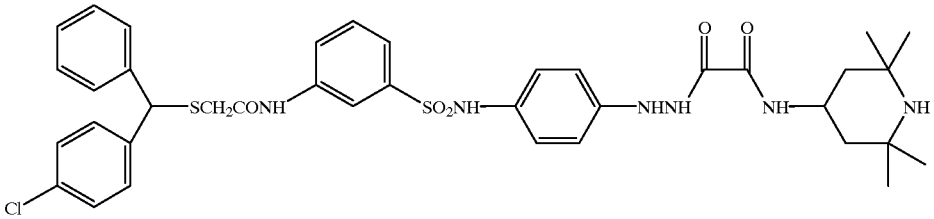 |
| 18 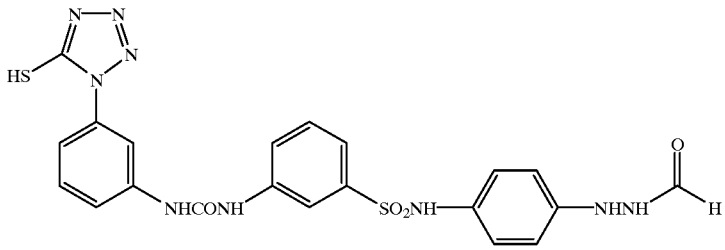 |
| 19 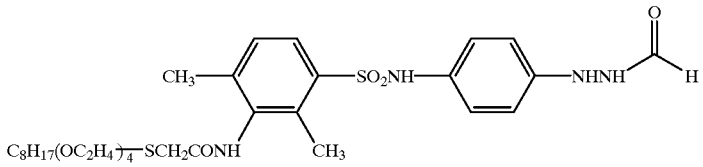 |
| 20 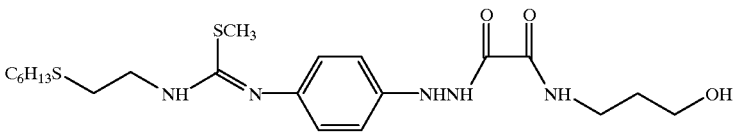 |
| 21 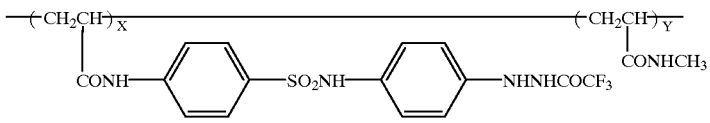 X:Y = 3.97 (mol ratio)<br>average molecular weight 100,000 |

-continued

| Y—NHNH—X |
|---|
| 22 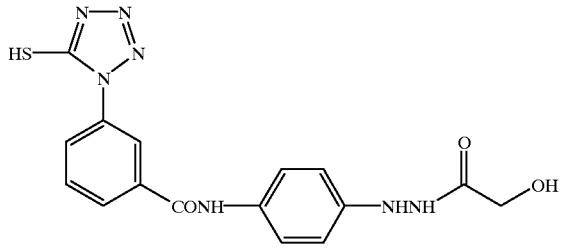 |
| 23 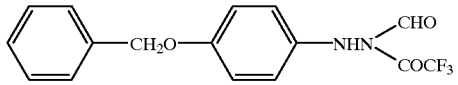 |
| 24 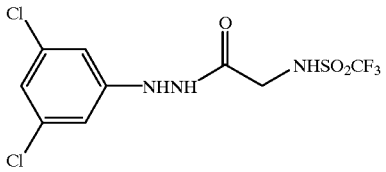 |
| 25 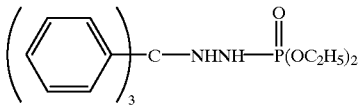 |

Furthermore, in the present invention, the hydrazine derivatives disclosed in JP-A-10-339932, JP-A-11-100472 and JP-A-161270 may be used in combination. In addition, the following hydrazine derivatives may also be used in combination: the compounds represented by (Chem. 1) of JP-B-6-77138, specifically, compounds described at pages 3 and 4 of the publication; the compounds represented by the formula (I) of JP-B-6-93082, specifically, Compounds 1 to 38 described at pages 8 to 18 of the publication; the compounds represented by the formulas (4), (5) and (6) of JP-A-6-230497, specifically, Compounds 4-1 to 4-10 described at pages 25 and 26, Compounds 5-1 to 5-42 described at pages 28 to 36 and Compounds 6-1 to 6-7 described at pages 39 and 40 of the publication; the compounds represented by the formulas (1) and (2) of JP-A-6-289520, specifically, Compounds 1-1) to 1-17) and 2-1) described at pages 5 to 7 of the publication; the compounds represented by (Chem. 2) and (Chem. 3) of JP-A-6-313936, specifically, compounds described at pages 6 to 19 of the publication; the compound represented by (Chem. 1) of JP-A-6-313951, specifically, the compounds described at pages 3 to 5 of the publication; the compound represented by the formula (I) of JP-A-7-5610, specifically, Compounds I-1 to I-38 described at pages 5 to 10 of the publication; the compounds represented by the formula (II) of JP-A-7-77783, specifically, Compounds II-1 to II-102 described at pages 10 to 27 of the publication; the compounds represented by the formulas (H) and (Ha) of JP-A-7-104426, specifically, Compounds H-1 to H-44 described at pages 8 to 15 of the publication; the compounds characterized by having in the vicinity of the hydrazine group an anionic group or a nonionic group capable of forming an intramolecular hydrogen bond with a hydrogen atom of hydrazine, described in EP713131A and JP-A-9-022082, particularly, the compounds represented by the formulas (A), (B), (C), (D), (E) and (F), specifically, Compounds N-1 to N-30 described in the publication; the compound represented by the formula (1) described in EP713131A and JP-A-9-22082, specifically, Compounds D-1 to D-55 described in the publications; various hydrazine derivatives described at pages 25 to 34 of Kochi Gijutsu (Known Techniques), pages 1 to 207, Aztech (issued on Mar. 22, 1991); and Compounds D-2 and D-39 described in JP-A-62-86354 (pages 6 and 7).

The hydrazine derivatives used in the present invention can be used alone or in any combination of two or more kinds of them. Other than those described above, the following hydrazine derivatives can also be used (they can also be used in combination as the case maybe). The hydrazine derivatives used for the present invention can be synthe sized by various methods described in the following patent documents.

That is, there can be mentioned all of the hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and European Patent 741320A.

These hydrazine derivatives for use in the present invention may be used after being dissolved in an appropriate organic solvent such an alcohol (e.g., methanol, ethanol, propanol, fluorinated alcohol), ketone (e.g., acetone, methyl ethyl ketone), dimethylformamide, dimethyl sulfoxide or methyl cellosolve.

The compounds may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compounds may be used after dispersion of a powder in an appropriate solvent such as water by using a ball mill, a colloid mill, or by means of ultrasonic wave according to a known method for solid dispersion.

The hydrazine derivatives may be added to any layers on a support provided on the side of the image-forming layer, i.e., the image-forming layer or other layers provided on the same side. The hydrazine compounds are preferably added to the image-forming layer or a layer adjacent thereto.

The amount of the hydrazine derivatives is preferably from $1\times10^{-6}$ to 1 mol, more preferably from $1\times10^{-5}$ to $5\times10^{-1}$ mol, most preferably from $2\times10^{-5}$ to $2\times10^{-1}$ mol, per mole of silver.

In addition, the acrylonitrile compounds disclosed in U.S. Pat. No. 5,545,515, more specifically the compounds CN-1 to CN-13 disclosed therein and the like may also be used as the nucleating agent.

In the present invention, a contrast accelerator may be used in combination with the above-described nucleating agent for the formation of an ultrahigh contrast image. For example, amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically CN-1-CN-13; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14 may be used.

Method for preparation and addition as well as amounts of the aforementioned contrast accelerators may be applied as those described in the patent publications cited above.

In the present invention, an acid formed by hydration of diphosphorus pentoxide or a salt thereof is preferably used together with the nucleating agent. Examples of the acid formed by hydration of diphosphorus pentoxide or a salt thereof include metaphosphoric acid (salt), pyrophosphoric acid (salt), ortho phosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are ortho phosphoric acid (salt) and hexametaphosphoric acid (salt). Specific examples of the salt are sodium orthophosphate, sodium ortho dihydrogen phosphate, sodium hexametaphosphate, ammonium hexametaphosphate and so forth.

The acid formed by hydration of diphosphorus pentoxide or a salt thereof that can be preferably used for the present invention is added to the image-forming layer or a binder layer adjacent thereto in order to obtain the desired effect with a small amount.

The acid formed by hydration of diphosphorus pentoxide or a salt thereof may be used in a desired amount (coating amount per 1 $m^2$ of the photosensitive material) depending on the desired performance including sensitivity and fog, preferably in an amount of 0.1–500 $mg/m^2$, more preferably 0.5–100 $mg/m^2$.

The silver halide emulsion and/or organic silver salt for use in the present invention can be further prevented from the production of additional fog or can be stabilized against the reduction in sensitivity during the stock storage, by means of an antifoggant, a stabilizer or a stabilizer precursor. Examples of antifoggants, stabilizers and stabilizer precursors which can be appropriately used alone or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechol described in U.S. Pat. No. 3,235,652, oximes, nitrons and nitroindazoles described in British Patent No. 623,448, polyvalent metal salts described in U.S. Pat. No. 2,839,405, thiuroniumsalts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, and phosphorus compounds described in U.S. Pat. No. 4,411,985.

Antifoggants which are preferably used in the present invention are organic halides other than the compounds of the formula (1), and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, Japanese Patent Application No. 10-292863, U.S. Pat. Nos. 5,340,712, 5,369,000 and 5,464,737.

In the present invention, a compound represented by the formula (Z) is preferably used as an antifoggant.

The compound represented by the formula (Z) is explained in detail.

In the formula (Z), M represents a hydrogen atom or a k-valent cation (for example, a metal ion such as sodium ion, potassium ion, calcium ion, barium ion and zinc ion, an ammonium ion such as tetramethylammonium ion and tetrabutylammonium ion). As indicated by the exemplified ions, k is an integer of 1 or higher number, and usually 1 or 2. When M is a hydrogen atom, k is 1.

In the formula (Z), R represents a substituent. Examples of the substituent include, for example, a linear, branched or cyclic alkyl group having preferably 1–20, more preferably 1–12, particularly preferably 1–8 carbon atoms (for example, methyl, ethyl, iso-propyl, t-butyl, n-octyl, 1,1,3,3-tetramethylbutyl, t-amyl, cyclohexyl etc.), an alkenyl group having preferably 2–20, more preferably 2–12, particularly preferably 2–8 carbon atoms (for example, vinyl, allyl, 2-butenyl, 3-pentenyl etc.), an alkynyl group having preferably 2–20, more preferably 2–12, particularly preferably 2–8 carbon atoms (for example, propargyl, 3-pentynyl etc.), an aralkyl group having preferably 7–30, more preferably 7–20, particularly preferably 7–16 carbon atoms (for example, benzyl, á-methylbenzyl, á-ethylbenzyl, diphenylmethyl, naphthylmethyl, naphthylphenylmethyl etc.), an aryl group having preferably 6–30, more preferably 6–20, particularly preferably 6–12 carbon atoms (for example, phenyl, p-methylphenyl, naphthyl etc.), an amino group having preferably 0–20, more preferably 0–10, particularly preferably 0–6 carbon atoms (for example, amino, methylamino, dimethylamino, diethylamino, dibenzylamino etc.), an alkoxy group having preferably 1–20, more preferably 1–12, particularly preferably 1–8 carbon atoms (for example, methoxy, ethoxy, butoxy etc.), an aryloxy group having preferably 6–20, more preferably 6–16, particularly preferably 6–12 carbon atoms (for example, phenyloxy, 2-naphthyloxy etc.), an acyl group having preferably 1–20, more preferably 1–16, particularly preferably 1–12 carbon atoms (for example, acetyl, benzoyl, formyl, pivaloyl etc.), an alkoxycarbonyl group having preferably 2–20, more preferably 2–16, particularly preferably 2–12 carbon atoms (for example, methoxycarbonyl, ethoxycarbonyl etc.), an aryloxycarbonyl group having preferably 7–20, more preferably 7–16, particularly preferably 7–10 carbon atoms (for example, phenoxycarbonyl etc.), an acyloxy group having preferably 1–20, more preferably 2–16, particularly preferably 2–10 carbon atoms (for example, acetoxy, benzoyloxy etc.), an acylamino group having preferably 1–20, more preferably 2–16, particularly preferably 2–10 carbon atoms (for example, acetylamino, benzoylamino etc.), an alkoxycarbonylamino group having preferably 2–20, more preferably 2–16, particularly preferably 2–12 carbon atoms (for example, methoxycarbonylamino etc.), an aryloxycarbonylamino group having preferably 7–20, more preferably 7–16, particularly preferably 7–12 carbon atoms (for example, phenyloxycarbonylamino etc.), a sulfonylamino group having preferably 1–20, more preferably 1–16, particularly preferably 1–12 carbon atoms (for example, methanesulfonylamino, benzenesulfonylamino etc.), a sulfamoyl group having preferably 0–20, more preferably 0–16, particularly preferably 0–12 carbon atoms (for example, sulfamoyl, methylsulfamoyl, dimethylsulfamoyl, phenylsulfamoyl etc.), a carbamoyl group having preferably 0–20, more preferably 0–16, particularly preferably 0–12 carbon atoms (for example, carbamoyl, diethylcarbamoyl, phenylcarbamoyl etc.), a ureido group having preferably 1–20, more preferably 1–16, particularly preferably 1–12 carbon atoms (for example, ureido, methylureido, phenylureido etc.), an alkylthio group having preferably 1–20, more preferably 1–16, particularly preferably 1–12 carbonatoms (for example, methylthio, ethylthio etc.), an arylthio group having preferably 6–20, more preferably 6–16, particularly preferably 6–12 carbon atoms (for example, phenylthio etc.), a sulfonyl group having preferably 1–20, more preferably 1–16, particularly preferably 1–12 carbon atoms (for example, mesyl, tosyl etc.), a sulfinyl group having preferably 1–20, more preferably 1–16, particularly preferably 1–12 carbon atoms (for example, methanesulfinyl, benzenesulfinyl etc.), a phosphor amide group having preferably 1–20, more preferably 1–16, particularly preferably 1–12 carbon atoms (for example, diethylphosphoramide, phenylphosphoramide etc.), hydroxyl group, mercapto group, a halogen atom (for example, fluorine atom, chlorine atom, bromine atom, iodine atom), cyano group, sulfo group, carboxy group, nitro group, hydroxamic group, sulfino group, hydrazino group, sulfonylthio group, thiosulfonyl group, a heterocyclic group (for example, imidazolyl, pyridyl, furyl, piperidyl, morpholyl etc.), disulfide group and so forth.

These substituents may further be substituted, and if it is a group that can form a salt, it may be form a salt. m is an integer of 1 to 4. When two or more substituents are present, i.e., m is 2 or higher integer, they may be the same or different. m is preferably 1–3, most preferably 2.

Further, those substituents may be bonded together to form a 5- to 7-membered non-aromatic or aromatic ring (for example, benzenering). Further more, these rings may be substituted with other substituents (for example, a halogen atom, carboxy group).

The substituent represented by R is preferably an alkyl group, an alkenyl group, an alkynyl group, an aralkyl group, an aryl group, an amino group, an alkoxy group, an acyl group, an alkoxycarbonyl group, an acyloxy group, an acylamino group, analkoxycarbonylamino group, asulfonylamino group, a sulfamoyl group, a carbamoyl group, a ureido group, an alkylthio group, a sulfonyl group, hydroxyl group, mercapto group, a halogen atom, cyano group, sulfo group, carboxy group, nitro group, or a heterocyclic group, further preferably an alkyl group, an alkenyl group, an aralkyl group, an amino group, an alkoxy group, an alkylthio group, hydroxyl group, mercapto group, a halogen atom, sulfo group, or carboxy group.

Furthermore, in the formula (Z), it is particularly preferred that an alkyl group (including an aralkyl group) is present at o-position and/or p-position with respect to the hydroxyl group.

A bisphenol structure where the compounds of the formula (z) are bonded via one carbon atom is also preferred.

Specific examples of the antifoggant of the formula (Z) are shown below. However, the antifoggant of the formula (Z) used for the present invention is not limited to these.

(A-1)

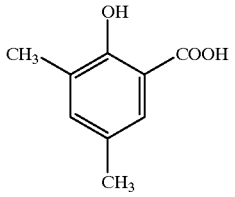

(A-2)

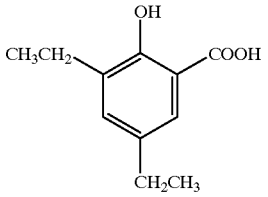

(A-3)

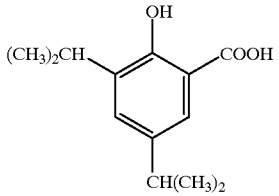

(A-4)

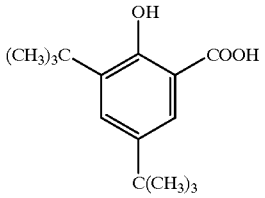

(A-5)

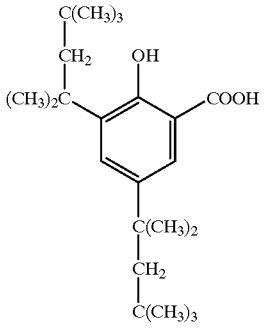

-continued
(A-6)
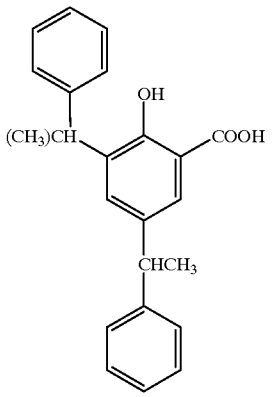
(A-7)
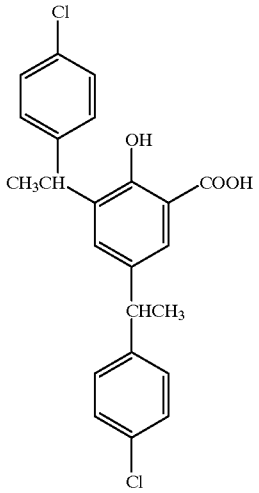
(A-8)
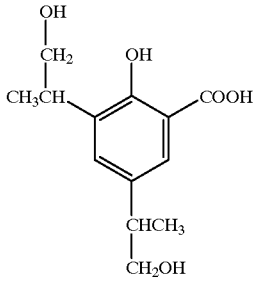
(A-9)
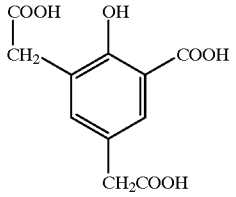
(A-10)
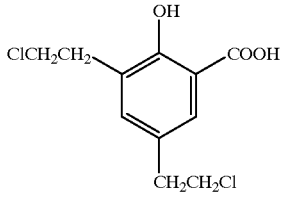
-continued
(A-11)
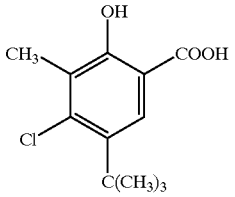
(A-12)
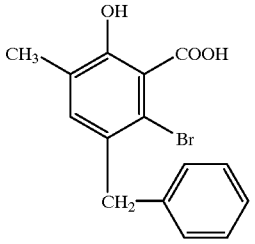
(A-13)
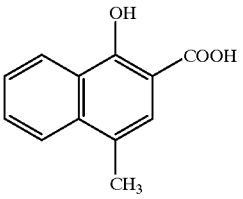
(A-14)
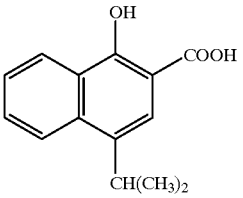
(A-15)
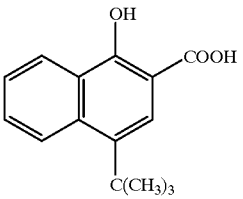
(A-16)
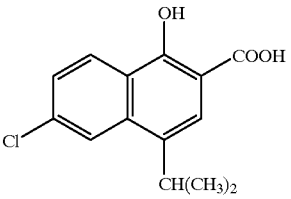
(A-17)
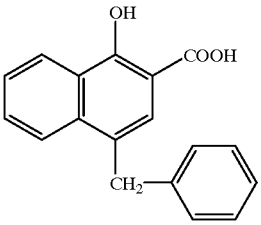

-continued
(A-18)
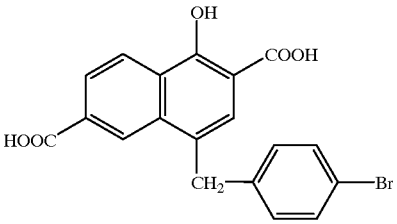
(A-19)
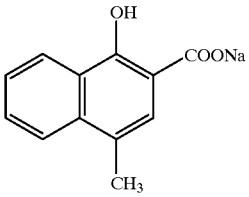
(A-20)
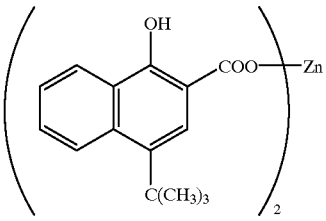
(A-21)
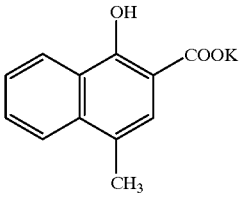
(A-22)
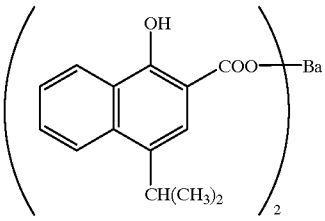
(A-23)
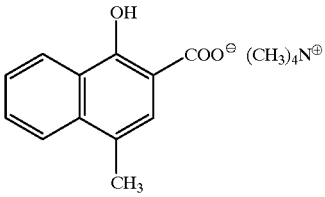
(A-24)
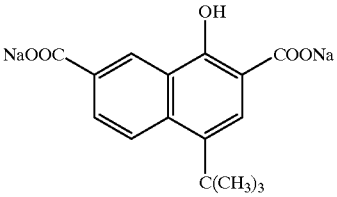
-continued
(A-25)
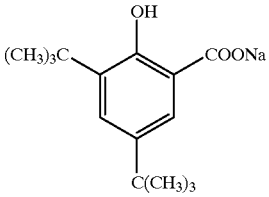
(A-26)
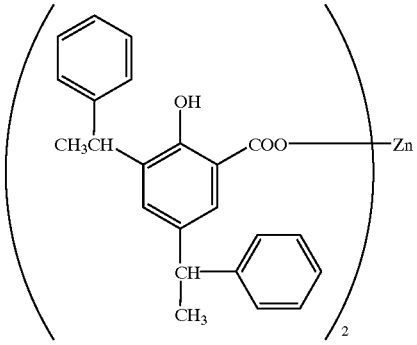
(A-27)
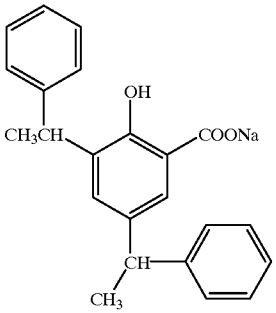
(A-28)
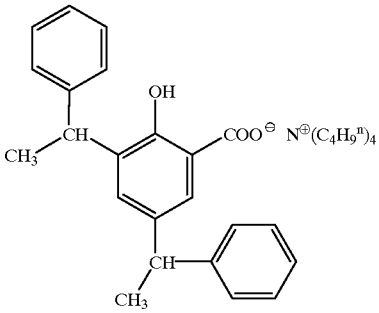
(A-29)
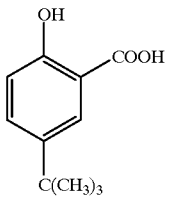
(A-30)
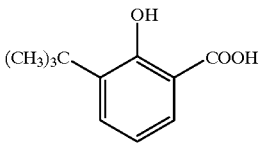

-continued
(A-31)
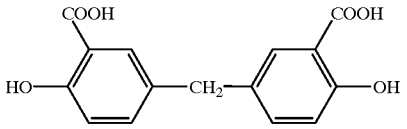
(A-32)
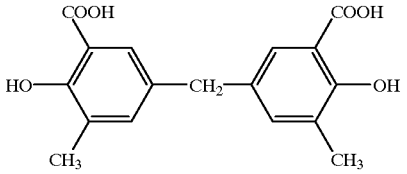
(A-33)
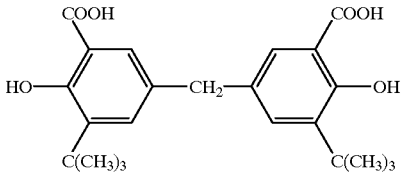
(A-34)
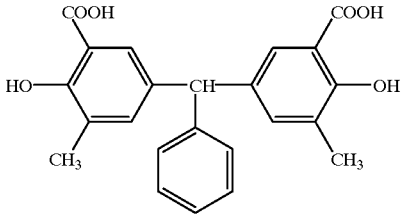
(A-35)
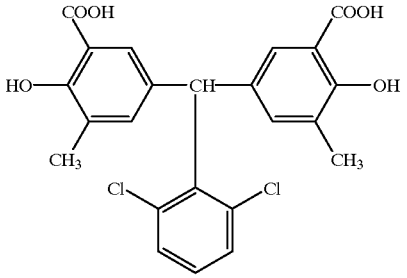
(A-36)
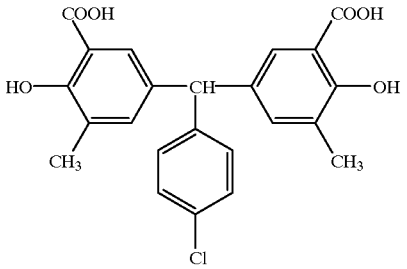
(A-37)
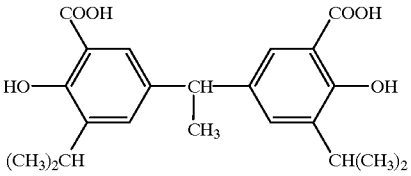
-continued
(A-38)
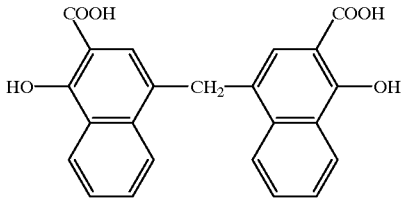
(A-39)
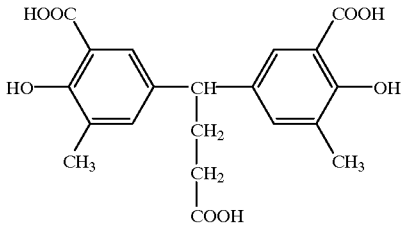
(A-40)
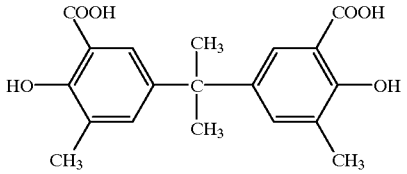
(A-41)
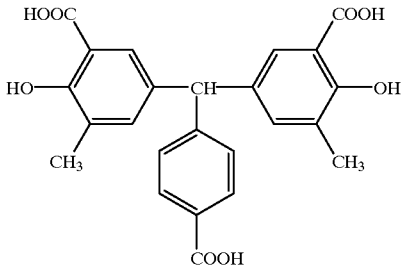
(A-42)
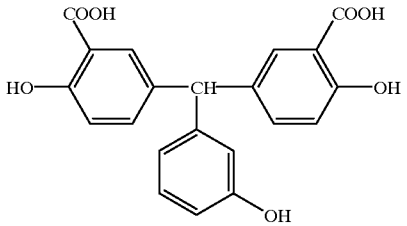
(A-43)
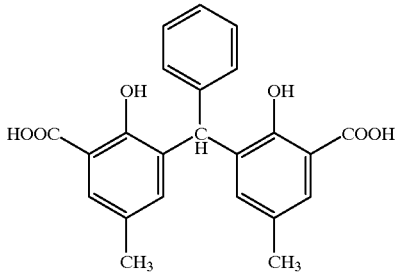

-continued
(A-44)
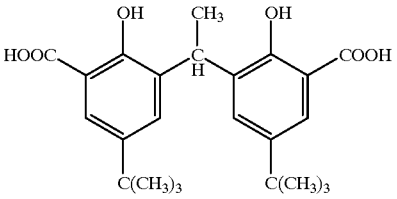
(A-45)
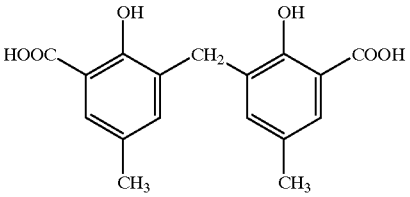
(A-46)
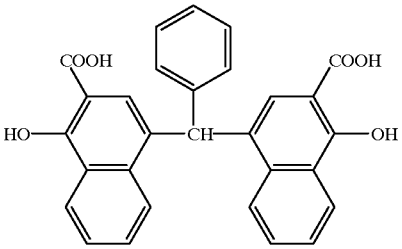
(A-47)
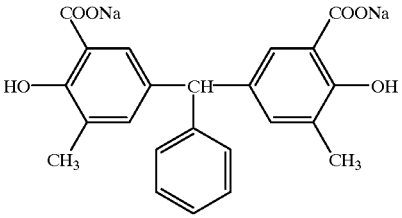
(A-48)
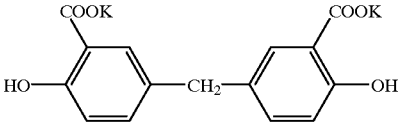
(A-49)
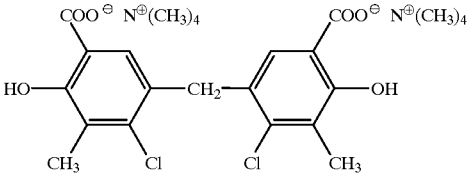
(A-50)
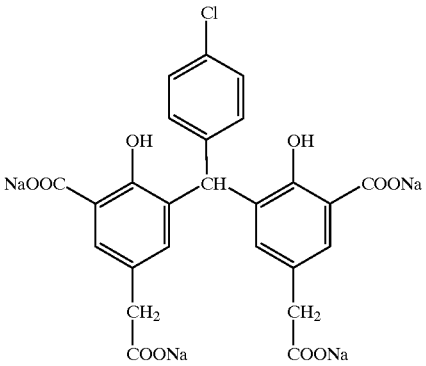
-continued
(A-51)
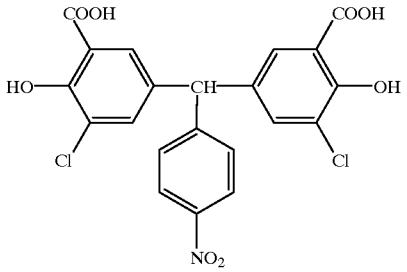
(A-52)
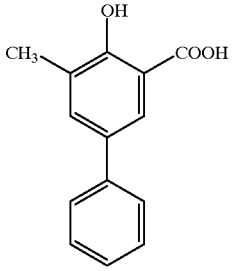
(A-53)
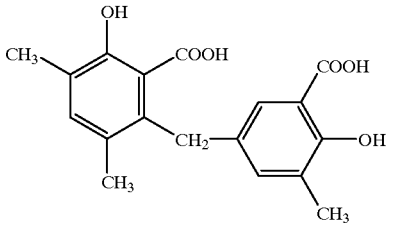
(A-54)
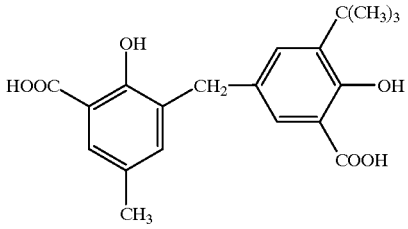
(A-55)
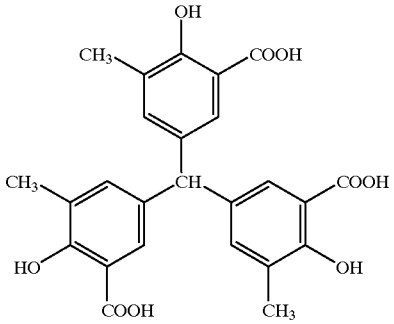
(A-56)
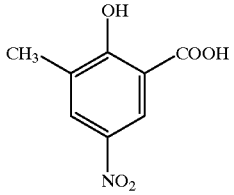

-continued (A-57)

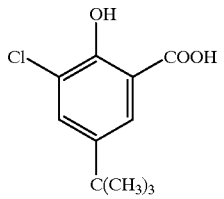

(A-58)

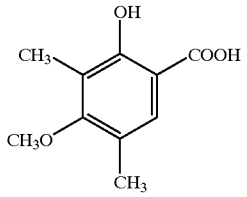

(A-59)

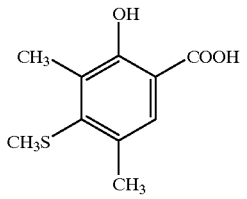

(A-60)

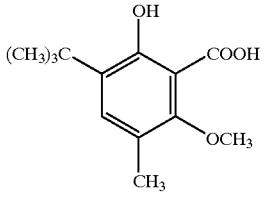

As the antifoggant of the formula (Z), commercially available substances may be used, or they can be easily synthe sized by, for example, the method disclosed in JP-A-2–251838, the acid catalyzed condensation reaction of salicylic acid and a carbonyl compound as described in J. Med. Chem., 34, 342 (1991) and so forth.

The antifoggant represented by the formula (Z) used for the present invention may be used after being dissolved in water or an appropriate organic solvent such as alcohol (e.g., methanol, ethanol, propanol, fluorinated alcohol), ketone (e.g., acetone, methyl ethyl ketone), dimethylformamide, dimethyl sulfoxide or methyl cellosolve.

It may also be used as a nemulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, it may be used after dispersion of a powder in water by using a ball mill, a colloid mill, a sand grinder mil, MANTON GAULIN, a microfluidizer, or by means of ultrasonic wave according to a known method for solid dispersion.

The antifoggant represented by the formulas (Z) used for the present invention may be added to any layers on a support provided on the side of the image-forming layer, i.e., the image-forming layer or other layers provided on the same side. However, the compound may preferably be added to the image-forming layer or a layer adjacent thereto. The image-forming layer is a layer containing the reducible silver salt (organic acid silver salt), and it is a photosensitive layer containing photosensitive silver halide as described above.

The antifoggant represented by the formula (Z) is added in an amount of, when expressed as mole amount per 1 mole of silver (mol/mol Ag), preferably $1\times10^{-5}$ to $5\times10^{-1}$ mol/mol Ag, more preferably $5\times10^{-5}$ to $1\times10^{-1}$ mol/mol Ag, further preferably $1\times10^{-4}$ to $5\times1^{-2}$ mol/mol Ag. The antifoggant may be used as one kind of compound, or may be used as a combination of two or more kinds of compounds.

The antifoggant for use in the present invention may be added in any form of a solution, a powder and a solid fine grain dispersion. Thesolidfinegraindispersion is performed using a known pulverization means (e.g., ball mill, vibration ball mill, sand mill, colloid mill, jet mill, roller mill etc.). In the solid fine grain dispersion, a dispersion aid may also be used.

As the antifoggant used for the present invention, the compounds of the formula (S) disclosed in Japanese Patent Application No. 11-23995 are also preferably used.

These cyclic compounds are known in the art as agent for preventing deterioration of photographic performance by formaldehyde gas. Itwas quite interesting and unexpectedthat such compounds should exhibit marked effect on prevention of fog and sensitivity fluctuation during storage in heat-developable photosensitive materials, in particular, those utilizing the nucleating agents described below. Specific examples of this class of compounds are included in the compounds disclosed in JP-A-61-73150, JP-A-58-10738, JP-A-50-87028 and so forth.

Although not necessary for practicing the present invention, it is advantageous in some cases to add a mercury (II) salt as an antifoggant to the emulsion layer (image-forming layer). Preferredmercury(II) saltstothispurposearemercury acetate and mercury bromide. The addition amount of mercury for use in the present invention is preferably from $1\times10^{-9}$ to $1\times10^{-3}$ mol, more preferably from $1\times10^{-8}$ to $1\times10^{-4}$ mol, per mol of silver coated.

The heat-developable photosensitive material of the present invention may contain a benzoic acid for the purpose of achieving high sensitivity or preventing fog. The benzoic acid for use in the present invention may be any benzoic acid derivatives but preferred examples of the structure include the compounds described in U.S. Pat. Nos. 4,784,939 and 4,152,160 JP-A-9-329863, JP-A-9-329864, JP-A-9-329865, JP-A-9-281637 and so forth. The benzoic acid for use in the present invention may be added to any site of the light-sensitive material but the layer to which the benzoic acid is added is preferably a layer on the side having the photosensitive layer, more preferably an organic silver salt-containing layer. The benzoic acid for use in the present invention may be added at any stage during the preparation of the coating solution. In the case of adding the benzoic acid to an organic silver salt-containing layer, it may be added at any stage from the preparation of the organic silver salt until the preparation of the coating solution but is preferably added in the period after the preparation of the organic silver salt and immediately before the coating. The benzoic acid for use in the present invention may be added in any form of a powder, a solution and a fine particle dispersion, or may be added as a solution containing a mixture of the benzoic acid with other additives such as a sensitizing dye, a reducing agent and a color tone adjustor. The benzoic acid for use in the present invention may be added in any amount. The addition amount thereof is preferably from $1\times10^{-6}$ to 2 mol, more preferably from $1\times10^{-3}$ to 0.5 mol, per mol of silver.

The compound represented by the formula (5), which is preferably used in the present invention, will be explained in detail hereafter.

In the formula (5), $Z^{11}$ represents an aliphatic hydrocarbon group, an aryl group or a heterocyclic group, and M represents a cation.

The aliphatic hydrocarbon group represented by $Z^{11}$ in formula (5) may be a linear, branched or cyclicalkyl group having preferably 1 to 20 carbon atoms, more preferably 1 to 12 carbon atoms, particularly preferably 1 to 8 carbon atoms, such as methyl, ethyl, n-propyl, iso-propyl, n-butyl, iso-butyl, sec-butyl, tert-butyl, n-octyl, n-amyl, iso-amyl, tert-amyl, hexyl, dodecyl, octadecyl and cyclohexyl, an alkenyl group having preferably 2 to 20 carbon atoms, more preferably 2 to 12 carbon atoms, particularly preferably 2 to 8 carbon atoms, such as vinyl, allyl, 2-butenyl, and 3-pentenyl, and an alkynyl group having preferably 2 to 20 carbon atoms, more preferably 2 to 12 carbon atoms, particularly preferably 2 to 8 carbon atoms, such as propargyl and 3-pentynyl, which may have a substituent.

Exemplary substituents include an aryl group having preferably 6 to 30 carbon atoms, more preferably 6 to 20 carbon atoms, particularly preferably 6 to 12 carbon atoms, for example, phenyl, p-methylphenyl and naphthyl; an amino group having preferably 0 to 20 carbon atoms, more preferably 0 to 10 carbon atoms, particularly preferably 0 to 6 carbon atoms, for example, amino, methylamino, dimethylamino, diethylamino and dibenzylamino; an alkoxy group having preferably 1 to 20 carbon atoms, more preferably 1 to 12 carbon atoms, particularly preferably 1 to 8 carbon atoms, for example, methoxy, ethoxy, and butoxy; an aryloxy group having preferably 6 to 20 carbon atoms, more preferably 6 to 16 carbon atoms, particularly preferably 6 to 12 carbon atoms, for example, phenyloxy and 2-naphthyloxy; an acyl group having preferably 1 to 20 carbon atoms, more preferably 1 to 16 carbon atoms, particularly preferably 1 to 12 carbon atoms, for example, acetyl, benzoyl, formyl and pivaloyl; an alkoxycarbonyl group having preferably 2 to 20 carbon atoms, more preferably 2 to 16 carbon atoms, particularly preferably 2 to 12 carbon atoms, for example, methoxycarbonyl and ethoxycarbonyl; an aryloxycarbonyl group, having preferably 7 to 20 carbon atoms, more preferably 7 to 16 carbon atoms, particularly preferably 7 to 10 carbon atoms, for example, phenoxycarbonyl; an acyloxy group having preferably 1 to 20 carbon atoms, more preferably 2 to 16 carbon atoms, particularly preferably 2 to 10 carbon atoms, for example, acetoxy and benzoyloxy; an acylamino group having preferably 1 to 20 carbon atoms, more preferably 2 to 16 carbon atoms, particularly preferably 2 to 10 carbon atoms, for example, acetylamino, valerylamino and benzoylamino; an alkoxycarbonylamino group having preferably 2 to 20 carbon atoms, more preferably 2 to 16 carbon atoms, particularly preferably 2 to 12 carbon atoms, for example, methoxycarbonylamino; an aryloxycarbonylamino group having preferably 7 to 20 carbon atoms, more preferably 7 to 16 carbon atoms, particularly preferably 7 to 12 carbon atoms, for example, phenyloxycarbonylamino; a sulfonylamino group having preferably 1 to 20 carbon atoms, more preferably 1 to 16 carbon atoms, particularly preferably 1 to 12 carbon atoms, for example, methanesulfonylamino and benzenesulfonylamino; a sulfamoyl group having preferably 0 to 20 carbon atoms, more preferably 0 to 16 carbon atoms, particularly preferably 0 to 12 carbon atoms, for example, sulfamoyl, methylsulfamoyl, dimethylsulfamoyl and phenylsulfamoyl; a carbamoyl group, having preferably 0 to 20 carbon atoms, more preferably 0 to 16 carbon atoms, particularly preferably 0 to 12 carbon atoms, for example, carbamoyl, diethylcarbamoyl and phenylcarbamoyl; a ureido group having preferably 1 to 20 carbon atoms, more preferably 1 to 16 carbon atoms, particularly preferably 1 to 12 carbon atoms, for example, ureido, methylureido and phenylureido; an alkylthio group having preferably 1 to 20 carbon atoms, more preferably 1 to 16 carbon atoms, particularly preferably 1 to 12 carbon atoms, for example, methylthio and ethylthio; an arylthio group having preferably 6 to 20 carbon atoms, more preferably 6 to 16 carbon atoms, particularly preferably 6 to 12 carbon atoms, for example, phenylthio; a sulfonyl group having preferably 1 to 20 carbon atoms, more preferably 1 to 16 carbon atoms, particularly preferably 1 to 12 carbon atoms, for example, mesyl and tosyl; a sulfinyl group having preferably 1 to 20 carbon atoms, more preferably 1 to 16 carbon atoms, particularly preferably 1 to 12 carbon atoms, for example, methanesulfinyl and benzenesulfinyl; a phosphor amide group having preferably 1 to 20 carbon atoms, more preferably 1 to 16 carbon atoms, particularly preferably 1 to 12 carbon atoms, for example, diethylphosphoramide and phenylphosphoramide; hydroxyl group; mercapto group; a halogen atom such as fluorine, chlorine, bromine and iodine atoms; cyano group; sulfo group; carboxy group; nitro group; hydroxamic group; sulf ino group; hydrazino groups; sulfonylthio group; thiosulfonyl group; a heterocyclic groupsuchas imidazolyl, pyridyl, furyl, piperidyl, morpholinyl and morpholino; and disulfide group and so forth. These substituents may be further substituted. Where there are two or more substituents, they may be identical or different. Among the foregoing groups, a group that can form a salt may form a salt.

Preferred substituents on the aliphatic hydrocarbon group represented by $Z^{11}$ are an aryl group, an alkoxy group, a heterocyclic group, cyano group, anacyl group, an alkoxycarbonyl group, a sulfamoyl group, a carbamoyl group, a sulfonyl group, nitro group, a halogen atom, carboxy group, and amino group. More preferred substituents are an aryl group, a heterocyclic group, cyano group, an alkoxy group, and a sulfonyl group.

The aliphatic hydrocarbon group represented by $Z^{11}$ is preferably an alkyl group, more preferably a chain alkyl group.

The aryl group represented by $Z^{11}$ is preferably a monocyclic or condensed ring aryl group of 6 to 30 carbon atoms, more preferably monocyclic or condensed ring aryl groups of 6 to 20 carbon atoms, for example, phenyl, p-methlphenyl and naphthyl, with the phenyl being especially preferred. The aryl group represented by $Z^{11}$ may have a substituent, examples of which include the above-described substituents on the aliphatic hydrocarbon group represented by $Z^{11}$ as well as a alkyl group having preferably 1 to 20 carbon atoms, more preferably 1 to 12 carbon atoms, particularly preferably 1 to 8 carbon atoms, such as methyl, ethyl, iso-propyl, n-butyl, tert-butyl, n-octyl, tert-amyl, and cyclohexyl, an alkenyl group having preferably 2 to 20 carbon atoms, more preferably 2 to 12 carbon atoms, particularly preferably 2 to 8 carbon atoms, suchas vinyl, allyl, 2-butenyl and 3-pentenyl, an alkynyl group having preferably 2 to 20 carbon atoms, more preferably 2 to 12 carbon atoms, particularly preferably 2 to 8 carbon atoms, such as propargyl and 3-pentynyl, and so forth.

Preferred substituents on the aryl group represented by $Z^{11}$. are an alkyl group, an aryl group, an alkoxy group, an aryloxy group, an acyl group, an alkoxycarbonyl group, an acyloxy group, an acylamino group, an alkoxycarbonylamino group, an aryloxycarbonylamino group, a sulfonylamino group, a sulfamoylamino group, a carbamoylamino group, a ureido group, an alkylthio group, an arylthio group, a sulfonyl group, an alkenyl group, a sulfinyl group, a sulfonylthio group, a thiosulfonyl group, a phosphor amide group, a halogen atom, cyano group, an alkynyl group, a sulfamoyl group, a carbamoyl group, a sulfonyl group, carboxy group, and a heterocyclic group. More preferred substituents are an alkyl group, an alkoxy group, an aryloxy group, an acyl group, an acylamino group, an alkoxycarbonyl group, an aryloxycarbonylamino group, a sulfonylamino group, a carbamoyl group, a ureido group, an alkylthio group, an arylthio group, a sulfonyl group, a sulfinyl group, a phosphor amide group, carboxy group, and a heterocyclic group. Further preferred substituents are an alkyl group, an alkoxy group, an aryloxy group, an acylamino group, a sulfonylamino group, a sulfamoyl group, a carbamoyl group, a ureido group, and carboxy group.

The heterocyclic group represented by $Z^{11}$ is 3- to 10-membered, saturated or unsaturated, heterocyclic group containing at least one atom selected from nitrogen (N), oxygen (O) and sulfur (S). The heterocyclic group may be monocyclic or may form a condensed ring with another or other rings.

Illustrative examples of the heterocyclic group include thienyl, furyl, pyranyl, 2H-pyrrolyl, pyrrolyl, imidazolyl, pyrazolyl, isothiazolyl, isooxazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indolizinyl, isoindolizinyl, 3H-indolyl, indolyl, 1H-indazolyl, purinyl, 4H-quinolizinyl, isoquinolyl, quinolyl, phthalazinyl, naphthyridinyl, quinoxalinyl, quinazolinyl, cinnolinyl, pteridinyl, carbazolyl, 3-carbonylyl, phenanthridinyl, acridinyl, perimidinyl, phenanthrolinyl, phenazinyl, phenarsazinyl, phenothiazinyl, furazanyl, phenoxazinyl, isochromanyl, chromanyl, pyrrolidinyl, pyrrolinyl, imidazolidinyl, imidazolinyl, pyrazolidinyl, pyrazolinyl, piperidyl, piperazinyl, indolinyl, isoindolinyl, quinuclidinyl, morpholinyl, tetrazolyl, benzimidazolyl, benzoxazolyl, benzothiazolyl, benzotriazolyl, triazinyl, uracil, triazopyrimidinyl and so forth.

Preferred heterocyclic groups are pyrrolyl, imidazolyl, pyrazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indolyl, 1H-indazolyl, purinyl, 4H-quinolizinyl, isoquinolyl, quinolyl, phthalazinyl, naphthyridinyl, quinoxalinyl, quinazolinyl, cinnolinyl, pteridinyl, tetrazolyl, benzimidazolyl, benzoxazolyl, benzothiazolyl, benzotriazolyl, triazinyl, uracil, and triazopyrimidinyl.

More preferred heterocyclic groups are imidazolyl, pyrazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indolyl, 1H-indazolyl, purinyl, quinolyl, phthalazinyl, naphthyridinyl, quinoxalinyl, quinazolinyl, cinnolinyl, pteridinyl, tetrazolyl, benzimidazolyl, benzoxazolyl, benzothiazolyl, benzotriazolyl, triazinyl, uracil, and triazopyrimidinyl.

Further preferred heterocyclic groups are imidazolyl, thiazolyl, oxazolyl, 1,2,3-triazolyl, 1,2,4-triazolyl, 1,3,4-oxadiazolyl, 1,3,4-thiadiazolyl, pyridyl, quinolyl, tetrazolyl, benzimidazolyl, benzoxazolyl, benzthiazolyl, benztriazolyl, triazinyl, uracil, and triazopyrimidinyl.

The heterocyclic group represented by $Z^{11}$ may have a substituent, examples of which include the aforementioned substituents on the aliphatic hydrocarbon group represented by $Z^{11}$ as well as an alkyl group having preferably 1 to 20 carbon atoms, more preferably 1 to 12 carbon atoms, particularly preferably 1 to 8 carbon atoms, such as methyl, ethyl, iso-propyl, tert-butyl, n-octyl, tert-amyl, and cyclohexyl, an alkenyl group having preferably 2 to 20 carbon atoms, more preferably 2 to 12 carbon atoms, particularly preferably 2 to 8 carbon atoms, such as vinyl, allyl, 2-butenyl, and 3-pentenyl, and an alkynyl group having preferably 2 to 20 carbon atoms, more preferably 2 to 12 carbon atoms, particularly preferably 2 to 8 carbon atoms, such as propargyl group and 3-pentynyl group.

Preferred substituents on the heterocyclic group represented by $Z^{11}$ are an alkyl group, an aryl group, an alkoxy group, an aryloxy group, an acyl group, an alkoxycarbonyl group, an acyloxy group, an acylamino group, sulfonylamino group, a sulfamoylamino group, a carbamoyl group, a ureido group, an alkylthio group, an arylthio group, a sulfonyl group, a sulfinyl group, a sulfonylthio group, a halogen atom, cyano group, nitro group and a heterocyclic group. More preferred substituents are an alkyl group, an aryl group, an alkoxy group, an acyl group, an alkoxycarbonyl group, an acyloxy group, an acylamino group, a sulfonylamino group, sulfamoyl group, sulfonylthio group, a carbamoyl group, a ureido group, and a heterocyclic group. Further preferred substituents are analkyl group, an aryl group, an alkoxy group, an acyl group, an aryloxy group, an acylamino group, a sulfonylamino group, a sulfamoyl group, a carbamoyl group, a ureido group, a phosphor amide, and a heterocyclic group. Most preferred substituents are an alkyl group, an alkoxy group, an aryloxy group, an acylamino group, a sulfonylamino group, a sulfamoyl group, a sulfonylthio group, a carbamoyl group, a ureido group, and a heterocyclic group.

Z" is preferably a chain alkyl group, or an aryl group (for example, phenyl group).

M represents a cation, for example, hydrogen ion, alkali metal ion (Na, K etc.), substituted or unsubstituted ammonium ion and so forth.

Illustrative examples of the compound of the formula (5) are given below, but are not limited to these examples.

(T-1)

$CH_3SO_2SNa$ (T-2)

$C_2H_5SO_2SNa$ (T-3)

$HOOC—CH_2—CH_2—SO_2SK$ (T-4)

$(n)C_4H_9SO_2SNa$ (T-5)

$NC—CH_2—CH_2—CH_2—SO_2SNa$ (T-6)

$(n)C_8H_{17}SO_2SNa$ (T-7)

$(n)C_{12}H_{25}SO_2SNa$ (T-8)

$Cl—CH_2—(CH_2)_4—SO_2SK$ (T-9)

$(n)C_{18}H_{37}SO_2SNa$ (T-10)

$(n)C_4H_9SO_2SK$ (T-11)

$(n)C_8H_{17}SO_2SK$

-continued
(T-12)
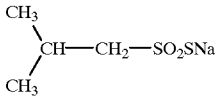
(T-13)
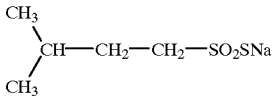
(T-14)
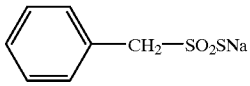
(T-15)
$(n)C_8H_{17}SO_2S^-$ $(n)(C_4H_9)_4N^+$
(T-16)
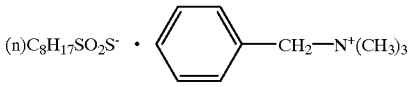
(T-17)
$H_2N—CH_2—CH_2—SO_2SH$
(T-18)
$CH_3O—CH_2—CH_2—SO_2SNa$
(T-19)
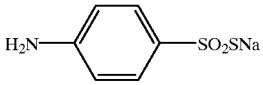
(T-20)
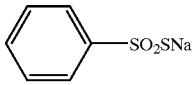
(T-21)
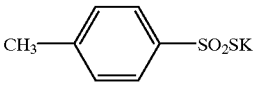
(T-22)
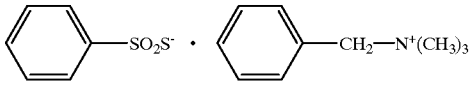
(T-23)
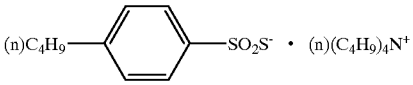
(T-24)
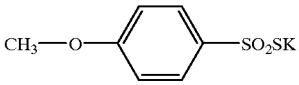
(T-25)
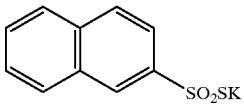
-continued
(T-26)
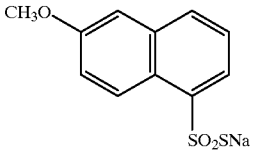
(T-27)
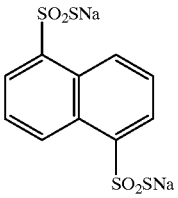
(T-28)
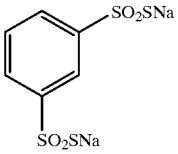
(T-29)
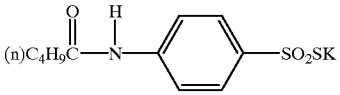
(T-30)
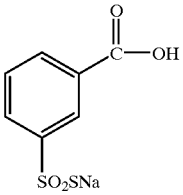
(T-31)
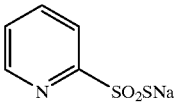
(T-32)
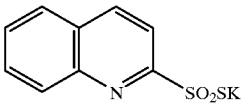
(T-33)
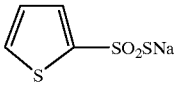
(T-34)
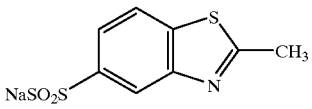
(T-35)
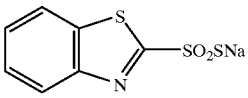

-continued (T-36)

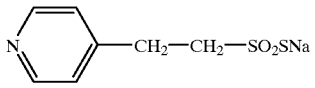

(T-37)

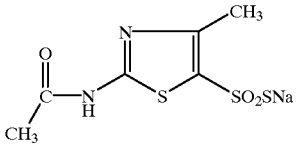

(T-38)

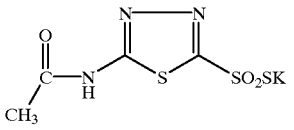

(T-39)

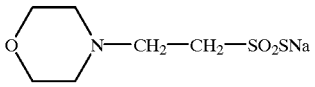

(T-40)

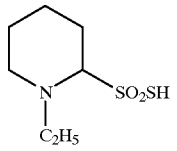

The compound of the formula (5) may be commercially available ones or synthe sized by known methods. For example, they can be synthe sized by reaction of sulfonyl halide and alkali metal sulfide, reaction of sulfinic acid salt and sulfur and so forth.

The compound represented by the formula (5) may be added to any layer son a support provided on the side of the image-forming layer, i.e., the image-forming layer or other layers provided on the same side. The compound may preferably be added to the image-forming layer or a layer adjacent thereto. The compound may be used alone, or in any combination of two or more kinds of it. The compound can be used in a desired amount for obtaining desired performance such as sensitivity and fog. It is preferably added in an amount of $1\times10^{-5}$ mol to $5\times10^{-2}$ mol, more preferably $1\times10^{-4}$ mol to $5\times10^{-1}$ mol, per mole of non-photosensitivesilversalt in the image-forming layer. The compound may be used after being dissolved in water or an appropriate organic solvent such as alcohol (e.g., methanol, ethanol, propanol, fluorinated alcohol), ketone (e.g., acetone, methyl ethyl ketone), dimethylformamide, dimethyl sulfoxide or methyl cellosolve. A compound having an acidic group may be neutralized with an equivalent amount of alkaline, and added as a salt.

The compound may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compounds may be used after dispersion of a powder in water by using a ball mill, a colloid mill, a sand grinder mil, MANTON GAULIN, a microfluidizer, or by means of ultrasonic wave according to a known method for solid dispersion.

When an additive known as a "color-tone adjustor" capable of improving an image is added, an optical density may sometimes increase. The color-tone adjustor may also be sometimes advantageous in forming a black silver image. The color-tone adjustor may preferably be added in the side having an image-forming layer in an amount of from 0.1 to 50% by mole, more preferably from 0.5 to 20% by mole based on one mole of silver. The color-tone adjustor may be a so-called precursor that is modifired to effectively act only at the time of development.

For the heat-developable photosensitive material using an organic silver salt, a wide variety of color-tone adjustors are disclosed in JP-A-46-6077, JP-A-47–10282, JP-A-49-5019, JP-A-49-5020, JP-A-49-91215, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795, Belgian Patent No. 841910 and the like. Examples of the color-tone adjustor include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and certain photobleaching agents, such as N,N'-hexamethylenebis(1-carbamoyl-3,5-dimethylpyrazole), 1,8-(3,6-diazaoctane)bis(iso-thiuroniumtrifluoroacetate) and 2-(tribromomethylsulfonyl)benzothiazole; 3-ethyl-5-[(3-ethyl-2-benzothiazolinylidene)-1-methylethylid ene]-2-thio-2,4-oxazolidinedione; phthalazinone, phthalazinone derivatives and metal salts thereof, such as 4-(1-naphthyl)phthalazinone, 6-chlorophthalazinone, 5,7-dimethyloxyphthalazinone or 2,3-dihydro-1,4-phthalazinedione; combinations of phthalazinone with a phthalic acid derivative such as phthalic acid, 4-methylphthalic acid, 4-nitrophthalic acid, and tetrachlorophthalic acid anhydride; phthalazine, phthalazine derivatives such as 4-(1-naphthyl)phthalazine, 6-chlorophthalazine, 5,7-dimethoxyphthalazine, 6-isopropylphthalazine, 6-isobutylphthalazine, 6-tert-butylphthalazine, 5,7-dimethyphthalazine, and 2,3-dihydrophthalazine and metal salts thereof; combinations of aphthalazineorderivatives thereof and aphthalicacidderivative such as phthalic acid, 4-methylphthalic acid, 4-nitrophthalic acid, and tetrachlorophthalic acid anhydride; quinazolinedione, benzoxazine and naphthoxazine derivatives; rhodium complexes which function not only as a color-tone adjustor but as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione, and 6-nitro-1,3-benzoxazin-2,4-dione; pyrimidines and asymmetric triazines such as 2,4-dihydroxpyrimidine and 2-hydroxy-4-aminopyrimidine; and azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraa zapentalene and the like.

The color-tone adjustor for use in the present invention may be added in any form, for example, as a solution, a powder, a solid fine grain dispersion and the like. The solid fine grain dispersion is performed using a known pulverization means (e.g., a ball mill, a vibrating ball mill, a sand mill, a colloid mill, a jet mill, a roller mill). In the solid fine grain dispersion, a dispersion aid may also be used.

The heat-developable photosensitive material of the present invention preferably has a film surface pH of 6.0 or less, more preferably 5.5 or less before heat development. While the lower limit is not particularly limited, it is normally around 3.

For controlling the film surface pH, an organic acid such as phthalic acid derivatives or a nonvolatile acid such as sulfuric acid, and avolatile base such as ammonia are preferably used to lower the film surface pH. In particular, ammonia is preferred to achieve a low film surface pH, because it is highly volatile and the refore it can be removed before coating or heat development.

The film surface pH of the heat-developable photosensitive material of the present invention is preferably measured as follows. A 2.5 cm×2.5 cm sample of the heat-developable photosensitive material before heat development is folded into a boat shape. The 300 $\mu$l of distilled water is dropped onto the image-forming layer side of the sample, and left stand for 30 minutes. Then, pH of the dropped water is measured by pH BOY-P2 (semiconductor type pHmeter, Shin-Dengen Kogyo Co.,Ltd.) over 1 minute.

The heat-developable photosensitive material of the present invention may contain a sensitizing dye. Any sensitizing dyes may be used so long that they can spectrally sensitize the silver halide grains at a desired wavelength range when they adsorb on the silver halide particles. As the sensitizing dyes, cyanine dyes, merocyanine dyes, complex cyanine dyes, complex merocyanine dyes, holopolar cyanine dyes, styryl dyes, hemicyanine dyes, oxonole dyes, hemioxonole dyes and the like may be used. Preferable sensitizing dyes which can be used in the present invention are described, for example, in Research Disclosure, Item 17643, IV-A (December, 1978, page 23), Item1831X (August, 1978, page437)and also in the references cited therein. In particular, sensitizing dyes having a spectral sensitivity suitable for spectral characteristics of light sources of various laser imagers, scanners, image setters, process cameras and the like can advantageously be chosen.

As examples of spectral sensitization to red light, for example, to so-called red light sources such as He-Ne laser, red semiconductor laser, LED and the like, Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to I-37 disclosed in JP-A-62-284343, Compounds I-1 to I-34 disclosed in JP-A-7-287338 and the like may be used.

In the heat-developable photosensitive material of the present invention, a photosensitive silver halide subjected to spectral sensitization in the range of 750–1400 nm is preferably used. To semiconductor laser light sources having a wavelength range of from 750 to 1,400 nm, spectral sensitization can be advantageously achieved by various known dyes including cyanine dyes, merocyanine dyes, styryl dyes, hemicyanine dyes, oxonol dyes, hemioxonol dyes and xanthene dyes. Useful cyanine dyes arecyaninedyes having a basic nucleus such as thiazoline nucleus, oxazoline nucleus, pyrroline nucleus, pyridine nucleus, oxazole nucleus, thiazole nucleus, selenazole nucleus or imidazole nucleus. Useful and preferred merocyanine dyes are merocyanine dyes having the above-described basic nucleus as well as an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. The aforementioned cyanine and merocyanine dyes having an imino group or a carboxyl group are particularly effective. The dye may be appropriately chosen from known dyes described, for example, in U.S. Pat. Nos. 3,761,279, 3,719,495 and 3,877,943, British Patent Nos. 1,466,201, 1,469,117 and 1,422,057, JP-B-3-10391, JP-B-6-52387, JP-A-5-341432, JP-A-6-194781 and JP-A-6-301141.

The dyes most preferably used for the present invention are cyanine dyes having one or more substituents containing a thioether bond (e.g., cyanine dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-A-7-500926 (the abbreviation "JP-W-A" as used herein means an "international application published in Japanese for Japanese national phase"), and U.S. Pat. No. 5,541,054), dyes having a carboxylic acid group (e.g., dyes disclosed in JP-A-3-163440, JP-A-6-301141, and U.S. Pat. No. 5,441,899), merocyanine dyes, polynuclear merocyanine dyes and polynuclear cyanine dyes (dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-A-W-55-50111, British Patent No. 1,467,638, and U.S. Pat. No. 5,281,515) and the like.

Dyes forming J-band are disclosed in U.S. Pat. Nos. 5,510,236, 3,871,887 (Example 5), JP-A-2-96131, JP-A-59-48753 and the like, and they can preferably be used for the present invention.

Each of these sensitizing dyes may be used alone or in any combination. A combination of sensitizing dyes is frequently used, especially for super sensitization. The emulsion may also contain, together with the sensitizing dye, a dye which itself does not have sensitizing effect or a substance which itself does not substantially absorb visible light, but shows super sensitization. Useful sensitizing dyes, combinations of dyes which exhibit super sensitization, and materials which show super sensitization are described in Research Disclosure, Vol. 176, 17643, page 23, Item IV-J (December, 1978), JP-B-49-25500, JP-B-43-4933, JP-A-59-19032, JP-A-59-192242 and the like.

The sensitizing dye may be added to the silver halide emulsion by dispersing the dye directly in the emulsion, or alternatively, the dye may be added to the emulsion after being dissolved in a single solvent or a mixed solvent chosen from water, methanol, ethanol, propanol, acetone, methyl cellosolve, 2,2,3,3-tetrafluoro propanol, 2,2,2-trifluoroethanol, 3-methoxy-1-propanol, 3-methoxy-1-butanol, 1-methoxy-2-propanol and N,N-dimethylformamide.

Furthermore, the sensitizing dye may be added according to the following methods: a method disclosed in U.S. Pat. No. 3,469,987 which comprises the step of dissolving a dye in a volatile organic solvent, dispersing the solution in water or hydrophilic colloid, and then adding the dispersion to an emulsion; a method disclosed in JP-B-44-23389, JP-B-44-27555 and JP-B-57-22091 which comprises the step of dissolving a dye in an acid, and adding the solution to an emulsion, or alternatively, preparing an aqueous solution in the presence of an acid or a base, and then adding the aqueous solution to an emulsion; a method disclosed in U.S. Pat. Nos. 3,822,135 and 4,006,025 which comprises the step of forming an aqueous solution or a colloid dispersion of a dye in the presence of a surface active agent, and then adding the solution or the dispersion to an emulsion; a method disclosed in JP-A-53-102733 and JP-A-58-105141 which comprises the step of dispersing a dye directly in hydrophilic colloid, and adding the dispersion to an emulsion; or a method disclosed in JP-A-51-74624 which comprises the step of dissolving a dye using a compound capable of red shifting, and adding the solution to an emulsion. An ultrasonic wave may also be applied to dissolve the dye.

The sensitizing dye for use in the present invention may be added to a silver halide emulsion in any stages heretofore known to be useful in the preparation of an emulsion. The sensitizing dye may be added at any time or in any stages before the coating of the emulsion, for example, in the grain formation process of silver halide and/or before desalting or during the desalting process and/or the time period from desalting until initiation of chemical ripening, as disclosed in U.S. Pat. Nos. 2,735,766, 3,628,960, 4,183,756 and 4,225,666, JP-A-58-184142 and JP-A-60-196749, or immediately before or during the chemical ripening process or in the time period after chemical ripening until coating, as disclosed in JP-A-58-113920. Furthermore, as disclosed in U.S. Pat. No. 4,225,666 and JP-A-58-7629, a single compound or a compound in combination with a structurally different compound may be added in divided portions, for example, one portion is added during grain formation and another is added during or after chemical ripening, or one portion is added before or during chemical ripening and another is added after completion of the chemical ripening. A type of a compound or a type of combination of compounds may be changed during the divided addition.

The amount of the sensitizing dye used in the present invention may be appropriately chosen depending on the performance such as sensitivity or fog. The amount may preferably be from $10^{-6}$ to 1 mol, more preferably from $10^{-4}$ to $10^{-1}$ mol based on one mole of silver halide in the photosensitive layer.

In the present invention, a supersensitizer can be used in order to improve infrared spectral sensitization efficiency. The supersensitizer used for the present invention may be compounds disclosed in European Patent 587338, U.S. Pat. Nos. 3,877,943 and 4,873,184, compounds selected from heteroaromatic or aliphatic mercapto compounds, heteroaromatic disulfide compounds, stilbenes, hydrazines and triazines.

Particularly preferred super sensitizers are heteroaromatic mercapto compounds and heteroaromatic disulfide compounds disclosed in JP-A-5-341432, stilbene compounds disclosed in JP-A-10-73899, and compounds of formula (I) disclosed in JP-A-11-271921, specifically, Compounds 1–57 disclosed in JP-A-11-271921.

These compounds including mercapto compounds are preferably added to the emulsion layer as super sensitizers in an amount of 0.0001 to 1.0 mol per mole of silver halide, more preferably in an amount of 0.001 to 0.3 mol per mole of silver halide.

Specific examples of the mercapto compounds include those mentioned hereinafter.

The heat-developable photosensitive material of the present invention may contain a mercapto compound, a disulfide compound or a thione compound, for example, to control the development by inhibition or acceleration, to improve spectral sensitization efficiency, and to improve storage stability before or after the development.

When a mercapto compound is used in the present invention, a mercapto compound having any chemical structure may be used, and those represented by Ar—$SM^O$ or Ar—S—S—Ar are preferred, wherein $M^O$ is a hydrogen atom or an alkali metal atom, and Ar is an aromatic ring or condensed aromatic ring containing one or more nitrogen, sulfur, oxygen, selenium or tellurium atoms. Preferably, the heteroaromatic ring may be benzimidazole, naphthimidazole, benzothiazole, naphthothiazole, benzoxazole, naphthoxazole, benzoselenazole, benzotellurazole, carbazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g., Br, Cl), hydroxyl, amino, carboxyl, an alkyl group (e.g., alkyl having one or more carbon atoms, preferably from 1 to 4 carbon atoms), an alkoxy group (e.g., alkoxy having one or more carbon atoms, preferably from 1 to 4 carbon atoms), and an aryl group (which may have one or more substituents). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methyl-pyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, 2-mercapto-4-phenyloxazole, N-[3-(mercaptoacetylamino)propyl] carbazole and the like. However, the present invention is not limited to these examples.

The amount of the mercapto compound may preferably be from 0.0001 to 1.0 mol, more preferably from 0.001 to 0.3 mol based on one mole of silver in the emulsion layer.

The image-forming layer (preferably, photosensitive layer) for use in the present invention may contain, as a plasticizer or a lubricant, polyhydric alcohols (for example, glycerins and diols described in U.S. Pat. No. 2,960,404), fatty acids or esters described in U.S. Pat. Nos. 2,588,765 and 3,121,060, and silicone resins described in British Patent No. 955,061.

In the present invention, a protective layer is preferably provided on the image-forming layer. As the binder of the protection layer, latex of a polymer having a glass transition temperature of 25° C. to 70° C. is preferably used. Such polymer latex is preferably used in an amount of 50% by weight or more, more preferably 70% by weight or more, of the total binder of the protective layer. In the present invention, at least one protective layer of such characteristics is preferably provided. Binder composition, coating method and so forth of the protective layer may be similar to those of the image-forming layer. As the polymer latex for the protection layer, preferably used are acrylate, styrene, acrylate/styrene, vinyl chloride, and vinylidene chloride polymer latexes. Specifically, preferably used are VONCORT $R^{3370}$ and 4280 as acrylate resins, Nipol Lx857, methyl (meth)acrylate/2-ethylhexyl (meth)acrylate/hydroxyethyl (meth)acrylate/styrene/(meth)acrylic acid copolymer, Nipol G576 as a vinyl chloride resin, Aron D5071 as a vinylidene chloride resin.

The total amount of the binders in the protective layers used for the present invention is 0.2 to 5.0 g/$m^2$, more preferably 0.5 to 4.0 g/$m^2$.

The heat-developable photosensitive material of the present invention may have a surface protective layer, for example, to prevent adhesion of the image-forming layer.

The surface protective layer used in the present invention may contain any polymers as a binder. The surface protective layer may preferably contain a polymer having carboxyl residues in an amount of from 100 mg/$m^2$ to 5 g/$m^2$. Examples of the polymer having carboxyl residues include, for example, natural polymers (e.g., gelatin, alginic acid), modified natural polymers (e.g., carboxymethyl cellulose, phthalizedgelatin), synthetic polymers (e.g., polymethacrylate, polyacrylate, poly(alkylmethacrylate)/acrylate copolymer, polystyrene/polymethacrylate copolymer) and the like. The content of the carboxyl residue in the polymers is preferably from 10 mmol to 1.4 mol per 100 g of the polymer. The carboxylic acid residues may form salts with alkali metal ions, alkaline earth metal ions, organic cations and the like.

For the surface protective layer for use in the present invention, any anti-adhesion material can be used. Examples of the anti-adhesion material include wax, silica particles, styrene-containing elastomeric block copolymer (e.g., styrene/butadiene/styrene, styrene/isoprene/styrene), cellulose acetate, cellulose acetate butyrate, cellulose propionate and a mixture thereof. The surface protective layer may also contain across linking agent for forming cross-linkage or a surface active agent for improving coating property.

The image-forming layer or the protective layer for the image-forming layer according to the present invention may contain a light-absorbing material and a filter dye described in U.S. Pat. Nos. 3,253,921, 2,274,782, 2,527,583 and 2,956,879. The dyes can be mordanted as described in, for example, U.S. Pat. No. 3,282,699. The filter dye is preferably used in such an amount that there should be obtained absorbance at an exposure wavelength of from 0.1 to 3, most preferably from 0.2 to 1.5.

The photosensitive layer for use in the present invention may contain a dye or a pigment of various types to improve color tone or prevent irradiation. Any dye or pigment may be used in the photosensitive layer for use in the present invention, and examples thereof include pigments and dyes described in the color index. Specific examples thereof include organic pigments and inorganic pigments such as pyrazoloazole dyes, anthraquinone dyes, azo dyes, azomethine dyes, oxonol dyes, carbocyanine dyes, styryl dyes, triphenylmethane dyes, indoaniline dyes, indophenol dyes and phthalocyanines. Preferred examples of the dye for use in the present invention include anthraquinone dyes (e.g., Compounds 1 to 9 described in JP-A-5-341441, Compounds 3-6 to 3-18 and 3-23 to 3-38 described in JP-A-5-165147), azomethine dyes (e.g., Compounds 17 to 47 described in JP-A-5-341441), indoaniline dyes (e.g., Compounds 11 to 19 described in JP-A-5-289227, Compound 47 described in JP-A-5-341441, Compounds 2-10 and 2-11 described in JP-A-5-165147) and azo dyes (Compounds 10 to 16 described in JP-A-5-341441). These dyes may be added in any form, for example, as a solution, emulsified product or solid fine grain dispersion, or as a dye mordanted with a polymer mordant. The amount of the compound may be determined depending on a desired amount of absorption. In general, the compound is preferably used in an amount of from $1\times10^{-6}$ g to 1 g per square meter of the photosensitive material.

The heat-developable photosensitive material of the present invention is preferably a so-called single-sided photosensitive material comprising a support having on one side thereof at least one photosensitive layer (preferably an image-forming layer)containing a silver halide emulsion and on the other side thereof a backing layer (backing).

In the present invention, the backing layer preferably has a maximum absorption of from about 0.3 to 2.0 in a desired wavelength range. Where the desired range is from 750 to 1,400 nm, the backing layer may preferably have an optical density of from 0.005 to less than 0.5 at from 360 to 750 nm, and more preferably act as an antihalation layer having optical density of from 0.001 to less than 0.3. Where the desired range is less than 750 nm, the backing layer may preferably be an antihalation layer having a maximum absorption of from 0.3 to 2.0 in a desired range of wavelength before the formation of an image, and an optical density of from 0.005 to less than 0.3 at from 360 to 750 nm after the formation of an image. The method for decreasing the optical density after the formation of an image to the above-described range is not particularly limited. For example, a method for reducing the density through decoloration of a dye by heating as described in Belgian Patent No. 733,706, or a method for reducing the density using decoloration by light irradiation described in JP-A-54-17833 may be used.

When antihalation dyes are used in the present invention, the dyes may be any compounds so far that they have an intended absorption in a desired wavelength region and sufficiently low absorption in a visible region, and also provide an absorption spectral property desired for the aforementioned backing layer. Examples of such dye include, as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the treatment, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734 and U.S. Pat. Nos. 4,088,497, 4,283,487, 4,548,896 and 5,187,049. However, the scope of the present invention is not limited to these examples.

The binder suitable for the backing layer in the present invention may be transparent or translucent, and generally colorless. Examples include natural polymers and synthe tic resins including homopolymers and copolymers, and other film-forming media. Specific examples include, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), poly(vinyl chloride), poly (methacrylic acid), copoly(styrene-maleic anhydride), copoly(styrene-acrylonitrile), copoly(styrene-butadiene), poly(vinyl acetals) (e.g., poly(vinyl formal), poly(vinyl butyral)), poly(esters), poly(urethanes), phenoxy resin, poly (vinylidene chloride), poly(epoxides), poly(carbonates), poly(vinyl acetate), cellulose esters and poly(amides). The binder may be coated and formed after being dissolved in water or an organic solvent or in the form of an emulsion.

The single-sided photosensitive material of the present invention may contain, in the surface protective layer for the photosensitive emulsion layer (preferably image-forming layer) and/or the backing layer or in the surface protective layer for the backing layer, a matting agent to improve transferability. The matting agent is, in general a fine particle of a water-insoluble organic or inorganic compound. Any matting agent may be employed, and those well known in the art may be used, such as organic matting agents described in U.S. Pat. Nos. 1,939,213, 2,701,245, 2,322,037, 3,262,782, 3,539,344 and 3,767,448, or inorganic matting agents described in U.S. Pat. Nos. 1,260,772,2,192,241, 3,257,206,3,370,951, 3,523,022 and 3,769,020.

In the present invention, it is preferred to use a porous matting agent described in JP-A-3-109542, page 2, lower left column, line 8 to page 3, upper right column, line 4, a matting agent in which the surface thereof has been modified with an alkali described in JP-A-4-127142, page 3, upper right column, line 7 to page 5, lower right column, line 4, or a matting agent of an organic polymer described in JP-A-6-118542, Paragraph Nos. [0005] to [0026].

Specific examples of the organic compound which can be used as the matting agent include, for example, water-dispersible vinyl polymers such as polymethyl acrylate, polymethyl methacrylate, polyacrylonitrile, acrylonitrile/α-methylstyrene copolymer, polystyrene, styrene/divinylbenzene copolymer, polyvinyl acetate, polydivinyl benzene, polyethylene carbonate, polytetrafluoroethylene, and copolymer thereof; cellulose derivatives including cellulose esters such as methyl cellulose, cellulose acetate and cellulose acetate propionate; starch derivatives such as carboxy starch, carboxynitrophenyl starch and urea/formaldehyde/starch reaction product; and gelatin hardened with a known hardening agent and hardened gelatin subjected to coacervation hardening so as to be a microcapsule hollow particle. Examples of the inorganic compound include, for example, silicon dioxide, titanium dioxide, magnesium dioxide, aluminum oxide, barium sulfate, calcium sulfate, zinc carbonate, calcium carbonate, calcium silicate, aluminum silicate, silver chloride desensitized by a known method, silver bromide desensitized by a known method, glass, diatomaceous earth and the like.

Further, two or more kinds of these matting agents may be used in combination. For example, a combination of an inorganic matting agent and an organic matting agent, a combination of a porous matting agent and a non-porous matting agent, a combination of indefinite shape matting agent and a globular matting agent, a combination of matting agents having different average particle diameters (for example, a combination of a matting agent having an average particle diameter of 1.5 μm or more and a matting agent having an average particle diameter of 1 μm or less as described in JP-A-6-118542) can be used.

The size and shape of the matting agent are not particularly limited and the matting agent may have any particle size. A matting agent having a particle size of preferably from 0.1 to 30 μm, more preferably from 1 to 10 μm, may used to carry out the present invention. The matting agent may have either a narrow or broad particle size distribution. However, the matting agent may greatly affect the haze of the photosensitive material or surface gloss of a coated layer, and accordingly, the particle size, shape and particle size distribution may preferably be controlled to meet a desired purpose at the preparation of the matting agent or by mixing several matting agents.

In the present invention, the matting agent is preferably added in an amount of 5 to 400 mg/m$^2$, more preferably in an amount of 10 to 200 mg/m$^2$.

In the present invention, the matting agent may preferably be incorporated in the outermost surface layer of the photosensitive material or a layer which functions as the outermost surface layer, or alternatively, in a layer close to the outer surface or a layer which acts as a so-called protective layer. By variously changing average diameter and addition amount of micro particles of the matting agent contained in the outermost surface layer of the image-forming layer side of the photosensitive material and the outermost surface layer of the opposite side, Beck's smoothness of the surface layers can be controlled. The matting degreeon the surface protective layer on the image-forming layer side can be freely chosen so long as the star dust trouble does not occur. The degree may preferably be within a range of from 300 to 10,000 seconds, particularly preferably from 500 to 2,000 seconds as indicated by the Beck's smoothness.

In the present invention, the backing layer preferably contains a matting agent. The matting degree of the backing layer is preferably 2,000 seconds or less, more preferably 10 to 1,200 seconds, further preferably from 50 to 700 seconds as indicated by the Beck's smoothness.

The Beck smoothness in the present invention can be easily determined by Japanese Industrial Stand ard (JIS) P8119, "Test Method for Smoothness of Paper and Paperboard by Beck Test Device"and TAPPI Stand ard Method T479.

The heat-developable photographic emulsion for use in the present invention is coated on a support to form one or more layers. In the case of a single layer, the layer should contain an organic silver acid salt, a silver halide, a developer, a binder, and optionally added materials such as a color-tone adjustor, a coating aid and other auxiliary agents. In the case of a double-layer structure, the first emulsion layer (usually a layer adjacent to the substrate) must contain an organic acid silver salt and a silver halide, and the second layer or both layers must contain some other components. A double-layer structure comprising a single emulsion layer containing all of the components and a protective topcoat may also be contemplated. A multi-color photosensitive heat-developable photosensitive material may have the combination of the above-described two layers for each of the colors, or as described in U.S. Pat. No. 4,708,928, a structure comprising a single layer containing all components. In the case of a multi-dye multi-color photosensitive heat-developable material, a functional or non-functional barrier layer is generally provided between respective emulsion layers (photosensitive layers) to keep the emulsion layer away from each other as described in U.S. Pat. No. 4,460,681.

A backside resistive heating layer described in U.S. Pat. Nos. 4,460,681 and 4,374,921 may also be used in the photosensitive heat-developable photographic image system.

In the present invention, a hardening agent may be used in layers such as the image-forming layer (preferably photosensitive layer), the protective layer, and the backing layer. Examples of the hardening agent include polyisocyanates described in U.S. Pat. No. 4,281,060 and JP-A-6-208193, epoxy compounds described in U.S. Pat. No. 4,791,042, and vinyl sulfone-based compounds described in JP-A-62-89048.

In the present invention, a surface active agent may also be used to improve the coating property and or electrostatic charge property. Examples of the surface active agent include nonionic, anionic, cationic and fluorocarbon surface active agents, which may be appropriately chosen and used. Specific examples include fluorocarbon polymer surface active agents described in JP-A-62-170950 and U.S. Pat. No. 5,380,644, fluorocarbon surface active agents described in JP-A-60-244945 and JP-A-63-188135, polysiloxane-based surface active agents described in U.S. Pat. No. 3,885,965, and polyalkylene oxides and anionic surface active agents described in JP-A-6-301140.

For the heat-developable photographic material of the present invention, various types of support can be used. Typical examples of the support include polyester film, undercoated polyester film, such as poly(ethylene terephthalate) film, or polyethylene naphthalate film, nitrocellulose film, cellulose ester film, poly(vinyl acetal) film, polycarbonate film, related or resinous material, glass, paper and metal. A flexible substrate, particularly, a paper support coated with baryta and/or partially acetylated α-olefin polymer, preferably, an α-olefin polymer having 2 to 10 carbon atoms, such as polyethylene, polypropylene or ethylene/butene copolymer may typically be used. The support may be either transparent or opaque, and preferably be transparent. Among them, a biaxially stretched polyester, in particular, polyethylene terephthalate (PET), is particularly preferred in view of strength, dimensional stability, chemical resistance and so forth. The support preferably has a thickness in terms of a base thickness, which means a thickness not including the thickness of undercoat layer(s), of approximately from 75 to 200 μm, more preferably from 90 to 180 μm.

When a plastic film is passed through a heat-developing apparatus and processed at 80° C. or higher, the film is generally stretched in the dimension. If the processed materials are used as printing photosensitive materials, the stretch causes a serious problem at the time of precision multi-color printing. Accordingly, in the present invention, it is preferred to use a film designed to cause little change in the dimension by relaxing the internal strain remaining in the film at the biaxial stretching and there by eliminating the heat shrinkage distortion generated during the heat development. For example, polyester, in particular, polyethylene terephthalate, heat-treated at 100 to 210° C., preferably 130 to 185° C., before a heat-developable photographic emulsion is coated thereon is preferably used. A film having a high glass transition point is also preferred, for example, a film of polyether ethyl ketone, polystyrene, polysulfone, polyether sulfone, polyarylate or polycarbonate may be used. The heat relaxation treatment described above may be performed either at a constant temperature within the temperature range or with raising the temperature.

The heat treatment of the support may be performed for the support in the form of a roll, or it may be performed for the support that is conveyed as a web. When it is performed for a support that is conveyed as a web, it is preferred that the conveying tension should be relatively low, specifically not more than 7 kg/cm$^2$, in particular, not more than 4.2 kg/cm$^2$. The lower limit of the conveying tension is, while not particularly limited, 0.5 kg/cm$^2$ or so.

This heat treatment is preferably performed after a treatment for improving adhesion of the image-forming layer and the backing layer to the support, application of the undercoat layer containing a vinylidene chloride copolymer and the like.

The thermal shrinkage of the support after the above heat treatment upon heating at 120° C. for 30 seconds is preferably −0.03% to +0.01% for the machine direction (MD), and 0 to 0.04% for the transverse direction (TD).

The support may be applied with, other than the vinylidene chloride copolymer layer, an undercoat layer containing SBR, polyester, gelatin or the like as a binder, as required. The undercoat layer may be composed of multiple layers, and may be provided on one side or both sides of the support. At least one of the undercoat layers may be an electro conductive layer. The undercoat layer generally has a thickness of 0.01–5 μm, more preferably 0.05–1 μm (for one layer). When it is an electro conductive layer, it preferably has a thickness of 0.01–1 μm, more preferably 0.03–0.8 μm.

In the present invention, undercoat layers containing a vinylidene chloride copolymer are preferably provided on both sides of the support. The vinylidene chloride copolymer for this contains vinylidene chloride monomer repeating units (also referred to as "vinylidene chloride monomers" hereinafter) in an amount of 70% by weight or more. When the vinylidene chloride monomer content is less than 70% by weight, sufficient moisture barrier property cannot be obtained, and hence the dimensional change over time after the heat development becomes large. The vinylidene chloride copolymer preferably contains carboxyl group-containing vinyl monomer repeating units (also referred to as "carboxyl group-containing vinyl monomers") as repeating units other than the vinylidene chloride monomers. Such structural repeating units are contained because the vinyl chloride monomers alone afford crystallization of the polymer, which makes it difficult to form a uniform film when the moisture barrier layer is coated, and the carboxyl group-containing vinyl monomers are indispensable for stabilization of the polymer.

The vinylidene chloride copolymer used for the present invention is a copolymer preferably containing 70–99.9% by weight, more preferably 85–99% by weight of vinylidene chloride monomers, and preferably 0.1–5% by weight, more preferably 0.2–3% by weight of carboxyl group-containing vinyl monomers.

The carboxyl group-containing vinyl monomer used for the vinylidene chloride copolymer in the present invention is a vinyl monomer having one or more carboxyl groups in a molecule, and specific examples thereof include, for example, acrylic acid, methacrylic acid, itaconic acid, citraconic acid and the like.

The vinylidene chloride copolymer used for the present invention may contain repeating units of monomers other than the vinylidene chloride monomer and the carboxyl group-containing monomer, which are copolymerizable with these monomers.

Examples of such monomers include, for example, acrylonitrile, methacrylonitrile, methyl acrylate, ethyl acrylate, methyl methacrylate, glycidyl methacrylate, 2-hydroxyethyl methacrylate, vinyl acetate, acrylamide, styrene, and the like.

These monomers can be used alone, or in any combination of two or more of them.

The molecular weight of the vinylidene chloride copolymer for use in the present invention is preferably 45000 or less, more preferably 10000 to 45000 in terms of weight average molecular weight. When the molecular weight becomes too large, adhesion between the vinylidene chloride copolymer layer and the support layer of polyester or the like is degraded.

The vinylidene chloride copolymer used for the present invention may be used by dissolving it in an organic solvent, or as an aqueous dispersion of latex. The aqueous dispersion of latex is preferred.

In the latter case, the latex of polymer particles may be latex having a uniform structure, or a so-called core/shell type latex comprising core and shell with different compositions.

The particle size of the polymer particles in the latex may be similar to those used for the binders of the image-forming layer or the protective layer explained herein.

The sequence of the monomeric units of the vinylidene chloride copolymer is not particularly limited, and it may show periodicity or randomness, or may be composed of blocks.

The following can be mentioned as specific examples of the vinylidene chloride copolymer used for the present invention. The parenthesized numerals indicate weight ratios. The average molecular weights represent weight average molecular weights.

V-1: latex of vinylidene chloride/methyl acrylate/acrylic acid (90:9:1, average molecular weight of 42000);

V-2: latex of vinylidene chloride/methyl acrylate/methyl methacrylate/acrylonitrile/methacrylic acid (87:4:4:4:1, average molecular weight of 40000);

V-3: latex of vinylidene chloride/methyl methacrylate/glycidyl methacrylate/methacrylic acid (90:6:2:2, average molecular weight of 38000);

V-4: latex of vinylidene chloride/ethyl methacrylate/2-hydroxyethyl methacrylate/acrylic acid (90:8:1.5:0.5, average molecular weight of 44000);

V-5: core shell type latex (90% by weight of core and 10% by weight of shell, average molecular weight of 38000); Core: vinylidene chloride/methyl acrylate/methylmethacrylate/acrylonitrile/acrylic acid (93:3:3:0.9:0.1); Shell: vinylidene chloride/methyl acrylate/methyl methacrylate/acrylonitrile/acrylic acid (88:3:3:3:3);

V-6: core shell type latex (70% by weight of core and 30% by weight of shell, average molecular weight of 20000); Core: vinylidene chloride/methylacrylate/methylmethacrylate/acrylonitrile/methacrylic acid (92.5:3:3:1:0.5); Shell: vinylidene chloride/methyl acrylate/methyl methacrylate/acrylonitrile/methacrylic acid (90:3:3:1:3).

The vinylidene chloride copolymers may be used alone, or in any combination of two or more of them.

The vinylidene chloride copolymer used in the present invention is used in such an amount that the undercoat layer containing the vinylidene chloride copolymer should have a total thickness for one side of 0.3 $\mu$m or more, preferably 0.3 to 4 $\mu$m.

The vinylidene chloride copolymer layer as the undercoat layer is preferably provided as the first undercoat layer that is directly coated on the support. While one undercoat layer is usually provided for each side, two or more layers may be provided as the case may be. When a multiple-layer structure composed of two or more layers is used, the vinylidene chloride copolymer amount range defined by the present invention may be satisfied by the total amount of the vinylidene chloride copolymers in such layers.

Because the vinylidene chloride copolymer layer usually has a mono layer structure as mentioned above, the thickness is preferably 0.3 to 4 $\mu$m, more preferably 0.6 to 3 $\mu$m, particularly preferably 1.0 to 2 $\mu$m in order to obtain a good applied surface condition.

This layer may contain, other than the vinylidene chloride copolymer, a crosslinking agent, matting agent and the like.

A backing layer or an undercoat layer adjacent to the support of the heat-developable photosensitive material of the present invention preferably contains metal oxide in order to reduce adhesion of dust. It is preferred that at least one of the backing layer and undercoat layers (those provided on both surface of the support) should be an electro conductive layer. Preferably, however, the outermost backing layer should not be an electro conductive layer.

As the metal oxide used to this end, those described in JP-A-61-20033 and JP-A-56-82504 are particularly preferred.

According to the present invention, the electro conductive metal oxide is preferably used in an amount of 0.05 to 20 g, particularly, 0.1 to 10 g, per 1 $m^2$ of the photosensitive material. Surface resistivity of the metal oxide-containing layer is preferably $10^{12}$ ohm or less, more preferably $10^{11}$ ohm or less, at 25° C., 25% RH. Such a surface resistivity provides good antistatic property. The lower limit of the surface resistivity is not particularly defined, but it is usually around $10^7$ ohm.

In the present invention, in addition to the above-described metal oxide, by using a fluorine-containing surface active agent may be used in combination, a better antistatic property can be obtained.

Examples of preferred fluorine-containing surface active agents which can be used in the present invention include surface active agents having a fluoroalkyl group, fluoroalkenyl group or fluoroaryl group having 4 or more carbon atoms (usually 15 or less), and having, as an ionic group, an anionic group (sulfonic acid (salt), sulfuric acid (salt), carboxylic acid (salt), phosphoric acid (salt)), a cationic group (amine salt, ammonium salt, aromatic amine salt, sulfonium salt, phosphonium salt), a betaine group (carboxyamine salt, carboxyammonium salt, a sulfoamine salt, sulfoammonium salt, phosphoammonium salt), or a nonionic group (substituted or unsubstituted polyoxyalkylene group, polyglyceryl group or a sorbitan residue).

These fluorine-containing surface active agents are described in, for example, JP-A-49-10722, British Patent No. 1,330,356, U.S. Pat. Nos. 4,335,201 and 4,347,308, British Patent No. 1,417,915, JP-A-55-149938, JP-A-58-196544, and British Patent No. 1,439,402.

Some specific examples of these agents are shown below.

F-1

$C_8F_{17}SO_3K$

F-2

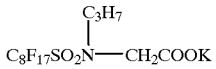

F-3

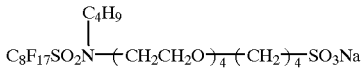

F-4

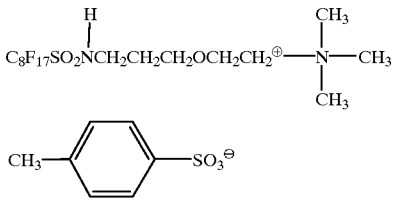

F-5

$C_8F_{17}SO_3Li$

In the present invention, the layer to which a fluorine-containing surface active agent is added is not specifically limited so long as it is at least one of the layers of the heat-developable photosensitive material of the present invention, and may be, for example, a surface protective layer, an emulsion layer, an intermediate layer, an undercoat layer and a backing layer. Of these layers, a preferred portion for addition is a surface protective layer, which may be on either the image-forming layer side or the backing layer side, but the addition to at least a surface protective layer on the image-forming layer is more preferred.

When the surface protective layer comprises two or more layers, the fluorine-containing surface active agent may be added to any layer, and alternatively, the agent may be used as an overcoat on the protective layer.

The amount of the fluorine-containing surface active agent used in the present invention is preferably from 0.0001 to 1 g, more preferably from 0.0002 to 0.25 g, particularly preferably from 0.0003 to 0.1 g, per 1 $m^2$ of the photosensitive material.

In the present invention, two or more of the fluorine-containing surface active agents may be used in admixture.

In the present invention, a lubricant is preferably contained in the uppermost surface layer on the image-forming layer side and/or the opposite side.

No particular limitation is imposed upon the lubricant used in the present invention, and any compound which, when present at the surface of an object, reduces the friction coefficient of the surface relative to that when the compound is absent can be used for this purpose.

Typical examples of the lubricant that can be used in the present invention include the silicone based lubricants disclosed in U.S. Pat. No. 3,042,522, British Patent 955,061, U.S. Pat. Nos. 3,080,317, 4,004,927, 4,047,958 and 3,489,567, and British Patent 1,143,118, the higher fatty acid based, alcohol based and acid amide based lubricants disclosed in U.S. Pat. Nos. 2,454,043, 2,732,305, 2,976,148 and 3,206,311, German Patents Nos. 1,284,295 and 1,284,294, the metal soaps disclosed in British Patent No. 1,263,722, and U.S. Pat. No. 3,933,516, the ester based and ether based lubricants disclosed in, for example, U.S. Pat. Nos. 2,588,765 and 3,121,060, and British Patent 1,198,387, and the taurine based lubricants disclosed in U.S. Pat. Nos. 3,502,473 and 3,042,222.

Examples of the lubricant that can preferably be used are Cellosol 524 (main component: carnauba wax), Polyron A, 393, H-481 (main component: polyethylene wax), Himicron G-110 (main component: ethylene bisstearic acid amide), Himicron G-270 (main component: stearic acid amide) (all of these products are from Chukyo Yushi Co., Ltd.) and so forth.

The amount of the lubricant used is 0.1 to 50% by weight, preferably 0.5 to 30% by weight, of the amount of binder in a layer to which it is added.

The heat-developable photosensitive material of the invention may have for antistatic purpose, for example, a layer containing soluble salts (e.g., chlorides and nitrates), an deposited metal layer, a layer containing ionic polymers as described in U.S. Pat. Nos. 2,861,056 and 3,206,312, insoluble inorganic salts as described in U.S. Pat. No. 3,428,451, or tin oxide fine grains as described in JP-A-60-252349 and JP-A-57-104931.

A method for producing color images using the heat-developable photosensitive material of the invention is as described in JP-A-7-13295, page 10, left column, line 43 to page 11, left column, line 40. Stabilizers for color dye images are exemplified in British Patent No. 1,326,889, U.S. Pat. Nos. 3,432,300, 3,698,909, 3,574,627, 3,573,050, 3,764,337, and 4,042,394.

In the present invention, the heat-developable photographic emulsion can be coated by various coating methods including dip coating, air knife coating, flow coating, and extrusion coating using a hopper of the type described in U.S. Pat. No. 2,681,294. If desired, two or more layers may be simultaneously coated by the methods described in U.S. Pat. No. 2,761,791 and British Patent No. 837,095.

In the heat-developable photosensitive material of the invention, there may be contained additional layers, for example, a dye accepting layer for accepting a mobile dye image, an opacifying layer when reflection printing is desired, a protective topcoat layer, and a primer layer well known in the photo thermographic art. The photosensitive material of the invention is preferably able to form an image by only a single sheet of the photosensitive material. That is, it is preferred that a functional layer necessary to form an image such as an image receiving layer does not constitute a separate member.

In the present invention, any light-exposure apparatus may be used so long as it enables light exposure of $10^{-7}$ second or shorter. In general, a light exposure apparatus utilizing an LD (laser diode) or LED (light emitting diode) as a light source is preferably used. In particular, LD is preferred because it can afford high output and high resolution. Any light source may be used so long as it can emit light of electromagnetic wave spectrum within a desired wavelength range. As for LD, for example, there can be used a dye laser, gas laser, solid laser, YAG laser, semiconductor laser and so forth. A semiconductor laser combined with a second harmonic generating device is also useful.

In the present invention, the light exposure is preferably performed with overlapped light beams from a light source. The expression of overlapped light beams means that the sub scanning pitch width is smaller than the beam diameter. For example, the overlap can be quantitatively expressed, when the beam diameter is expressed with the full-width at half maximum (FWHM) of beam intensity, as FWHM/Sub scanning pitch width (overlap coefficient).

In the present invention, the overlap coefficient is 0.2 to 0.5, and a lower overlap coefficient is preferred for obtaining higher productivity.

Scanning scheme of the light source of the light exposure apparatus used in the present invention is not particularly limited, and there can be used cylinder outer surface scanning, cylinder inner surface scanning, plane scanning and so forth. Further, the light source may have either a single channel, or multiple channels, and for cylinder outer surface scanning, multiple channels are preferably used.

The heat-developable photosensitive material of the present invention has a low haze at the exposure, and is liable to incur generation of interference fringes. For preventing the generation of interference fringes, a technique of entering a laser ray obliquely with respect to the photosensitive material disclosed in JP-A-5-113548 and a method of using a multimode laser disclosed in International Patent Publication WO95/31754 have been known, and these techniques are preferably used.

The heat-developable photosensitive material of the present invention is preferably exposed such that the laser rays are overlapped and the scanning lines are not viewed as described in SPIE, Vol. 169, "Laser Printing", pages 116 to 128 (1979), JP-A-4-51043, International Patent Publication WO95/31754 and so forth.

The heat-developable photosensitive material of the present invention may be developed by any method. The development is usually performed by elevating the temperature of the photosensitive material after imagewise exposure. Preferred embodiments of the heat-developing apparatus include, as a type of contacting a heat-developable photosensitive material with a heat source such as heat roller or heat drum, the heat-developing apparatuses described in JP-B-5-56499, Japanese Patent No. 684453, JP-A-9-292695, JP-A-9-297385 and International Patent Publication WO95/30934, and as a non-contacting type, the heat-developing apparatuses described in JP-A-7-13294, International Patent publications WO97/28489, WO97/28488 and WO97/28287. A non-contacting type heat-developing apparatus is particularly preferred. The development temperature may preferably be from 80 to 250° C., more preferably from 100 to 140° C. The development time may preferably be from 1 to 180 seconds, more preferably from 10 to 90 seconds.

For preventing uneven processing of the heat-developable photosensitive material of the present invention due to dimensional change during the heat development, a method comprising steps of heating the photosensitive material at a temperature of from 80° C. to less than 115° C. (preferably 113° C. or lower) for 5 seconds or more so that an image is not formed, and then heat-developing the material at 110° C. to 140° C. (preferably 130° C. or lower) to form an image (the so-called multi-stage heating method) is effective.

An example of the structure of a heat-developing apparatus used for the heat development of the heat-developable photosensitive material of the present invention is shown in FIG. 1. FIG. 1 depicts a side view of a heat-developing apparatus. The apparatus shown in FIG. 1 comprises carrying-in roller pairs 11 (lower rollers are heating rollers), which carry a heat-developable photosensitive material 10 into the heating section while making the material in a flat shape and preheating it, and carrying-out roller pairs 12, which carry out the heat-developable photosensitive material 10 after heat development from the heating section while maintaining the material to be in a flat shape. The heat-developable photosensitive material 10 is heat-developed while it is conveyed by the carrying-in roller pairs 11 and then by the carrying-out roller pairs 12. As a conveying means for carrying the heat-developable photosensitive material 10 under the heat development, multiple rollers 13 is provised in such a way that they are contacted with the side of the image-forming layer, and a flat surface 14 consisting of non-woven fabric (composed of aromatic polyamide, polyphenylene sulfite, Teflon etc.) or the like is provided on the opposite side so that it should be contacted with the back surface. The heat-developable photosensitive material 10 is conveyed by driving of the multiple rollers 13 contacted with the image-forming layer side, while the back surface slides on the flat surface 14. As a heating means, heaters 15 are provided over the rollers 13 and under the flat surface 14 so that the heat-developable photosensitive material 10 should be heated from the both sides. Examples of the heating means include panel heaters and so forth. While clearance between the rollers 13 and the flat surface 14 may vary depending on the member of the flat surface, it is suitably adjusted to a clearance that allows the conveyance of the heat-developable photosensitive material 10. The clearance is preferably 0–1 mm.

The material of the surface of the rollers 13 and the member of the flat surface 14 may be composed of any materials so long as they have heat resistance and they should not cause any troubles in the conveyance of the heat-developable photosensitive material 10. The material of the roller surface is preferably composed of silicone rubber, and the member of the flat surface is preferably composed of non-woven fabric made of aromatic polyamide or Teflon (polytetrafluoroethylene). The heating means preferably comprises multiple heaters so that temperature of each heater can be adjusted freely.

The heating section is composed of a preheating section A comprising the carrying-in roller pairs 11 and a heat development section B comprising the heaters 15. The temperature of the preheating section A located upstream of the heat development section B is preferably selected to be lower than the heat development temperature (for example, by about 10–50° C.), and the temperature and heat development time are desirably adjusted so that they are sufficient for evaporating moisture contained in the heat-developable photosensitive material 10. The temperature is also adjusted to be higher than the glass transition temperature (Tg) of the support of the heat-developable photosensitive material 10 so that uneven development should be prevented.

Moreover, guide panels 16 are provided downstream from the heat development section B, and they constitute a gradual cooling section C together with the carrying-out roller pairs 12. The guide panels 16 are preferably composed of a material of low heat conductivity, and it is preferred that the cooling is performed gradually so as not to cause deformation of the heat-developable photosensitive material 10.

The heat-development apparatus is explained with reference to an example shown in the drawing. However, the apparatus is not limited to the example. For example, the heat-development apparatus used for the present invention may have a variety of structures such as disclosed in JP-A-7-13294, JP-A-11-133572 and Japenese Patent Application Nos. 10-249940. For the multi-stage heating method, which is preferably used in the present invention, the heat-developable photosensitive material may be successively heated at different temperatures in such an apparatus as mentioned above, which is provided with two or more heat sources at different temperatures.

EXAMPLES

The present invention will be specifically explained with reference to the following examples. Materials, reagents, ratios, operations and so forth mentioned in the following examples can suitably be modified without deviating from the spirit of the present invention. Therefore, the scope of the present invention is not limited to the following examples.

Example 1

(1) Preparation of Support (base)

PET having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, melted at 300° C., then extruded from a T-die and rapidly cooled to form an unstretched film having a thickness of 120 $\mu$m after thermal fixation.

The film was stretched along the longitudinal direction by 3.3 times using rollers of different peripheral speeds, and then stretched along the transverse direction by 4.5 times using atenter. The temperatures used for these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a film having a width of 2.4 m, length of 3500 m, and thickness of 120 $\mu$m was obtained.

(2) Undercoat Layer

| | |
|---|---|
| Undercoat layer (a-1) | |
| Polymer latex V-5 (core shell type latex comprising 90% by weight of core and 10% by weight of shell, weight average molecular weight; 38000, core: vinylidene chloride/methyl acrylate/methyl methacrylate/acrylonitrile/acrylic acid = 93/3/3/0.9/0.1 (% by weight), shell; vinylidene chloride/methyl acrylate/methyl methacrylate/acrylonitrile/acrylic acid = 88/3/3/3/3 (% by weight)) | 3.0 g/m$^2$ as solid content |
| 2,4-Dichloro-6-hydroxy-s-triazine | 23 mg/m$^2$ |
| Matting agent (polystyrene, average diameter; 2.4 $\mu$m) | 1.5 mg/m$^2$ |
| Undercoat layer (a-2) | |
| Polymer latex (styrene/butadiene/hydroxyethyl methacrylate/divinylbenzene = 67/30/2.5/0.5 (% by weight) | 160 mg/m$^2$ as solid content |
| 2,4-Dichloro-6-hydroxy-s-triazine | 4 mg/m$^2$ |
| Matting agent (polystyrene, average diameter; 2.4 $\mu$m) | 3 mg/m$^2$ |
| Undercoat layer (b) | |
| Alkali treated gelatin ($Ca^{++}$ content; 30 ppm, jelly strength; 230 g) | 50 mg/m$^2$ |

(3) Electrocoductive Layer

| | |
|---|---|
| Julimer ET-410 (Nihon Junyaku Co., Ltd.) | 96 mg/m$^2$ |
| Alkali treated gelatin (molecular weight; about 10000, $Ca^{++}$ content; 30 ppm) | 42 mg/m$^2$ |
| Deionized gelatin ($Ca^{2+}$ content; 0.6 ppm) | 8 mg/m$^2$ |
| Compound A | 0.2 mg/m$^2$ |
| Polyoxyethylene phenyl ether | 10 mg/m$^2$ |
| Sumitex Resin M-3 (water-soluble melamine resin, Sumitomo Chemical Co., Ltd.) | 18 mg/m$^2$ |
| Dye A | Amount affording optical density of 1.0 at 783 nm |
| $SnO_2$/Sb (weight ratio: 9/1, acicular grains, long axis/short axis = 20–30, Ishihara Sangyo Kaisha, Ltd.) | 160 mg/m$^2$ |
| Matting agent (Polymethyl methacrylate, average particle size: 5 $\mu$m) | 7 mg/m$^2$ |

Compound A

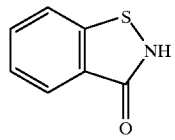

Dye A

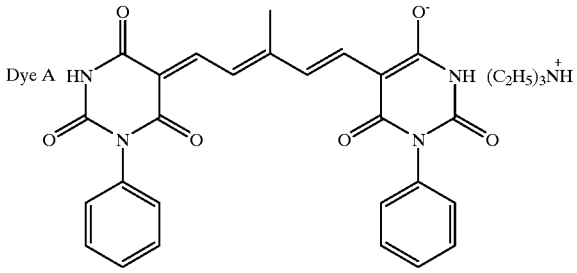

(4) Protective Layer

| | |
|---|---|
| Polymer latex (copolymer of methyl methacrylate/styrene/2-ethylhexyl acrylate/2-hydroxyethyl methacrylate/acrylic acid = 59/9/26/5/1 (% by weight)) | 1000 mg/m$^2$ |
| Polystyrenesulfonate (molecular weight: 1000–5000) | 2.6 mg/m$^2$ |
| Cellosol 524 (Chukyo Yushi Co., Ltd.) | 25 mg/m$^2$ |
| Sumitex Resin M-3 (water-soluble melamine compound, Sumitomo Chemical Co., Ltd.) | 218 mg/m$^2$ |

(5) Preparation of Support I

Undercoat layer (a-1) and Undercoat layer (b) were successively applied on both sides of the support (base), and each dried at 180° C. for 4 minutes. Then, an electro conductive layer and a protective layer are successively applied to one side applied with Undercoat layer (a-1) and Undercoat layer (b), and each dried at 180° C. for 4 minutes to prepare PET Support I having backing layers and undercoat layers. The dry thickness of Undercoat layer (a-1) was 2.0 $\mu$m (for one side).

(6) Preparation of Support II

In a similar manner, Undercoat layer (a-2) and Undercoat layer (b) were applied successively on both sides of the support (base), and each dried at 180° C. for 4 minutes. Then, an electro conductive layer and a protective layer are successively applied to one side, and each dried at 180° C. for 4 minutes to prepare PET Support II having backing layers and undercoat layers. The dry thickness of Undercoat layer (a-2) was 2.0 $\mu$m (for one side).

(7) Heat Treatment During Transportation (7-1) Heat Treatment

PET supports I and II with backing layers and undercoat layers were introduced into a heat treatment zone having a total length of 200 m set at 160° C., and transported at a tension of 3 kg/cm$^2$ and a transportation speed of 20 m/minute.

(7-2) Post-heat Treatment

Following the aforementioned heat treatment, each support was passed through a zone at 40° C. for 15 seconds, and rolled up. The rolling up tension for this operation was 10 kg/cm$^2$.

<<Preparation of silver halide emulsion>>

(Emulsion A)

In 700 ml of water, phthalized gelatin (11 g), potassium bromide (30 mg) and sodium benzenethiosulfonate (10 mg) were dissolved. After the solution was adjusted to pH 5.0 at a temperature of 40° C., 159 ml of an aqueous solution containing silver nitrate (18.6 g) and an aqueous solution containing 1 mol/l of potassium bromide, $5\times10^{-6}$ mol/l of $(NH_4)_2RhCl_5(H_2O)$ and $2\times10^{-5}$ mol/l of $K_3IrCl_6$ were added by the control double jet method over 6 minutes and 30 seconds while pAg was maintained at 7.7. Then, 476 ml of an aqueous solution containing silver nitrate (55.5 g) and an aqueous halogen salt solution containing 1 mol/l of potassium bromide and 2×1 mol/l of $K_3IrCl_6$ were added by the control double jet method over 28 minutes and 30 seconds while pAg was maintained at 7.7. Then, the pH was lowered to cause coagulation precipitation to there by effect desalting, Compound A (0.17 g) and low molecular weight gelatin having an average molecular weight of 15,000 (23.7 g, calcium content: 20 ppm or less) were added, and pH and pAg were adjusted to 5.9 and 8.0, respectively. The grains obtained were cubic grains having an average grain size of 0.08 μm, a variation coefficient of the projected area of 9% and a [100] face ratio of 90%.

The temperature of the silver halide grains obtained as described above was raised to 60° C., and sodium benzenethiosulfonate (76 μmol per mole of silver) was added. After 3 minutes, sodium thiosulfate (154 μmol) was further added, then the grains were ripened for 100 minutes. After addition of $5\times10^{-4}$ mol of 4-hydroxy-6-methyl-1,3,3a,7-tetrazaindene, the mixture was cooled to 40° C.

Then, Sensitization Dye A and Compound B mentioned below were added in amounts of $12.8\times10^{-4}$ mol and $6.4\times10^{-3}$ mol per mole of silver halide with stirring while the emulsion is maintained at 40° C. After 20 minutes, the emulsion was quenched to 30° C. to complete the preparation of Silver halide emulsion A.

M-110S-EH, manufactured by Microfluidex International Corporation, using G10Z interaction chamber) under a pressure controlled to be 1,750 kg/cm$^2$ to obtain Organic acid silver salt dispersion A. The organic acid silver salt grains contained in the organic acid silver salt dispersion obtained as described above were acicular grains having an average short axis length of 0.04 μm, an average long axis length of 0.8 μm and a variation coefficient of 30%. The grain size was measured by Master Sizer X manufactured by Malvern Instruments Ltd. During the cooling operation, a desired dispersion temperature was achieved by providing coiled heat exchangers fixed before and after the interaction chamber and controlling the temperature of the refrigerant. Thus, Organic acid silver salt A having a silver behenate content of 85 mol % was obtained.

<<Preparation of solid fine grain dispersion of 1,1-bis(2-hydroxy-3,5-dimethylphenyl)-3,5,5-trimethylhexane)

To 1,1-bis(2-hydroxy-3,5-dimethylphenyl)-3,5,5-trimethylhexane (20 g), MP Polymer (3.0 g, MP-203, pro- Sensitization Dye A

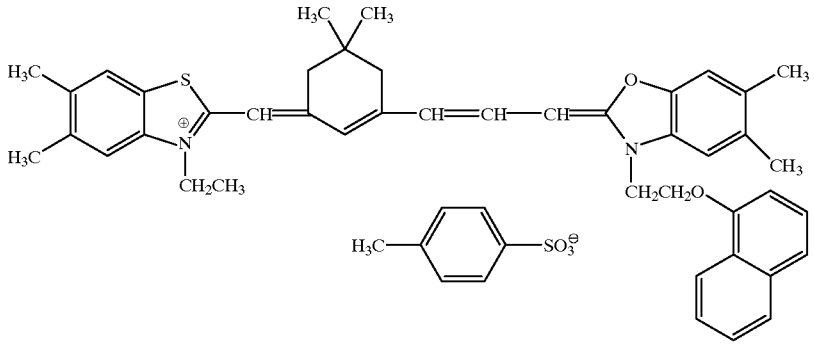

Compound A

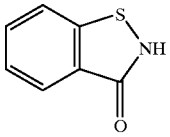

Compound B

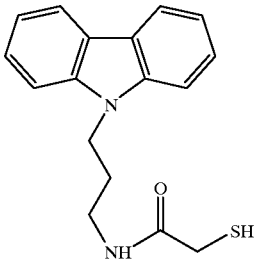

<<Preparation of organic acid silver salt dispersion>>

(organic silver salt A)

Arachic acid (6.1 g), behenic acid (37.6 g), distilled water (700 ml), tert-butanol (70 ml) and 1 N aqueous NaOH solution (123 ml) were mixed, allowed to react at 75° C. for 1 hour with stirring, and cooled to 65° C. Then, 112.5 ml of an aqueous solution containing silver nitrate (22 g) was added to the mixture over 45 seconds. The mixture was left for 5 minutes so that the temperature should be lowered to 30° C. Subsequently, the solid content was separated by suction filtration, and washed with water until the conductivity of the filtrate became 30 μS/cm. The solid content obtained as described above was not dried but hand led as a wet cake. To this wet cake corresponding to 100 g of dry solid content, 7.5 g of polyvinyl alcohol (trade name: PVA-217) and water were added to make the total amount of 500 g, and the resulting mixture was preliminarily dispersed in a homomixer.

Then, the preliminarily dispersed stock solution was treated three times in a dispersing machine (Microfluidizer duced by Kuraray Co., Ltd.) and water (77 ml) were added, and the mixture was thoroughly stirred to form a slurry. The resulting slurry was left for 3 hours. Then, 0.5-mm zirconia beads (360 g) were prepared and put together with the slurry into a vessel. The contents in the vessel were dispersed in a dispersing machine (1/4G Sand Grinder Mill, manufactured by Imex) for 3 hours to prepare a solid fine grain dispersion of reducing agent. In this dispersion, 80% by weight of the grains had a grain size of from 0.3 to 1.0 μm.

<<Preparation of solid fine grain dispersion of Polyhalogenated compound A>>

Polyhalogenated compound A (30 g) was added with MP Polymer (4 g, MP-203, produced by Kuraray Co., Ltd.), Compound C (0.25 g) and water (66 g) were added, and the mixture was thoroughly stirred to form a slurry. Then, 0.5-mm zirconia beads (200 g) were prepared and put together with the slurry into a vessel. The contents in the vessel were dispersed in a dispersing machine (1/16G Sand Grinder Mill, manufactured by Imex) for 5 hours to prepare a solid fine grain dispersion. In this dispersion, 80% by weight of the grains had a grain size of from 0.3 to 1.0 μm.

Polyhalogenated compound A

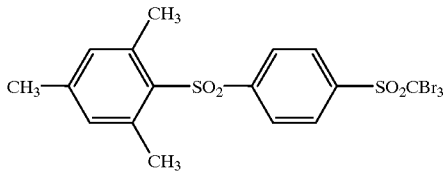

<<Preparation of coating solution for emulsion layer>>

The binder, raw materials shown below and Silver halide emulsion A were added to the organic silver salt microcrystal dispersion prepared above in the indicated amounts per one mole of silver in the dispersion, and water was added to the mixture to form a coating solution for emulsion layer.

| | |
|---|---|
| Binder: LACSTAR 3307B (SBR latex, produced by Dai-Nippon Ink & Chemicals, Inc., glass transition temperature: 17° C.) | 406 g as solid |
| -1,1-Bis(2-hydroxy-3,5-dimethyl-phenyl)-3,5,5-trimethylhexane | 119 g as solid |
| Compound of the formula (1) | Type and amount shown in Table 1 |
| Tribromomethylphenylsulfone | 11.6 g as solid |
| Solid fine grain dispersion of Polyhalogenated compound A (When a compound of the formula (1) was added, this compound was used in a reduced amount so that the total amount should be 0.1 mol.) | 0.1 mol |
| Sodium benzenethiosulfonate | 0.44 g |
| Benzotriazole | 1.25 g |
| Polyvinyl alcohol (PVA235, produced by Kuraray Co., Ltd.) | 10.0 g |
| iso-Propylphthalazine | 0.10 mol |
| Sodium o-dihydrogenphosphate | 0.13 g |
| Development inhibitor A | 9.38 g |
| Nucleating agent (Compound C-62) | 0.03 mol |
| Dye A | Amount affording optical density of 0.3 at 783 nm |
| Silver halide emulsion A | 0.05 mol as Ag |

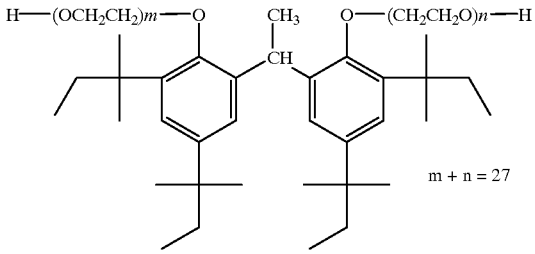

Compound C

-continued

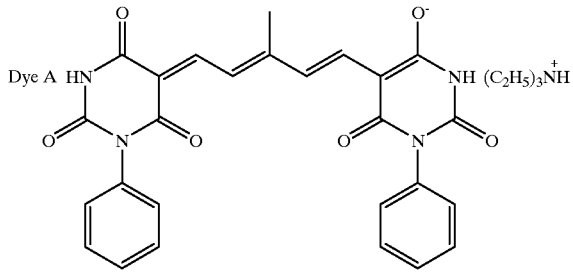

Development inhibitor A

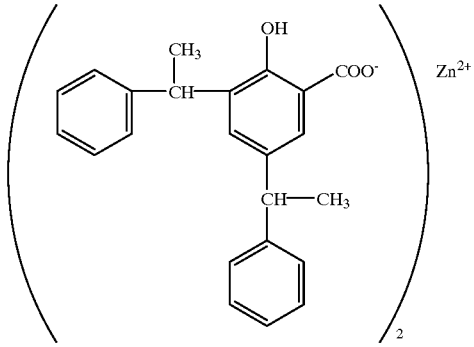

<<Preparation of coating solution for lower protective layer for emulsion layer surface>>

A polymer latex containing copolymer of methyl methacrylate/styrene/2-ethylhexyl acrylate/2-hydroxyethyl methacrylate/acrylic acid=58.9/8.6/25.4/5.1/2 (% by weight) (glass transition temperature: 57° C., solid content: 21.5% by weight, containing Compound D as a film-forming aid in an amount of 15% by weight relative to solid content of the latex, 956 g) was added with $H_2O$, Compound E (1.62 g), Compound G (2.3 g), matting agent (polystyrene particles, average diameter: 7 μm, 1.98 g) and polyvinyl alcohol (PVA-235, Kuraray Co., Ltd., 23.6 g) and further added with $H_2O$ to form a coating solution (pH 5.6).

<<Preparation of coating solution for upper protective layer for emulsion layer surface>>

A polymer latex containing copolymer of methyl methacrylate/styrene/2-ethylhexyl acrylate/2-hydroxyethyl methacrylate acrylic acid=58.9/8.6/25.4/5.1/2 (% by weight) (glass transition temperature: 54° C., solid content: 21.5% by weight, containing Compound D as a film-forming aid in an amount of 15% by weight relative to solid content of the latex, 630 g) was added with $H_2O$, carnauba wax (30% by weight solution of Cellosol 524, Chukyo Yushi Co., Ltd., 6.30 g), Compound E (0.72 g), Compound F (7.95 g), Compound G (0.7 g), matting agent (polystyrene particles, average diameter: 7 μm, 1.18 g) and polyvinyl alcohol (PVA-235, Kuraray Co., Ltd., 8.30 g) and further added with $H_2O$ to form a coating solution (pH 2.8).

Compound D

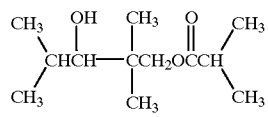

-continued

Compound E

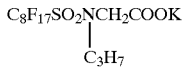

Compound F

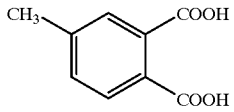

Compound G

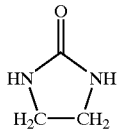

<<Preparation of heat-developable photosensitive material>>

On the undercoat layers of the aforementioned PET support coated with Undercoat layer (a) and Undercoat layer (b), the coating solution for emulsion layer was coated so that the coated silver amount should be 1.7 g/m$^2$. Further, the coating solution for lower protective layer for emulsion surface was coated on the emulsion layer simultaneously with the coating solution for emulsion layer as laminated layers, so that the coated solid content of the polymer latex should be 1.31 g/m$^2$. Then, the coating solution for upper protective layer for emulsion surfacewas coated on the coated layer, so that the coated solid content of the polymer latex should be 3.02 g/m$^2$, to form a heat-developable photosensitive material. The film surface pH of the obtained heat-developable photosensitive material on the image-forming layer side was 4.9, and the Beck smoothness was 660 seconds. As for the opposite surface, the film surface pH was 5.9 and the Beck smoothness was 560 seconds.

<<Evaluation of photographic performance>>

(Light exposure)

Each obtained heat-developable photosensitive material was preliminarily conditioned for moisture contentat 25° C. under 45% RH. Then, it was light exposed for $2\times10^{-8}$ seconds by using a laser light-exposure apparatus of single channel cylindrical inner surface type provided with a semiconductor laser with a beam diameter (½ of FWHM of beam intensity) of 12.56 $\mu$m, laser output of 50 mW and output wavelength of 783 nm. The exposure time was adjusted by controlling the mirror revolution number, and exposure was adjusted by changing output. The overlap coefficient (FWHM/pitch width of sub scanning) of the light exposure was 0.5.

(Heat development)

The light-exposed heat-developable photosensitive material was heat-developed by using a heat-developing apparatus as shown in FIG. 1, in which the roller surface material of the heat development section was composed of silicone rubber, and the flat surface consisted of Teflon non-woven fabric. The heat development was performed in the preheating section at 90–100° C. for 5 seconds, and in the heat development section at 120° C. for 20 seconds. The temperature precision as for the transverse direction was ±1° C.

(Evaluation of photographic performance)

The obtained image was evaluated by Macbeth TD904 densitometer (visible density). The measurement results were evaluated as Dmin, sensitivity (a reciprocal of the ratio of the exposure amount necessary for giving a density 1.0 higher than Dmin, expressed as a relative value), and γ (contrast). γ was defined as a gradient of a straight line connecting the points at densities of 0.2 and 2.5, with the abscissa being a logarithm of the exposure amount. The sensitivity was expressed by a relative value to the sensitivity of Sample No. 1 (Photographic performance 1) that was taken as 100.

(Development temperature latitude)

Each heat-developable photosensitive material was exposed in the same manner as described above, and subjected to development at 119° C. for 20 seconds and 122° C. for 20 seconds for evaluation. The results of the evaluation were expressed by sensitivity difference (Δlog E) affording a density of 1.0, and difference of Dmin (ΔDmin).

(Evaluation of image storability)

An unexposed sample was subjected to heat development (120° C., 20 seconds) in the same manner as described above, and irradiated with a Xe light source of 10000 luxat 25° C. under 50% RH. Thereafter, the storability was evaluated by increase of Dmin for a UV light (λ=365 nm).

The results are shown in Table 1. As clearly seen from the results shown in Table 1, the heat-developable photosensitive material according to the present invention exhibited little performance fluctuation due to temperature variation, and good image storability irrespective of the undercoat of the base.

TABLE 1

| | | Compound of formula (1) | | | | | Latitude for development temperature | | |
|---|---|---|---|---|---|---|---|---|---|
| | | | Addition amount | Photographic performance 1 | | | | | Image |
| Sample No. | Support | Type | (mol/mol Ag) | Sensitivity | γ | Dmin | Δ Log E | Δ Dmin | storability |
| 1 | I | — | — | 100 | 13 | 4.0 | 0.30 | 0.05 | +0.06 |
| 2 (Invention) | I | P-75 | $1\times10^{-2}$ | 98 | 13 | 3.9 | 0.10 | 0.02 | +0.01 |
| 3 (Invention) | I | P-75 | $3\times10^{-2}$ | 95 | 12.6 | 3.9 | 0.08 | 0.01 | +0.005 |
| 4 (Invention) | I | P-87 | $1\times10^{-2}$ | 98 | 13 | 3.9 | 0.09 | 0.02 | +0.01 |
| 5 (Invention) | I | P-87 | $3\times10^{-2}$ | 93 | 12.8 | 3.9 | 0.08 | 0.01 | +0.005 |
| 6 (Invention) | I | P-7 | $1\times10^{-2}$ | 95 | 13 | 3.9 | 0.10 | 0.01 | +0.01 |
| 7 (Invention) | I | P-7 | $3\times10^{-2}$ | 91 | 12 | 3.9 | 0.08 | 0.01 | +0.005 |
| 8 (Invention) | I | P-82 | $1\times10^{-2}$ | 98 | 12.8 | 3.9 | 0.08 | 0.01 | +0.005 |
| 9 (Invention) | I | P-82 | $3\times10^{-2}$ | 93 | 12.6 | 3.9 | 0.06 | 0.005 | +0.00 |
| 10 | II | — | — | 100 | 13 | 3.9 | 0.28 | 0.04 | +0.03 |
| 11 (Invention) | II | P-75 | $1\times10^{-2}$ | 98 | 13 | 3.8 | 0.08 | 0.01 | +0.01 |
| 12 (Invention) | II | P-75 | $3\times10^{-2}$ | 95 | 12.5 | 3.8 | 0.06 | 0.01 | +0.005 |
| 13 (Invention) | II | P-7 | $1\times10^{-2}$ | 98 | 12.5 | 3.8 | 0.08 | 0.01 | +0.005 |
| 14 (Invention) | II | P-7 | $3\times10^{-2}$ | 93 | 12.0 | 3.8 | 0.06 | 0.005 | +0.00 |

Example 2

Sample Nos. 4 and 11 obtained in Example 1 were light-exposed and developed in the same manner as in Example 1 so that a density of 4.0 should be obtained. Then, rate of dimensional change upon heat development, and rate of dimensional change over time after heat development were determined for the samples.

(Measurement method of rate of dimensional change upon heat development)

On a sample (5 cm×25 cm in size) light-exposed for the whole surface but before heat development, two holes each having a diameter of 8 mm were provided with a distance of about 200 mm, and the distance between the two holes was precisely measured by using a pin gauge of 1/1000 mm precision. The value measured at this time was represented by X (unit: mm). Then, the sample was heat-developed by using the heat-developing apparatus of FIG. 1 under a condition of 120° C. for 30 seconds, and then the distance was measured by the pin gauge after 120 minutes. The value measured at this time was represented by Y (unit: mm). The evaluation was obtained based on the value calculated in accordance with the following equation.

$$\text{Rate of dimensional change (\%)}=[(Y-X)/200]\times 100$$

(Measurement method of rate of dimensional change over time after heat development)

On a sample (5 cm×25 cm in size) light-exposed for the whole surface but before heat development, two holes each having a diameter of 8 mm were provided with a distance of about 200 mm, and the sample was heat-developed by using the heat-developing apparatus of FIG. 1 under a condition of 120° C. for 30 seconds. The distance was measured by a pin gauge of 1/1000 mm precision after 3 minutes. The value measured at this time was represented by $X_1$ (unit: mm). Then, the distance was measured after 240 minutes. The value measured at this time was represented by $Y_1$ (unit: mm).

This series of measurements were performed under atmospheres of 75% RH at 25° C. and 20% RH at 25° C., respectively.

The evaluation was obtained based on the value calculated in accordance with the following equation.

$$\text{Rate of dimensional change (\%)}=[(Y_1-X_1)/200]\times 100$$

The results are shown in Table 2. As clearly seen from the results shown in Table 2, it was revealed that Sample No. 4 utilizing Support I showed extremely small dimensional change due to heat treatment, in particular, dimensional change over time after the heat development.

TABLE 2

| | | Dimensional change ratio after heat development | | Dimensional change ratio with time at 20% RH | | Dimension change ratio with time at 75% RH | |
|---|---|---|---|---|---|---|---|
| Sample No. | Support | MD (%) | TD (%) | MD (%) | TD (%) | MD (%) | TD (%) |
| 4 | I | −0.004 | 0.013 | 0 | 0 | 0.010 | 0.009 |
| 11 | II | −0.005 | 0.014 | 0.001 | 0.001 | 0.040 | 0.041 |

MD: Machine Direction, TD: Transverse Direction

Example 3

The compounds used in Example 3 are listed below.

Sensitization Dye A

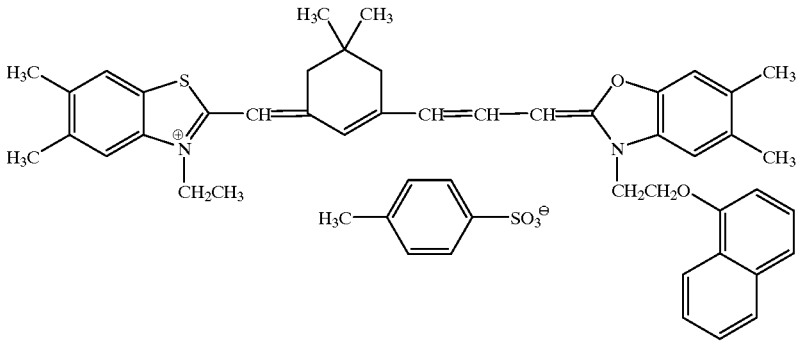

Compound A

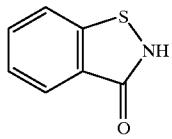

Compound B

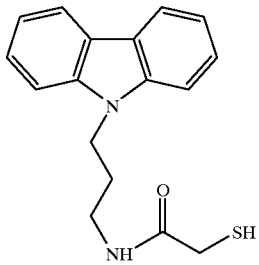

-continued

Polyhalogenated compound A

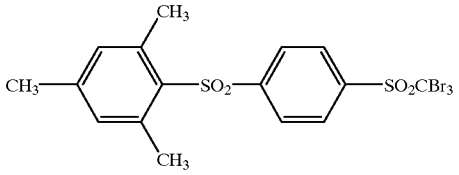

Compound Z

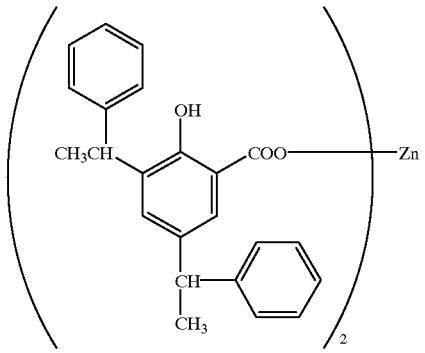

Dye A

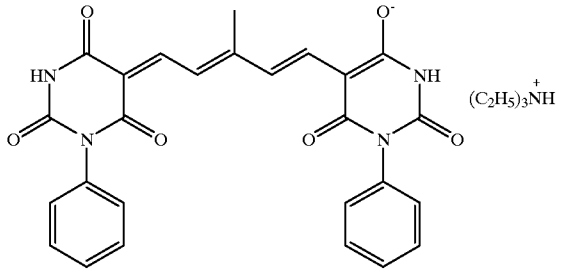

Compound H

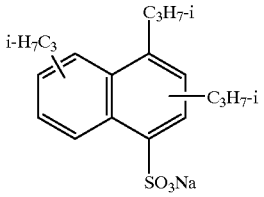

Compound D

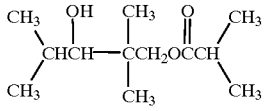

Compound E

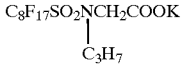

Compound G

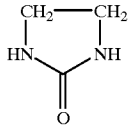

<<Preparation of silver halide emulsion>>

(Emulsion A)

In 700 ml of water, phthalized gelatin (11 g), potassium bromide (30 mg) and sodium benzenethiosulfonate (10 mg) were dissolved. After the solution was adjusted to pH 5.0 at a temperature of 55° C., 159 ml of an aqueous solution containing silver nitrate (18.6 g) and an aqueous solution containing 1 mol/l of potassium bromide were added by the control double jet method over 6 minutes and 30 seconds while pAg was maintained at 7.7. Then, 476 ml of an aqueous solution containing silver nitrate (55.5 g) and an aqueous halogen salt solution containing 1 mol/l of potassium bromide were added by the control double jet method over 28 minutes and 30 seconds while pAgwas maintained at 7.7. Then, the pH was lowered to cause coagulation precipitation to there by effect desalting, Compound A (0.17 g) and deionized gelatin (23.7 g, calcium content: 20 ppm or less) were added, and pH and pAg were adjusted to 5.9 and 8.0, respectively. The grains obtained were cubic grains having an average grain size of 0.11 μm, a variation coefficient of the projected area of 8% and a [100] face ratio of 93%.

The temperature of the silver halide grains obtained as described above was raised to 60° C., and added with sodium benzenethiosulfonate (76 μmol per mole of silver). After 3 minutes, sodium thiosulfate (154 μmol per mole of silver) was further added, and then the grains were ripened for 100 minutes.

Then, Sensitization Dye A and Compound B were added in amounts of $2.7\times10^{-3}$ mol and $8.2\times10^{-3}$ mol, respectively, per mole of silver halide with stirring while the emulsion was maintained at 40° C. After 20 minutes, the emulsionwas quenched to 30° C. to complete the preparation of Silver halide emulsion A.

<<Preparation of organic acid silver salt dispersion>>

<Organic acid silver salt A>

Organic silver acid salt A having a silver behenate content of 85 mol % was prepared in the same manner as in Example 1 except that 2.0 g of polyvinyl alcohol (trade name: PVA-217) was used for the wet cake corresponding to 100 g of dry solid content.

<<Preparation of solid fine grain dispersion of 1,1-bis(2-hydroxy-3,5-dimethylphenyl)-3,5,5-trimethylhexane)

To 1,1-bis(2-hydroxy-3,5-dimethylphenyl)-3,5,5-trimethylhexane (70 g), MP Polymer (14 g, MP-203, produced by Kuraray Co., Ltd.) and water (266 ml) were added, and the mixture was thoroughly stirred to form a slurry. Then, 0.5-mm zirconia silicate beads (960 g) were prepared and put together with the slurry into a vessel. The contents in the vessel were dispersed in a dispersing machine (1/4G Sand Grinder Mill, manufactured by Imex) for 5 hours, and then added with Compound-2 in such an amount that a concentration of 100 ppm should be obtained in the completed dispersion to prepare a solid fine grain dispersion of reducing agent. In this dispersion, 80% by weight of the fine grain had a grain size of from 0.3 to 1.0 μm. This solid fine grain dispersion of reducing agent will be referred to as "HP dispersion" hereinafter.

<<Preparation of solid fine grain dispersion of polyhalogenated compound>>

Polyhalogenated compound A (30 g) was added with MP Polymer (5.0 g, MP-203, produced by Kuraray Co., Ltd.), Compound H (0.21 g) and water (65 g), and the mixture was thoroughly stirred to form a slurry. Then, 0.5-mm zirconia silicate beads (200 g) were prepared and put together with the slurry into a vessel. The contents in the vessel were dispersed in a dispersing machine (1/16G Sand Grinder Mill, manufactured by Imex) for 5 hours, the n added with water (20 ml) and stirred for 10 minutes to prepare a solid fine grain dispersion. In this dispersion, grains had an average grain size of 0.35 μm and maximum grain size of 1.85 mm.

<<Preparation of solid fine grain dispersion of Compound Z>>

Compound Z (7.5 g) was added with MP Polymer (3 g, MP-203, produced by Kuraray Co., Ltd.) and water (90 ml), and the mixture was thoroughly stirred. Then, a dispersion was prepared in the same manner as used for the preparation of the solid fine grain dispersion of Antifoggant A.

<<Preparation of solid fine grain dispersion of nucleating agent>>

To Exemplary compound 62 (10 g), polyvinyl alcohol (PVA-217, 2.5 g, Kraray Co., Ltd.) and water (87.5 g) were added, and thoroughly mixed to form a slurry. Then, a dispersion was prepared in the same manner as used for the preparation of the solid fine grain dispersion of Antifoggant A.

<<Preparation of coating solution for emulsion layer>>

The binder, raw materials shown below and Silver halide emulsion A were added to the organic acid silver microcrystal dispersion prepared above in the indicated amounts per one mole of silver in the dispersion, and water was added to the mixture to form a coating solution for emulsion layer.

| | |
|---|---|
| Binder: LACSTAR 3307B (SBR latex, produced by Dai-Nippon Ink & Chemicals, Inc., glass transition temperature: 17° C.) | 470 g as solid |
| HP Dispersion | 166 g as HP solid content |
| Compound of the formula (5) | Type and amount shown in Table 3 |
| 6-Methylbenzotriazole | 1.36 g |
| Polyvinyl alcohol (PVA-235, produced by Kuraray Co., Ltd.) | 12.1 g |
| Solid fine grain dispersion of Antifoggant A | 34.1 g as Antifoggant A |
| Compound of the formula (1) (aqueous solution) | Type and amount shown in Table 3 |
| Solid dispersion of Compound Z | 10.5 g as compound Z |
| Sodium dihydrogenphosphate | 0.36 g |
| 6-iso-Propylphthalazine | 16.5 g |
| Dye A | 0.50 g |
| Silver halide emulsion A | 0.05 mol as Ag |
| Solid dispersion of high contrast agent, Exemplary Compound 62 | 17.1 g as Compound 62 |

<<Preparation of coating solution for protective layer for emulsion surface>>

Apolymer latex containing 27.5% by weight of solid content (copolymer of methyl methacrylate/styrene/2-ethylhexyl acrylate/2-hydroxyethyl methacrylate/acrylic acid=59/9/26/5/1, glass transition temperature of 55° C., 109 g) was added with $H_2O$ (3.75 g), benzyl alcohol (4.5 g) as a film-forming aid, Compound D (0. 4 5 g), Compound E (0. 12 5 g), 4-methylphthalic acid (1.7 g), Compound G(0. 59 g) and polyvinyl alcohol (PVA-2 35, Kuraray Co., Ltd., 0.285 g) and further added with $H_2O$ to a total amount of 150 g to form a coating solution.

<<Preparation of PET support with backing layer and undercoat layer>>

(1) Support

A support was prepared in the same manner as in Example 1.

(2) Undercoat layer (a)

Same as Undercoat layer (a-2) in Example 1.

(3) Undercoat layer (b)

| | |
|---|---|
| Alkali-treated gelatin ($Ca^{2+}$ content; 30 ppm, jelly strength; 230 g) | 50 mg/m$^2$ |
| Dye A | Amount affording optical density of 0.6 at 780 nm |

(4) Electroconductive layer

| | |
|---|---|
| Julimer ET-410 (Nihon Junyaku Co.) | 96 mg/m$^2$ |
| Gelatin | 50 mg/m$^2$ |
| Compound A | 0.2 mg/m$^2$ |
| Polyoxyethylene phenyl ether | 10 mg/m$^2$ |
| Sumitex Resin M-3 (water-soluble melamine resin, Sumitomo Chemical Co., Ltd.) | 18 mg/m$^2$ |
| Dye A | Amount affording optical density of 0.6 at 780 nm |
| $SnO_2$/Sb (weight ratio: 9/1, acicular grains, long axis/short axis = 20–30, Ishihara Sangyo Kaisha, Ltd.) | 120 mg/m$^2$ |
| Matting agent (Polymethyl methacrylate, average particle size: 5 μm) | 7 mg/m$^2$ |

(5) Protective layer

| | |
|---|---|
| Polymer latex 2 (copolymer of methyl methacrylate/styrene/2-ethylhexyl acrylate/2-hydroxyethyl methacrylate/acrylic acid = 59/9/26/5/1 (% by weight)) | 1000 mg/m$^2$ |
| Polystyrenesulfonate (molecular weight: 1000–5000) | 2.6 mg/m$^2$ |
| Cellosol 524 (Chukyo Yushi Co., Ltd.) | 30 mg/m$^2$ |
| Sumitex Resin M-3 (water-soluble melamine compound, Sumitomo Chemical Co., Ltd.) | 218 mg/m$^2$ |

On one side of the support, Undercoat layer (a) and Undercoat layer (b) were successively coated and dried at 180° C. for 4 minutes, respectively. Subsequently, on the surface opposite to the surface coated with Undercoat layer (a) and Undercoat layer (b), an electro conductive layer and a protective layer were successivelycoated and dried at 180° C. for 30 seconds, respectively, to prepare a PET support with backing/undercoat layers.

The PET support with backing/undercoat layers prepared as described above was introduced into a heat treatment zone set at 150° C. and having a total length of 30 m, and subjected to spontaneous transportation by gravity at a tension of 1.4 kg/cm$^2$ and a transportation speed of 20 m/minute. Then, the support was passed through a zone at 40° C. for 15 seconds, and taken up at a take-up tension of 10 kg/cm$^2$.

<<Preparation of heat-developable photosensitive material>>

On the undercoat layer of the PET support with backing/undercoat layers, the aforementioned coating solution for emulsion layer was coated to give a coated silver amount of 1.8 g/m$^2$. Coating solutions corresponding to the aforementioned coating solution for emulsion layer in which addition amounts of the compounds of the present invention (compounds of the formulas (1) and (5)) were changed were also prepared and coated on the support. The coated amounts are shown in Table 3. The coating solution for protective layer for emulsion surface was further coated on each emulsion layer so that the coated polymer latex amount should be 2.0 g/m$^2$ as a solid content.

<<Evaluation of photographic performance>>

(Light exposure)

Each of the obtained coated samples was exposed by a xenon flash light of an emission time of $10^{-6}$ seconds through an interference filter having a peak at 780 nm and a step wedge.

(Evaluation of storability of photosensitive material/performance fluctuation after thermal treatment)

Each coated sample was stored for 3 days in an environment of 50° C. and 75% RH, and then light-exposed in the same manner as described above.

(Heat development)

Each light-exposed heat-developable photosensitive material was heat-developed by using a heat-developing apparatus as shown in FIG. 1, in which the roller surface material was composed of silicone rubber, and the flat surface consisted of Teflon non-woven fabric. The heat development was performed at a transportation linear speed of 20 mm/second in the preheating section at 90–110° C. for 15 seconds (driving units of the preheating section and the heat development section were independent from each other, and speed difference as to the heat development section was adjusted to −0.5 to −1%), in the heat development section at 120° C. for 20 seconds and in the gradual cooling section for 15 seconds. The temperature precision as for the transverse direction was ±1° C.

(Evaluation of photographic performance)

The obtained image was evaluated by a densitometer. The measurement results were evaluated as Dmax, fog (Dmin), sensitivity (a reciprocal of the ratio of the exposure amount necessary for giving a density 1.5 higher than Dmin, expressed as a relative value), and γ. The sensitivity (S1.5) was expressed as a relative value to the sensitivity of Sample No. 101 that was taken as 100. γ (contrast) was defined to be a gradient of a straight line connecting the points at densities of 0.2 and 2.5, with the abscissa being a logarithm of the exposure amount.

Performance fluctuation after thermal treatment was evaluated by difference in Dmin (ΔDmin) between samples that were subjected or not subjected to thermal treatment before light exposure and heat development. Therefore, a smaller value indicates that fog is more unlikely to increase during storage of photosensitive materials, i.e., indicates more excellent storage stability.

The results are shown in Table 3

TABLE 3

| | Compound of formula (1) | | Compound of formula (5) | | Photographic performance (120° C.) | | | | Δ Dmin after heat | |
|---|---|---|---|---|---|---|---|---|---|---|
| Sample No. | Type | Mmol/mol Ag | Type | mmol/mol Ag | Dmin | S1.5 | γ | Dmax | development | Note |
| 101 | — | — | — | — | 0.35 | 100 | 23 | 4.8 | 1.25 | Comparative |
| 102 | P-60 | 92 | — | — | 0.25 | 95 | 22 | 4.7 | 0.42 | Comparative |
| 103 | — | — | T-2 | 2.2 | 0.31 | 98 | 22 | 4.7 | 0.77 | Comparative |
| 104 | Polyhalogenated compound-A (2-fold amount)* | | T-2 | 2.2 | 0.23 | 79 | 18 | 4.1 | 0.05 | Comparative |
| 105 | P-60 | 19 | T-2 | 2.2 | 0.11 | 76 | 24 | 4.8 | 0.01 | Invention |
| 106 | P-60 | 19 | T-4 | 2.2 | 0.12 | 81 | 23 | 4.7 | 0.01 | Invention |
| 107 | P-60 | 19 | T-14 | 2.2 | 0.12 | 85 | 22 | 4.8 | 0.02 | Invention |
| 108 | P-60 | 19 | T-20 | 2.2 | 0.11 | 83 | 22 | 4.7 | 0 | Invention |
| 109 | P-60 | 19 | T-31 | 2.2 | 0.13 | 89 | 22 | 4.8 | 0.03 | Invention |
| 110 | P-1 | 19 | T-2 | 2.2 | 0.12 | 83 | 24 | 4.8 | 0.02 | Invention |
| 111 | P-48 | 19 | T-2 | 2.2 | 0.13 | 85 | 24 | 4.8 | 0.02 | Invention |
| 112 | P-63 | 19 | T-2 | 2.2 | 0.12 | 74 | 23 | 4.8 | 0.02 | Invention |
| 113 | P-66 | 19 | T-2 | 2.2 | 0.12 | 85 | 22 | 4.8 | 0.01 | Invention |
| 114 | P-93 | 19 | T-2 | 2.2 | 0.13 | 89 | 22 | 4.8 | 0.03 | Invention |
| 115 | P-112 | 19 | T-2 | 2.2 | 0.13 | 87 | 24 | 4.6 | 0.05 | Invention |

*Two-fold amount of Polyhalogenated compound-A was added while no compound of formula (1) was added.

(Results)

From the results shown in Table 3, it can be seen that Sample No. 101 showed a high Dmin even as a sample not undergone the thermal treatment (fresh) and showed extremely high fog after thermal treatment. Sample Nos. 102 and 103 appeared to be improved compared with Sample No. 101, but improvement was not sufficient. Sample No. 104 showed further reduced Dmin as a fresh sample and after the thermal treatment compared with the former samples, i.e., it showed tendency of further improvement for Dmin, but it also showed significant decrease of Dmax. In contrast, Sample Nos. 105 to 115 showed low Dmin as fresh samples, and sufficient Dmax. In addition, they showed very little increase of fog even after the thermal treatment, and thus afforded good storability.

Example 4

1. Preparation of Silver Halide Emulsion (Emulsion A)

Silver halide emulsion A was prepared in the same manner as in Example 1 by using alkali-treated gelatin (calcium content: 2700 ppm or less, 11 g) instead of the phtalized gelatin and Compound I (0.17 g) instead of Compound A, and using the low molecular weight gelatin having an average molecular weight of 15,000 in an amount of 51.1 g and triethylthiourea in an amount of 71 μmol.

(Emulsion B)

Emulsion B was prepared in the same manner as used for Emulsion A except that Sensitization Dye B was added instead of Sensitization Dye A.

(Emulsion C)

Emulsion C was prepared in the same manner as used for Emulsion A except that Sensitization Dye C was added instead of Sensitization Dye A.

(Emulsion D: Comparative Example)
Emulsion D was prepared as a comparative example in the same manner as used for Emulsion A except that Sensitization Dye D was added instead of Sensitization Dye A.
Sensitization Dye A
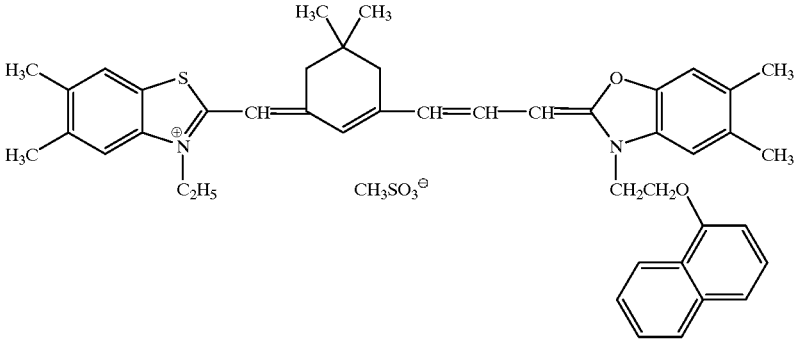
Sensitization Dye B
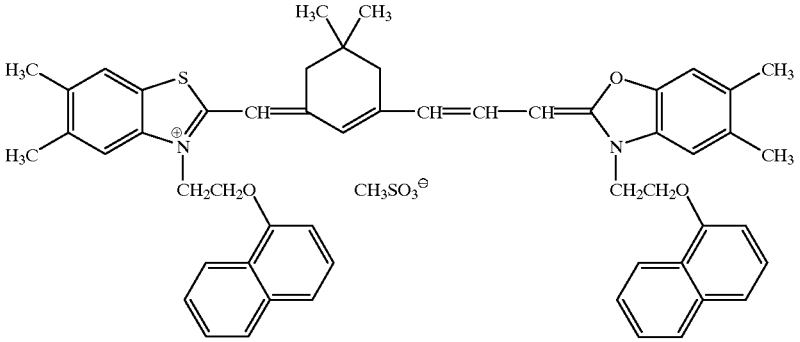
Sensitization Dye C
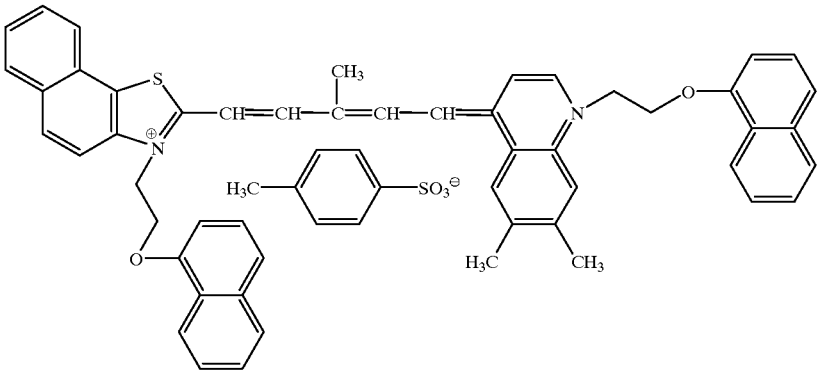
Sensitization Dye D
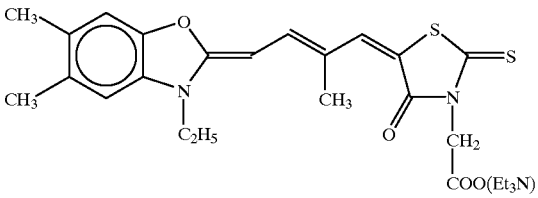
Compound I
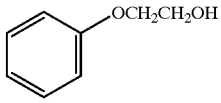
Compound B
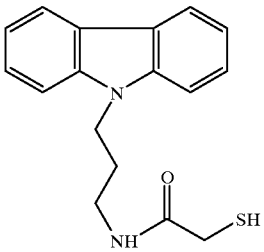

2. Preparation of Organic Silver Salt Dispersion (Organic silver salt A)

Behenic acid (87.6 g, product name: Edenor C22–85R, Henkel Corp.), distilled water (423 ml), 5 NNaOH aqueous solution (49.2 ml) and tert-butyl alcohol (120 ml) was mixed and allowed to react at 750C for 1 hour with stirring to prepare a sodium behenate solution. Separately, an aqueous solution (206.2 ml) of silver nitrate (40.4 g) was prepared and maintained at 110° C. A reaction vessel containing distilled water (635 ml) and tert-butylalcohol (30 ml) was maintained at 30° C., and added with the whole volumes of the sodium behenate solution and the aqueous silver nitrate solution with stirring at constant flow rates over 62 minutes and 10 seconds, and 60 minutes, respectively. This operation was designed so that only the aqueous silver nitrate solution should be added for 7 minutes and 20 seconds after starting the addition of the aqueous silver nitrate solution. Then, addition of the sodium behenate solution was started so that only the sodium behenate solution should be added for 9 minutes and 30 seconds afterthe completionof the additionof the aqueous silver nitrate solution. During this procedure, the internal temperature of the reaction vessel was maintained to be 30° C., and controlled so that the mixture temperature should not be raised. Piping of sodium behenate solution addition system was warmed by a steam tracing, and steam amount was controlled so that the solution temperature at the outlet of addition nozzle tip should be 75° C. Further, piping of the aqueous silver nitrate solution addition system consisted of a double pipe system, and was cooled by circulating cooled water between the inner pipe and the outer pipe. The addition points of the sodium behenate solution and the aqueous silver nitrate solution were symmetrically located with respect to a stirring axis, and the ir heights were controlled so as not to contact with the reaction mixture.

After the completion of the addition of the sodium behenate solution, the mixture was left at that temperature for 20 minutes with stirring so that the temperature of the mixture should be lowered to 25° C. Thereafter, the solid content was separated by suction filtration, and washed with water until the conductivity of the filtrate became 30 $\mu$S/cm. The solid content obtained as described above was not dried but stored as a wet cake.

The shape of the obtained silver behenate grains was analyzed by electron microphotography. The obtained grains were scale crystals having an average projected area diameter of 0.52 $\mu$m, an average grain thickness of 0.14 $\mu$m, and an average spherical diameter variation coefficient of 15%.

Then, a silver behenate dispersion was produced as follows. To the wet cake corresponding to 100 g of dry solid content, 7.4 g of polyvinyl alcohol (trade name: PVA-217, average polymerization degree: about 1700) and water were added to make the total amount of 385 g, and the resulting mixture was preliminarily dispersed in a homomixer. Then, the preliminarily dispersed stock solution was treated three times in a dispersing machine (trade name: Microfluidizer M-110S-EH, manufactured by Microfluidex International Corporation, using G10Z interaction chamber) under a pressure controlled to be 1,750 kg/cm$^2$ to obtain a silver behenate dispersion. During the cooling operation, a desired dispersion temperature was established by providing coiled heat exchangers fixed before and after the interaction chamber and controlling the temperature of the refrigerant.

The silver behenate grains contained in the silver behenate dispersion obtained as described above were grains having a volume weighted mean diameter of 0.52 $\mu$m, and a variation coefficient of 15%. The grainsize was measured by Master Sizer X manufactured by Malvern Instruments Ltd. Further, when the grains were evaluated by electron microphotography, the grains have a ratio of long side length and short side length of 1.5, grain thickness of 0.14 $\mu$m, and an average aspect ratio (ratio of circular diameter of projected area of grain and grain thickness) of 5.1.

3. 1,1-Bis(2-hydroxy-3,5-dimethylphenyl)-3,5,5-trimethyihexane: Preparation of Solid Fine Grain Dispersion of Reducing Agent To 1,1-bis(2-hydroxy-3,5-dimethylphenyl)-3,5,5-trimethylhexane (25 g), a 20% by weight aqueous solution of MP Polymer (25 g, MP-203, produced by Kuraray Co., Ltd.), Safinol 104E (Nisshin Kagaku Co., Ltd., 0.1 g), methanol (2 g) and water (48 ml) were added, and the mixture was thoroughly stirred to form a slurry. The resulting slurry was left for 3 hours. Then, 1 mm zirconia beads (360 g) were prepared and put together with the slurry into a vessel. The contents in the vessel were dispersed in a dispersing machine (1/4G Sand Grinder Mill, manufactured by Imex) for 3 hours to prepare a solid fine grain dispersion of reducing agent. In this dispersion, 80% by weight of the grains had a particle size of from 0.3 to 1.0 $\mu$m.

4. Preparation of Solid Fine Grain Dispersion of Polyhalogenated Compound

Polyhalogenated compound-A (30 g) was added with MP Polymer (4.0 g, MP-203, produced by Kurarayco., Ltd.), compoundC (0.25 g) and water (66 g), and the mixture was thoroughly stirred to form a slurry. Then, 0.5-mm zirconia silicate beads (200 g) were prepared and put together with the slurry into a vessel. The contents in the vessel were dispersed in a dispersing machine (1/16G Sand Grinder Mill, manufactured by Imex) for 5 hours to prepare a solid fine grain dispersion. In this dispersion, 80% by weight of the grains had a grain size of from 0.3 to 1.0 $\mu$m.

A solid fine grain dispersion of Polyhalogenated compound-B was also prepared in the same manner as for Polyhalogenated compound-A. The grains in this dispersion had a similar grain size.

5. Preparation of Solid Fine Grain Dispersion of Nucleating Agent

Each nucleating agent shown in Table 4 (10 g) was added with polyvinyl alcohol (2.5 g, PVA-217, produced by Kuraray Co., Ltd.) and water (87.5 g), and the mixture was thoroughly stirred to form a slurry. The slurry was left for 3 hours. Then, 0.5-mm zirconia beads (240 g) were prepared and put together with the slurry into a vessel. The contents in the vessel were dispersed in a dispersing machine (1/4G Sand Grinder Mill, manufactured by Imex) for 10 hours to prepare a solid fine grain dispersion. In this dispersion, 80% by weight of the grain had a particle size of from 0.1 to 1.0 $\mu$m, and the average grain size was 0.5 $\mu$m.

6. Preparation of Solid Fine Grain Dispersion of Compound Z

Compound Z (30 g) was added with MP Polymer (3 g, MP-203, produced by Kuraray Co., Ltd.) and water (87 ml), and the mixture was thoroughly stirred to form a slurry. The slurry was left for 3 hours. Then, a dispersion was prepared in the same manner as used for the aforementioned preparation of the solid fine grain dispersion of reducing agent. In this dispersion, 80% by weight of the grains had a particle size of from 0.3 to 1.0 $\mu$m.

7. Preparation of Coating Solution for Emulsion Layer

The binder, raw materials shown below and Silver halide emulsion A were added to the organic acid silver microcrystal dispersion prepared above in the indicated amounts per one mole of silver in the dispersion, and water was added to the mixture to form a coating solution for emulsion layer.

| | |
|---|---|
| Binder: LACSTAR 3307B (SBR latex, produced by Dai-Nippon Ink & Chemicals, Inc., glass transition temperature: 17° C.) | 397 g as solid |
| 1,1-Bis(2-hydroxy-3,5-dimethylphenyl)-3,5,5-trimethylhexane | 149 g as solid |
| Polyhalogenated compound-A | 0.06 mol as solid |
| Nucleating agent | Type and amount (mol) shown in Table 4 |
| Organic polyhalogenated compound of the formula (1) | Type and amount (mol) shown in Table 4 |
| Polyhalogenated compound-B | Type and amount (mol) as solid shown in Table 4 |
| Sodium ethylthiosulfonate | 0.30 g |
| Benzotriazole | 1.04 g |
| Polyvinyl alcohol (PVA235, produced by Kuraray Co., Ltd.) | 10.8 g |
| iso-Propylphthalazine | 15.0 g |
| Sodium o-dihydrogenphosphate dihydrate | 0.37 g |
| Compound Z | 9.7 g as solid |
| Dye A | Amount affording optical density of 0.3 at 783 nm (about 0.37 g) |
| Silver halide emulsion (type shown in Table 4) | 0.06 mol as Ag |

Polyhalogenated compound A

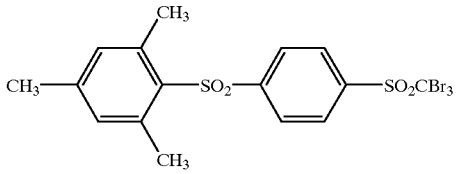

Polyhalogenated compound B

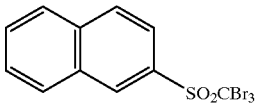

Compound Z

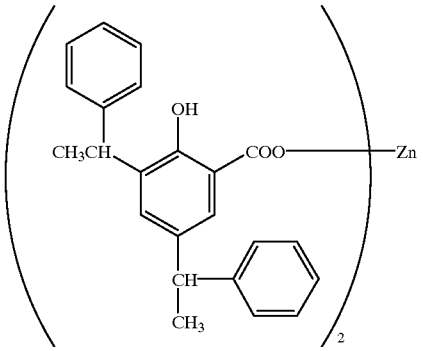

-continued

Dye A

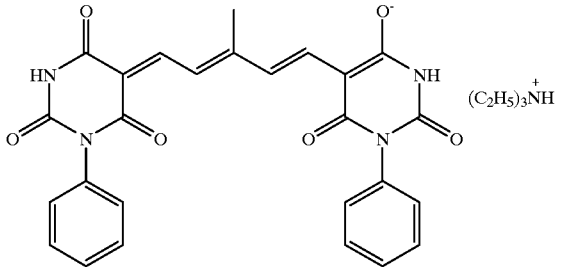

Compound H

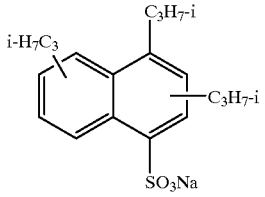

8. Preparation of Coating Solution for Lower Protective Layer for Emulsion Layer Surface A polymer latex containing copolymer of methyl methacrylate styrene/2-ethylhexyl acrylate/2-hydroxyethyl methacrylate acrylic acid=58.9/8.6/25.4/5.1/2 (% by weight) (glass transition temperature: 57° C., solid content: 21.5% by weight, average particle diameter: 120 nm, containing Compound D as a film-forming aid in an amount of 15% by weight relative to solid content of the latex) (956 g) was added with $H_2O$, Compound E (1.62 g), matting agent (polystyrene particles, average diameter: 7 μm, 1.98 g) and polyvinyl alcohol (PVA-235, Kuraray Co., Ltd., 23.6 g) and further added with $H_2O$ to form a coating solution.

9. Preparation of Coating Solution for Upper Protective Layer for Emulsion Layer Surface A polymer latex containing copolymer of methyl methacrylate styrene/2-ethylhexyl acrylate/2-hydroxyethyl methacrylate/acrylic acid=58.9/8.6/25.4/5.1/2 (% by weight) (glass transition temperature: 54° C., solid content: 21.5% by weight, average particle diameter: 70 nm, containing Compound D as a film-forming aid in an amount of 15% by weight relative to solid content of the latex)(630 g) was added with $H_2O$, 30% by weight solution of carnauba wax (Cellosol 524, Chukyo Yushi Co., Ltd., 6.30 g), Compound E (0.72 g), Compound F (7.95 g), CompoundG (0.9 g), matting agent (polystyrene particles, average diameter: 7 μm, 1.18 g) and polyvinyl alcohol (PVA-235, Kuraray Co., Ltd., 8.30 g) and further added with $H_2O$ to form a coating solution.

Compound D

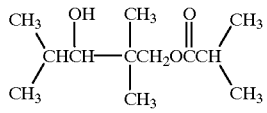

Compound E

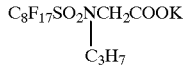

-continued

Compound F

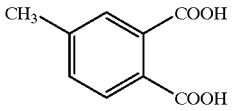

Compound G

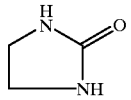

10. Preparation of PET Support with Backing Layer and Undercoat Layer (1) Support A support was prepared in the same manner as in Example 1.

(2) Undercoat Layer (a)

Same as Undercoat layer (a-1) in Example 1.

(3) Undercoat Layer (b)

| | |
|---|---|
| Deionized gelatin ($Ca^{2+}$ content; 0.6 ppm, jelly strength; 230 g) | 50 mg/m$^2$ |

(4) Electroconductive layer

| | |
|---|---|
| Julimer ET-410 (Nihon Junyaku Co.) | 96 mg/m$^2$ |
| Alkali-treated gelatin (molecular weight: about 10000, $Ca^{2+}$ content: 30 ppm) | 42 mg/m$^2$ |
| Deionized gelatin ($Ca^{2+}$ content: 0.6 ppm) | 8 mg/m$^2$ |
| Compound A | 0.2 mg/m$^2$ |
| Polyoxyethylene phenyl ether | 10 mg/m$^2$ |
| Sumitex Resin M-3 (water-soluble melamine resin, Sumitomo Chemical Co., Ltd.) | 18 mg/m$^2$ |
| Dye A | Amount affording optical density of 1.2 at 783 nm |
| $SnO_2$/Sb (weight ratio: 9/1, acicular grains, long axis/short axis = 20–30, Ishihara Sangyo Kaisha, Ltd.) | 160 mg/m$^2$ |
| Matting agent (Polymethyl methacrylate, average particle size: 5 $\mu$m) | 7 mg/m$^2$ |

(5) Protective Layer

Same as Example 1

(6) Preparation of PET Support with Backing/undercoat Layers

On both sides of the support (base), Undercoat layer (a) and Undercoat layer (b) were successively coated and dried at 180° C. for 4 minutes, respectively. Subsequently, on one side of the surfaces coated with Undercoat layer (a) and Undercoat layer (b), an electro conductive layer and a protective layer were successively coated and dried at 180° C. for 4 minutes, respectively, to prepare a PET support with backing/undercoat layers. The dry thickness of Undercoat layer (a) was 2.0 $\mu$m.

(7) Heat Treatment During Transportation

The PET support was subjected to heat treatment during transportation in the same manner as in Example 1.

Compound A

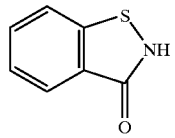

Dye A

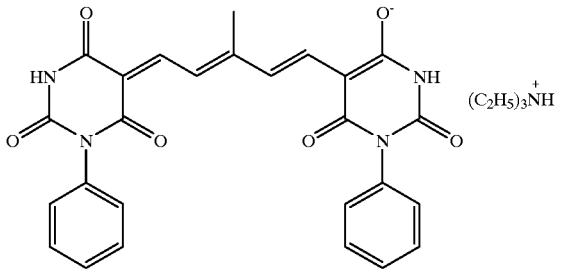

11. Preparation of Heat-developable Photosensitive Material

Each heat-developable photosensitive material was prepared in the same manner as in Example 1 except that the coating solution for emulsion layer was used in an amount affording a coated silver amount of 1.6 q/m$^2$. The film surface pH of the obtained heat-developable photosensitive material on the image-forming layer side was 4.9, and the Beck smoothness was 660 seconds. As for the opposite surface, the film surface pH was 5.9 and the Beck smoothness was 560 seconds.

12. Evaluation of Photogaphic Performance (Light exposure)

Each obtained heat-developable photosensitive material was light exposed for $2\times10^{-8}$ seconds by using a laser light-exposure apparatus of single channel cylindrical inner surface type provided with a semiconductor laser with a beam diameter (1/2 of FWHM of beam intensity) of 12.56 $\mu$m, laser output of 50 mW and output wavelength of 783 nm. The exposure time was adjusted by controlling the mirror revolution number, and exposure was adjusted by changing output. The overlap coefficient during the light exposure was 0.449.

(Heat development)

The light-exposed heat-developable photosensitive material was heat-developed by using a heat-developing apparatus as shown in FIG. 1, in which the roller surface material was composed of silicone rubber, and the flat surface consisted of Teflon non-woven fabric. The heat development was performed at a transportation linear speed of 20 mm/second in the preheating sectionat 90–110° C. for 15 seconds (driving units of the preheating section and the heat development section were independent from each other, and speed difference as to the heat development section was adjusted to −0.5 to −1%), in the heat development section at 120° C. for 20 seconds and in the gradual cooling section for 15 seconds. The temperature precision as for the transverse direction was ±1° C.

(Evaluation of photographic performance)

The obtained image was evaluated by Macbeth TD904 densitometer (visible density). The measurement results were evaluated as Dmin, sensitivity (a reciprocal of the ratio of the exposure amount necessary for giving a density 1.0 higher than Dmin, expressed as a relative value to the sensitivity of Heat-developable photosensitive material 204 mentioned in Table 4 that was taken as 100), Dmax and γ (contrast). γ was defined as a gradient of a straight line connecting the points at densities of 0.2 and 2.5, with the abscissa being a logarithm of the exposure amount. As for evaluation of storability, each heat-developable photosensitive material after the coating operation was stored as it was in the dark at 50° C. in a humidity of 75% RH, which as established with steam, for 3 days. Then, it was subjected to light exposure and heat development as described above, and evaluated for Dmin, sensitivity, Dmax and γ (contrast).

The results of the above evaluation for each heat-developable photosensitive material are shown in Table 4.

TABLE 4

| Heat-developable photosensitive material | Emulsion | Nucleating agent Type | Nucleating agent Addition amount (mol) | Compound of formula (1) Type | Compound of formula (1) Addition amount (mol) | Polyhalogenated compound B Addition amount (mol) | Performance before time lapse Dmin | Performance before time lapse Dmax | Performance before time lapse Sensitivity | Performance before time lapse γ | Performance after 3 days at 50° C. 75% RH Dmin | Performance after 3 days at 50° C. 75% RH Dmax | Performance after 3 days at 50° C. 75% RH Sensitivity | Performance after 3 days at 50° C. 75% RH γ |
|---|---|---|---|---|---|---|---|---|---|---|---|---|---|---|
| 201 | A | — | — | — | — | — | 0.14 | 1.5 | 58 | — | 0.38 | 1.5 | 70 | — |
| 202 | A | — | — | — | — | 0.02 | 0.12 | 1.5 | 56 | — | 0.32 | 1.5 | 68 | — |
| 203: invention | A | — | — | P-82 | 0.02 | — | 0.11 | 1.5 | 55 | — | 0.12 | 1.5 | 58 | — |
| 204 | A | C-62 | 0.03 | — | — | 0.02 | 0.14 | 4 | 100 | 12 | 0.36 | 4.2 | 114 | 5 |
| 205: Invention | A | C-62 | 0.03 | P-82 | 0.02 | — | 0.12 | 4 | 98 | 12 | 0.13 | 4.2 | 105 | 12 |
| 206: Invention | A | C-62 | 0.03 | P-62 | 0.02 | — | 0.12 | 4 | 96 | 12 | 0.12 | 4.1 | 98 | 12 |
| 207: Invention | A | C-62 | 0.03 | P-60 | 0.02 | — | 0.12 | 4 | 98 | 12 | 0.13 | 4.2 | 102 | 12 |
| 208: Invention | B | C-62 | 0.03 | P-82 | 0.02 | — | 0.12 | 4 | 100 | 12 | 0.12 | 4.1 | 101 | 12 |
| 209: Invention | C | C-62 | 0.03 | P-82 | 0.02 | — | 0.11 | 4 | 90 | 12 | 0.11 | 4.1 | 92 | 12 |
| 210 | D | C-62 | 0.03 | P-82 | 0.02 | — | 0.21 | — | — | — | 0.21 | — | — | — |
| 211 | D | C-62 | 0.03 | — | — | 0.02 | 0.22 | — | — | — | 0.32 | — | — | — |
| 212: Invention | A | C-1 | 0.01 | P-60 | 0.02 | — | 0.12 | 4 | 96 | 12 | 0.13 | 4.1 | 98 | 12 |
| 213: Invention | A | C-8 | 0.01 | P-60 | 0.02 | — | 0.12 | 3.9 | 93 | 11 | — | 4 | 95 | 11 |
| 214: Invention | A | H-1 | 0.01 | P-60 | 0.02 | — | 0.13 | 4 | 95 | 10 | 0.15 | 4.1 | 105 | 9 |

H-1: N-(2-methoxyphenyl)-N'-formylhydrazine

It can be seen that good performance, including low Dmin (fog), little increaseof fog and little sensitivity fluctuation during storage, was obtained in the heat-developable photosensitive materials of the present invention. Further, it can also be seen that, when a nucleating agent was used, it was possible to obtain images of high Dmax, and in addition, fog and sensitivity fluctuation during storage could be reduced in the heat-developable photosensitive materials of the present invention. It can also be seen that the use of the compounds of the formulas (2) to (4) was more excellent in the improvement of fog and sensitivity fluctuation during storage as compared with use of the formylhydrazine compound. It can further be seen that photographic sensitivity was low and Dmin was high in Comparative Examples 210 and 211, because the spectral sensitization was not infrared sensitization in them.

From the above, the advantages of the present invention were clearly demonstrated.

EXAMPLE 5

Heat-developable photosensitive materials 204 (Comparative) and 205 (Invention) mentioned in Example 4 were packaged according to the roll packaging disclosed in JP-A-6-214350 to obtain light-shielded roll packages (package form of completed products) of a material having a width of 61 cm and a length of 59 m.

The humidity in these packages in the package form of completed products was estimated to be 25% RH at 25° C. based on the moisture content of the heat-developable photosensitive materials.

The storability test was performed for these packages in the of package form of completed products at 50° C. for 3 days in the same manner as in Example 4, and evaluation was performed also in the same manner as in Example 4.

The obtained results were substantially similar to the results of Example 4, and it could be confirmed that the small increase of Dmin and little sensitivity fluctuation of Heat-developable photosensitive material 205 according to the present invention could also be attained in the packaged form. Thus, the advantages of the present invention were clearly demonstrated.

What is claimed is:

1. A heat-developable photosensitive material wherein the photosensitive material comprises, on a support an image-forming layer containing at least (a) non-photosensitive organic silver salt, (b) photosensitive silver halide, (c) a reducing agent, and (d) a binder, and a protective layer on the image-forming layer, polymer latexes are used as binders of the image-forming layer and the protective layer, and the photosensitive material further comprises, on the image-forming layer side, (e) a nucleating agent and (f) one or more compounds represented by the following formula (1):

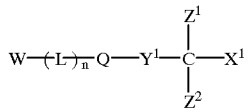

(1)

wherein, in the formula (1), $Z^1$ and $Z^2$ each independently represent a halogen atom, $X^1$ represents a hydrogen atom or an electron withdrawing group, $Y^1$ represents —CO— group or —$SO_2$— group, Q represents an arylene group which may have a substituent or a divalent heterocyclic group which may have a substittient, L represents a linking group, W represents carboxyl group or a salt thereof, sulfo group or a salt thereof, phosphoric acid group, hydroxyl group, a quaternary ammonium group, or a polyethyleneoxy group, and n represents 0 or 1, and wherein said material further contains, on the side of the support provided with the photosensitive silver halide, at least one compound represented by the following formula (5):

$$Z^{11}—SO_2SM \quad (5)$$

wherein, in the formula (5), $Z^{11}$ represents an aliphatic hydrocarbon group, an aryl group or a heterocyclic group, and M represents a cation.

2. The heat-developable photosensitive material according to claim 1, wherein the nucleating agent consists of one or more of a substituted alkene derivative represented by the following formula (2), a substituted isoxazole derivative represented by the following formula (3), and an acetal compound represented by the following formula (4):

(2)

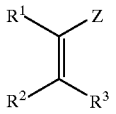

(3)

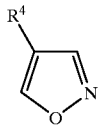

(4)

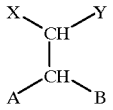

wherein, in the formula (2), $R^1$, $R^2$ and $R^3$ each independently represents a hydrogen atom or a substituent, and Z represents an electron withdrawing group or a silyl group; and $R^1$ and Z, $R^2$ and $R^3$, $R^1$ and $R^2$, or $R^3$ and Z may be combined with each other to form a ring structure;

in the formula (3), $R^4$ represents a substituent; and in the formula (4), X and Y independently represent a hydrogen atom or a substituent, A and B independently represent an alkoxy group, an alkylthio group, an alkylamino group, an aryloxy group, an arylthio group, an anilino group, a heterocyclyloxy group, a heterocyclylthio group or a heterocyclylamino group, and X and Y, or A and B may be combined with each other to form a ring structure.

3. The heat-developable photosensitive material according to claim 1, wherein the support has, on both surfaces, one or more undercoat layers which have a thickness of 0.3 $\mu$m or more (total thickness for each surface) and contain a vinylidene chloride copolymer containing at least 70% by weight of repeating units of vinylidene chloride monomers.

4. The heat-developable photosensitive material according to claim 1, wherein the nucleating agent consists of one or more compounds represented by the formula (A) or (B).

(A)

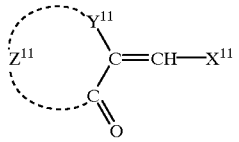

(B)

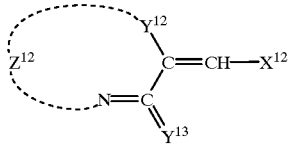

wherein, in the formula (A) and (B), $Z^{11}$ and $Z^{12}$ each represent a nonmetallic atomic group which can form a 5- to 7-membered ring structure including $Z^{11}$ and $Z^{12}$, $Y^{11}$ and $Y^{12}$ each represent —C(=O)— group or —$SO_2$— group, and $X^{11}$ and $X^{12}$ each represent hydroxyl group (or a salt thereof), an alkoxy group, an aryloxy group, a heterocyclyloxy group, mercapto group (or a salt thereof), an alkylthio group, an arylthio group, a heterocyclylthio group, amino group, an alkylamino group, an arylamino group, a heterocyclylamino group, an acylamino group, a sulfonamide group, or a heterocyclic group; and $Y^{13}$ represents a hydrogen atom or a substituent.

5. The heat-developable photosensitive material according to claim 1, which contains, on the side of the support provided with the photosensitive silver halide, at least one compound represented by the following formula (Z).

(Z)

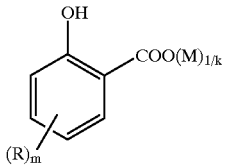

wherein, in the formula (Z), M represents a hydrogen atom or a k-valent cation, and R represents a substituent; m represents an integer of 1–4; when n is 2 or higher number, a plurality of Rmay be the same or different; k is an integer of 1 or higher; and when M is a hydrogen atom, k is 1.

6. The heat-developable photosensitive material according to claim 2, which contains, on the side of the support provided with the photosensitive silver halide, at least one compound represented by the following formula (Z).

(Z)

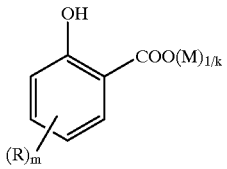

wherein, in the formula (Z), M represents a hydrogen atom or a k-valent cation, and R represents a substituent; m represents an integer of 1–4; when n is 2 or higher number, a plurality of R may be the same or different; k is an integer of 1 or higher; and when M is a hydrogen atom, k is 1.

7. The heat-developable photosensitive material according to claim 4, which contains, on the side of the support provided with the photosensitive silver halide, at least one compound represented by the following formula (Z).

(Z)

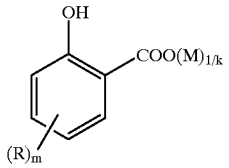

wherein, in the formula (Z), M represents a hydrogen atom or a k-valent cation, and R represents a substituent; m represents an integer of 1–4; when n is 2 or higher number, a plurality of R may be the same or different; k is an integer of 1 or higher; and when M is a hydrogen atom, k is 1.

8. The heat-developable photosensitive material according to claim 1, which has a film pH of 6.0 or less.

9. The heat-developable photosensitive material according to claim 2, which has a film pH of 6.0 or less.

10. The heat-developable photosensitive material according to claim 4, which has a film pH of 6.0 or less.

11. The heat-developable photosensitive material according to claim 2, which further contains, on the side of the support provided with the photosensitive silver halide, at least one compound represented by the following formula (5)

$$Z^{11}—SO_2SM \quad (5)$$

wherein, in the formula (5), $Z^{11}$ represents an aliphatic hydrocarbon group, an aryl group or a heterocyclic group, and M represents a cation.

12. The heat-developable photosensitive material according to claim 4, which further contains, on the side of the support provided with the photosensitive silver halide, at least one compound represented by the following formula (5)

$$Z^{11}—SO_2SM \quad (5)$$

wherein, in the formula (5), $Z^{11}$ represents an aliphatic hydrocarbon group, an aryl group or a heterocyclic group, and M represents a cation.

13. The heat-developable photosensitive material according to claim 1, wherein the photosensitive silver halide is subjected to spectral sensitization in the range of 750–1400 nm.

14. The heat-developable photosensitive material according to claim 2, wherein the photosensitive silver halide is subjected to spectral sensitization in the range of 750–1400 nm.

15. The heat-developable photosensitive material according to claim 4, wherein the photosensitive silver halide is subjected to spectral sensitization in the range of 750–1400 nm.

16. The heat-developable photosensitive material according to claim 1, wherein the polymer latex of the image-forming layer comprises a polymer latex having a glass transition temperature of −30 to 40° C. in an amount of at least 50% by weight.

17. The heat-developable photosensitive material according to claim 2 wherein the polymer latex of the image-forming layer comprises a polymer latex having a glass transition temperature of −30 to 40° C. in an amount of at least 50% by weight.

18. The heat-developable photosensitive material according to claim 4, wherein the polymer latex of the image-forming layer comprises a polymer latex having a glass transition temperature of −30 to 40° C. in an amount of at least 50% by weight.

* * * * *